US009650172B2

(12) United States Patent
Ojima et al.

(10) Patent No.: US 9,650,172 B2
(45) Date of Patent: May 16, 2017

(54) CAN LID AND DRINK CAN

(75) Inventors: Shinichi Ojima, Tokyo (JP); Kazunori Ikeda, Tokyo (JP); Kenyu Muraoka, Tokyo (JP); Tetsuo Kashiwazaki, Tokyo (JP); Asumi Suwa, Tokyo (JP)

(73) Assignee: SHOWA ALUMINUM CAN CORPORATION, Toyo (JP)

( * ) Notice: Subject to any disclaimer, the term of this patent is extended or adjusted under 35 U.S.C. 154(b) by 0 days.

(21) Appl. No.: 14/381,356

(22) PCT Filed: Apr. 25, 2012

(86) PCT No.: PCT/JP2012/061085

§ 371 (c)(1),
(2), (4) Date: Aug. 27, 2014

(87) PCT Pub. No.: WO2013/161021

PCT Pub. Date: Oct. 31, 2013

(65) Prior Publication Data

US 2015/0008221 A1 Jan. 8, 2015

(51) Int. Cl.
*B65D 17/34* (2006.01)
*B65D 17/00* (2006.01)

(52) U.S. Cl.
CPC .... *B65D 17/165* (2013.01); *B65D 2517/0014* (2013.01)

(58) Field of Classification Search
CPC ..... B65D 17/165; B65D 2517/0014
USPC ..... 220/269, 271
See application file for complete search history.

(56) References Cited

U.S. PATENT DOCUMENTS 3,796,344 A 3/1974 De Phillips et al.
4,205,760 A * 6/1980 Hasegawa ..... B65D 17/165 220/271
5,129,541 A 7/1992 Voigt et al.
5,375,729 A 12/1994 Schubert
5,655,678 A 8/1997 Kobayashi
5,692,636 A 12/1997 Schubert
(Continued)

FOREIGN PATENT DOCUMENTS

CN 1863709 A 11/2006
JP 51-82188 U 7/1976
(Continued)

OTHER PUBLICATIONS

International Search Report for PCT/JP2012/061085 dated Sep. 11, 2012.
(Continued)

*Primary Examiner* — James N Smalley
(74) *Attorney, Agent, or Firm* — Sughrue Mion, PLLC

(57) ABSTRACT

In a panel (400), a protrusion (nipple) (420) is formed, which is flattened when a tab is secured to the panel (400) and functions as a rivet. The protrusion (420) is provided at a section of the panel (400) which is surrounded by a first score line (430) and which is located on a top part (433A) side relative to one end (431) or the other end (432) of the first score line (430). A second score line (450) connected to a curved part (433) of the first score line (430) is provided in the panel (400). Consequently, a decrease in the outflow performance of the drink is suppressed and a decrease in operability of the tab is suppressed, even if the tab or the opening is increased in size or the panel is reduced in size.

46 Claims, 27 Drawing Sheets

(56) References Cited

U.S. PATENT DOCUMENTS

| | | | |
|---|---|---|---|
| 5,860,553 | A | 1/1999 | Schubert |
| 2008/0203094 | A1 | 8/2008 | Cho |
| 2008/0272120 | A1 | 11/2008 | Delport et al. |

FOREIGN PATENT DOCUMENTS

| | | | |
|---|---|---|---|
| JP | 61-48127 | U | 3/1986 |
| JP | 63-28633 | U | 2/1988 |
| JP | 05-162761 | A | 6/1993 |
| JP | 6-76049 | U | 10/1994 |
| JP | 6-321238 | A | 11/1994 |
| JP | 06-336247 | A | 12/1994 |
| JP | 07-172436 | A | 7/1995 |
| JP | 07-242234 | A | 9/1995 |
| JP | 07-285550 | A | 10/1995 |
| JP | 8-11882 | | 1/1996 |
| JP | 09-039962 | A | 2/1997 |
| JP | 10-167265 | A | 6/1998 |
| JP | 2000-128167 | A | 5/2000 |
| JP | 2004043007 | A | 2/2004 |
| JP | 2006-315704 | A | 11/2006 |
| JP | 2008-168923 | A | 7/2008 |
| JP | 2008-213934 | A | 9/2008 |
| JP | 3149331 | U | 3/2009 |
| JP | 2009196701 | A | 9/2009 |
| JP | 2012-035851 | A | 2/2012 |

OTHER PUBLICATIONS

Communication dated Nov. 6, 2015 from the European Patent Office in counterpart application No. 12875246.6.

* cited by examiner

CAN LID AND DRINK CAN

CROSS REFERENCE TO RELATED APPLICATIONS

This application is a National Stage of International Application No. PCT/JP2012/061085 filed Apr. 25, 2012, incorporated herein by reference in its entirety.

TECHNICAL FIELD

The present invention relates to a can lid and a drink can.

BACKGROUND ART

A drink can is suggested, in which an opening portion functioning as a tap is formed by fracture of a panel at a score line which is caused by applying pressure of a tab on a part of the panel (for example, refer to Patent Document 1).

CITATION LIST

Patent Literature

Patent Document 1: Japanese Patent Application Laid-Open Publication No. Sho 51-82188.

SUMMARY OF INVENTION

Technical Problem

Generally, the score line is provided on one side of a region out of two regions facing each other across the central part of a panel and a tab is provided on a side of the other region. Further, in most cases, the score line reaches in the vicinity of a peripheral part of the panel and the tab also reaches in the vicinity of the peripheral part of the panel.

In order to form an opening portion in a can lid easier, it is effective to make a tab bigger to increase distance between a rear end part of the tab and a rivet. In order to improve outflow performance of the drink therein, it is effective to make the opening portion bigger. However, since the size of the panel is limited and the opening portion decreases in size if the tab is made to increase in size, the outflow performance of the drink is easy to be lowered. Meanwhile, since the tab decreases in size if the opening portion is made to increase in size, the operability of the tab is easy to be lowered. Further, for example, in a case where the diameter of the can lid is made to be smaller, it is necessary to make the tab and the opening portion decrease in size in order to be contained in the panel. In such a case, the outflow performance of the drink therein is lowered and further the operability of the tab is also lowered.

In the panel of the can lid used for a drink can or the like, a score line for accelerating fracture of the panel at forming the opening portion in the panel is provided in most cases. Generally, the score line is provided with a first section that has one end and the other end and is formed into a U-shape, a second section that is provided between a pressed section of the panel which is pressed by the tab and the rivet, and a third section that connects the second section and the one end of the first section.

In such a can lid, a region surrounded by the first section having the U-shape is pressed by the tab, and the opening portion is formed in the panel. More specifically, fracture of the panel firstly occurs at the second section provided between the pressed section of the panel which is pressed by the tab and the rivet, and then the fracture of the panel progresses along the aforementioned third section. After that, the fracture of the panel further progresses from the one end toward the other end of the first section having the U-shape. Thereby, the opening portion having the U-shape is formed in the panel.

Here, for example, in a case where the rivet securing the tab to the panel is provided in the region surrounded by the aforementioned first section having the U-shape, the aforementioned one end of the first section is located at a point away from the aforementioned pressed section where the tab presses the panel since the aforementioned third section is connected to the one end of the first section after curvature or bend. Further, as the third section travels toward the one end of the first section, the third section gradually get away from the aforementioned pressed section.

In a case where a part of the score line is curved like the aforementioned third section, fracture of the score line is difficult to progress. In addition, if the score line is arranged to gradually get away from the aforementioned pressed section where the tab presses the panel like the third section, a load (shear force) is difficult to act on this section which gradually gets away from the pressed section, and thus fracture of the score line is difficult to occur. In this case, an operation load of the tab at forming the opening portion in the panel increases.

It is an object of the present invention to smoothly progress the fracture of the panel at the score line, and reduce the operation load when the tab is operated.

In general, a score line is provided in a can lid used for a drink can, fracture of the panel occurs along the score line by applying pressure of the tab on the region surrounded by this score line, and the opening portion is formed in the panel.

Here, in the panel, not only one sequential score line but also a score line that branches off from the middle of the route can be provided. In the case where the score line branches off, fracture of the panel may occur at plural sections on a downstream side of the branch point of the score line at the same time. As described above, if the fracture of the panel progresses at the plural sections at the same time, the operation load at operating the tab increases.

It is also an object of the present invention to suppress increase of the operation load of the tab which may occur in the case where the score line has a branch.

In a case where the region of the panel which is surrounded by the score line (the region which becomes the opening portion) is large or the tab is small, the distance between the section of the panel which is pressed by the tab and the score line increases, and the load from the tab is difficult to be transmitted to the score line. In this case, the fracture of the score line is difficult to occur, and the operation load of the tab necessary at forming the opening portion in the panel is easy to increase.

It is also an object of the present invention to provide a can lid or the like that can suppress increase in the operation load of the tab which may occur in the case where the region surrounded by the score line is large or the tab is small.

In a case where there is provided a connection portion connecting a side of the tab which is pulled up by a user and a rivet securing the tab to the panel, force pulling the rivet upward acts on the rivet through the connection portion when the tab is pulled up. If the pulling force acts on the rivet as described above, a rotation moment starts to act on the panel due to the pulling force and the pressing force of the tab pressing the panel. In the case where such a rotation moment acts, for example, it is possible that a section of the panel where the rivet is provided may also enter the inside of the drink can. In the case where the connection portion is provided as mentioned above, disposition of the tab is easy to be restricted by the connection portion, and a finger is difficult to be inserted between the tab and the panel when the tab is pulled up. In this case, the operability of the tab at forming the opening portion functioning as a tap in the panel is lowered.

Solution to Problem

A can lid to which the present invention is applied includes: a panel that is attached to an opening of a can body; a first score line that is formed in the panel, has one end and the other end, is formed to expand toward a peripheral edge side of the panel, and has a top part on the peripheral edge side; a tab that is operated by a user, and presses a section of the panel which is surrounded by the first score line; a rivet that secures the tab to a section of the panel which is surrounded by the first score line and which is located on the top part side relative to the one end and the other end of the first score line; and a second score line that is provided to pass between a section of the panel which is pressed by the tab and the rivet, and is provided to be connected to the first score line.

Here, the second score line is provided to be connected to a section of the first score line which is located between the one end and the other end.

Moreover, the other end portion side of the tab located on a side opposite to one end portion side which presses the panel is operated by the user and moves in a direction away from the panel, and thereby the one end side moves toward the panel and presses the panel, so that the tab applies pressure on the panel, the tab is provided with a connection portion between the other end portion side of the tab and the rivet, the connection portion connecting the other end portion side and the rivet, operation force from the user is transmitted to the rivet via the connection portion when the user operates the other end portion side and the other end portion side is displaced in the direction away from the panel, and the rivet is pulled toward the direction away from the panel, and a rotation moment acts on the section of the panel which is surrounded by the first score line, which is caused by pulling the rivet and applying the pressure of the one end portion side of the tab on the panel.

Moreover, the connection portion is configured to stretch until the other end portion side of the tab moves in the direction away from the panel and an angle of the tab with respect to the panel becomes a predetermined angle.

Further, the other end portion side of the tab which is located on the side opposite to the one end portion side pressing the panel is operated by the user and moves in the direction away from the panel, and thereby the one end portion side moves toward the panel, so that the tab applies the pressure on the panel, and the tab is provided with a rigidity decrease part between the other end portion side and a support portion supported by the rivet, the rigidity decrease part having lower rigidity than the other part, and the tab folds by use of the rigidity decrease part when the other end portion side of the tab which has moved in the direction away from the panel is operated to come close to the panel by a user.

Moreover, any one of a concavity and a convex is formed at a section of the panel which is located between the one end and the other end of the first score line.

From another point of view, a can lid to which the present invention is applied includes: a panel that is attached to an opening of a can body and is formed into a disk; a first score line that is formed in the panel, and has a top part, one end and the other end, the top part being arranged within one region out of two regions facing each other across a virtual line passing through a central part of the panel, the one end and the other end being arranged within the other region out of the two regions; a tab that is operated by a user, and presses a section of the panel which is surrounded by the first score line; a rivet that secures the tab to a section of the panel which is surrounded by the first score line and which is located within the one region; and a second score line that is provided to pass between a section of the panel which is pressed by the tab and the rivet, and is provided to be connected to the first score line.

In a case where the present invention is taken as a drink can, the drink can to which the present invention is applied includes: a can body that has an opening and contains drink therein; and a can lid that seals the opening of the can body. The can lid includes: a panel that is attached to the opening of the can body; a first score line that is formed in the panel and is formed into a U-shape in a case where the panel is viewed from a front side, and that has one end and the other end, and a top part on a peripheral edge side of the panel; a tab that is operated by a user and presses a section of the panel which is surrounded by the first score line; a rivet that secures the tab to a section of the panel which is surrounded by the first score line and which is located on the top part side relative to the one end and the other end of the first score line; and a second score line that is provided to pass between the section of the panel which is pressed by the tab and the rivet, and is provided to be connected to the first score line.

From another point of view, a can lid to which the present invention is applied includes: a panel that is attached to an opening of a can body; a first score line that is formed in the panel, has one end and the other end, and is formed to expand toward a peripheral edge side; a tab that has one end portion and the other end portion, is arranged along one direction from the central part side of the panel toward the peripheral edge side of the panel, and presses a section of the panel which is surrounded by the first score line; a rivet that secures a section of the tab which is located between the one end portion and the other end portion to the panel; and a second score line that is formed along a direction intersecting with the one direction while being provided to pass between a section of the panel which is pressed by the tab and the rivet, and that is connected to a section of the first score line which is located between the one end and the other end.

Here, the first score line formed to expand toward the peripheral edge side of the panel has a top part on the peripheral edge side, and the second score line travels to get away from a straight line which is orthogonal to a straight line passing through the top part of the first score line and a central part of the panel and which passes through the rivet, and is connected to the first score line, after passing between the section which is pressed by the tab and the rivet.

Moreover, the first score line formed to expand toward the peripheral edge side of the panel has a top part on the peripheral edge side, and the second score line is provided to connect any one of a section of the first score line which is located between the top part and the one end and a section of the first score line which is located between the top part and the other end.

Further, the rivet secures the tab to a section of the panel which is surrounded by the first score line and which is located on the top part side relative to the one end and the other end of the first score line.

In a case where the present invention is taken as a drink can, the drink can to which the present invention is applied includes: a can body that has an opening and contains drink therein; and a can lid that seals the opening of the can body. The can lid includes: a panel that is attached to the opening of the can body; a first score line that is formed in the panel, has one end and the other end, and is formed to expand toward a peripheral edge side of the panel; a tab that has one end portion and the other end portion, is arranged along one direction from the central part side of the panel toward the peripheral edge side of the panel, and presses a section of the panel which is surrounded by the first score line; a rivet that secures a section of the tab which is located between the one end portion and the other end portion to the panel; and a second score line that is formed along a direction intersecting with the one direction while being provided to pass between a section of the panel which is pressed by the tab and the rivet, and that is connected to a section of the first score line which is located between the one end and the other end.

From another point of view, a can lid to which the present invention is applied includes: a panel that is attached to an opening of a can body; a first score line that is formed in the panel, has one end and the other end, is formed to expand toward a peripheral edge side of the panel, and has a top part on the peripheral edge side; a tab that has one end portion and the other end portion, the one end portion pressing a predetermined section of the panel which is located within a region surrounded by the first score line; a rivet that is provided in the central part side of the panel relative to the one end portion of the tab, and secures a section of the tab which is located between the one end portion and the other end portion to the panel; and a second score line that is formed in the panel, is provided to be connected to a section of the first score line which is located between the other end and the top part, is provided to head toward an inside of the region which is surrounded by the first score line from the connection portion with the first score line, and is provided to pass on a side where the rivet is provided rather than the predetermined section. Fracture of the panel progresses along the second score line and toward the connection portion by applying pressure of the tab on the predetermined section of the panel, the fracture of the panel further progresses from the connection portion toward the one end of the first score line, and the fracture of the panel progresses from the connection portion toward the other end of the first score line after the fracture progresses to a predetermined point of the first score line.

Here, the second score line is provided to pass between the predetermined section and the rivet.

Moreover, the rivet secures the tab to a section of the panel which is located within the region surrounded by the first score line and which is located on the top part side relative to the one end and the other end of the first score line, the other end portion side of the tab which is located on a side opposite to the one end portion side is operated by a user and moves in a direction away from the panel and thereby the one end portion side moves toward the panel, so that the panel is pressed by the moving one end portion, a transmission portion that connects the tab and the rivet and transmits a load from the tab to the rivet is provided between the other end portion side of the tab and the rivet, operation force from the user is transmitted to the rivet via the transmission portion when the user operates the other end portion side and the other end portion side is displaced in the direction away from the panel, and the rivet is pulled toward the direction away from the panel, and a rotation moment acts on the section located on the top part side relative to the one end and the other end of the first score line, which is caused by pulling the rivet and applying the pressure of the one end portion of the tab on the panel.

From another point of view, a can lid to which the present invention is applied includes: a panel that is attached to an opening of a can body; a first score line that is formed in the panel, has one end and the other end, is formed to expand toward a peripheral edge side of the panel, and has a top part on the peripheral edge side; a tab that has one end portion and the other end portion, the one end portion pressing a predetermined section of the panel which is located within a region surrounded by the first score line; a rivet that is provided in the central part side of the panel relative to the one end portion of the tab, and secures a section of the tab which is located between the one end portion and the other end portion to the panel; and a second score line that is formed in the panel, is provided to be connected to a section located between the other end and the top part of the first score line, is provided to head toward an inside of the region surrounded by the first score line from the connection portion with the first score line, and is provided to pass on a side where the rivet is provided rather than the predetermined section. In the region of the panel which is surrounded by the first score line, a first region located on the top part side of the first score line relative to the second score line and a second region located on a side opposite to the first region with respect to the second score line are formed, and fracture of the panel progresses along the second score line and toward the connection portion by applying pressure of the one end portion of the tab on the predetermined section located within the first region, the fracture of the panel further progresses from the connection portion toward the one end of the first score line and thereby an opening is formed in the first region, the one end portion of the tab enters the opening that has been formed and thereby the second region is pressed by the tab, and, by the pressure, the fracture of the panel progresses from the connection portion toward the other end of the first score line.

Here, the one end portion of the tab does not come in contact with the second region when the tab is operated by a user and the predetermined section located within the first region is pressed by the one end portion of the tab.

Moreover, the second score line is provided to pass between the predetermined section and the rivet.

In a case where the present invention is taken as a drink can, the drink can to which the present invention is applied includes: a can body that has an opening and contains drink therein; and a can lid that seals the opening of the can body. The can lid includes: a panel that is attached to the opening of the can body; a first score line that is formed in the panel, has one end and the other end, is formed to expand toward a peripheral edge side of the panel, and has a top part on the peripheral edge side; a tab that has one end portion and the other end portion, the one end portion pressing a predetermined section of the panel which is located within a region surrounded by the first score line; a rivet that is provided in the central part side of the panel relative to the one end portion of the tab, and secures a section of the tab which is located between the one end portion and the other end portion to the panel; and a second score line that is formed in the panel, is provided to be connected to a section of the first score line which is located between the other end and the top part, is provided to head toward an inside of the region surrounded by the first score line from the connection portion with the first score line, and is provided to pass on a side where the rivet is provided rather than the predetermined section. Fracture of the panel progresses along the second score line and toward the connection portion by applying pressure of the tab on the predetermined section of the panel, the fracture of the panel further progresses from the connection portion toward the one end of the first score line, and the fracture of the panel progresses from the connection toward the other end of the first score line after the fracture progresses to a predetermined point of the first score line.

From another point of view, a can lid to which the present invention is applied includes: a panel that is attached to an opening of a can body; a rivet that is provided in the panel; a tab that is secured to the panel with the rivet while being arranged along one direction from a peripheral edge of the panel toward the rivet, and presses the panel; a first score line that is formed in the panel and is formed to surround a pressed section of the panel which is pressed by the tab; and a second score line that is formed within a region of the panel which is surrounded by the first score line, that is provided to extend in a direction intersecting with the one direction from one end located within the region as a start point, and that is connected to the first score line at the other end.

Here, the second score line is formed to pass a section other than the pressed section.

Moreover, the one end side of the second score line is arranged in the vicinity of the pressed section.

Further, the second score line is formed to pass on a side where the rivet is provided rather than the pressed section.

Moreover, the second score line is provided to pass between the pressed section and the rivet.

Further, the second score line gradually gets away from a straight line passing the rivet and heading toward a direction orthogonal to the one direction as heading toward the other end from the one end.

Moreover, the first score line has one end and the other end, is formed to expand toward the peripheral edge side of the panel, and has a top part on the peripheral edge side; and the other end of the second score line is connected to any one of a section of the first score line which is located between the one end and the top part and a section of the first score line which is located between the other end and the top part.

In a case where the present invention is taken as a drink can, the drink can to which the present invention is applied includes: a can body that has an opening and contains drink therein; and a can lid that seals the opening of the can body. The can lid includes: a panel that is attached to the opening of the can body; a rivet that is provided in the panel; a tab that is secured to the panel with the rivet while being arranged along one direction from a peripheral edge of the panel toward the rivet, and presses the panel; a first score line that is formed in the panel and is formed to surround a pressed section of the panel which is pressed by the tab; and a second score line that is formed within a region of the panel which is surrounded by the first score line, that is provided to extend in a direction intersecting with the one direction from one end located within the region as a start point, and that is connected to the first score line at the other end.

From another point of view, a can lid to which the present invention is applied includes: a panel that has an outer peripheral edge and is attached to an opening of a can body; a rivet that is provided in the panel; a tab that is secured to the panel with the rivet while being arranged along one direction from the outer peripheral edge of the panel toward the rivet, and presses the panel; a first score line that is formed in the panel and is formed to surround a pressed section of the panel which is pressed by the tab; and a second score line that is formed in the panel, is provided to be connected to the first score line, and is provided to head toward an inside of a region surrounded by the first score line from a connection portion with the first score line. The connection is provided at a section other than an intersection where a center line of the tab along the one direction and the first score line intersect with each other.

Here, the rivet is provided within the region surrounded by the first score line, and the connection portion is provided on a side where the intersection is located relative to a straight line orthogonal to the center line of the tab and the straight line passing the rivet.

Moreover, the second score line heading toward the inside of the region surrounded by the first score line from the connection portion passes on a side where the rivet is provided rather than the pressed section.

Further, the second score line heading toward the inside of the region surrounded by the first score line from the connection portion passes between the pressed section and the rivet.

From another point of view, a can lid to which the present invention is applied includes: a panel that has an outer peripheral edge and is attached to an opening of a can body; a rivet that is provided in the panel; a tab that is secured to the panel with the rivet while being arranged along one direction from the outer peripheral edge of the panel toward the rivet, and presses the panel; a first score line that is formed to surround a pressed section of the panel which is pressed by the tab, is formed to be symmetrical with respect to a center line of the tab along the one direction as a symmetrical axis, has one end arranged on one region out of two regions facing each other across the center line and the other end arranged on the other region out of the two regions, and is formed to expand toward the outer peripheral edge side of the panel; and a second score line that is formed in the panel, is provided to be connected to the first score line, and is provided to head toward an inside of a region surrounded by the first score line from a connection portion with the first score line. The connection portion is provided so that length of a section of the first score line which is located between the one end and the connection portion and length of a section of the first score line which is located between the other end and the connection portion are different from each other.

Here, the connection portion is provided at a section other than the one end of the first score line and at a section other than the other end of the first score line.

Moreover, the connection portion is provided on a side where the pressed section is located relative to a straight line orthogonal to the center line of the tab and the straight line passing the rivet.

Further, the second score line has one end and the other end, the one end of the second score line is located within the region surrounded by the first score line, and the other end of the second score line is connected to the first score line at the connection portion, and the second score line gradually gets away from the straight line passing the rivet as travelling from the one end toward the other end.

Moreover, the second score line passes by the pressed section when travelling from the one end toward the other end.

Further, in a case where the present invention is taken as a drink can, the drink can to which the present invention is applied includes: a can body that has an opening and contains drink therein; and a can lid that seals the opening of the can body. The can lid includes: a panel that has an outer peripheral edge and is attached to the opening of the can body; a rivet that is provided in the panel; a tab that is secured to the panel with the rivet while being arranged along one direction from the outer peripheral edge of the panel toward the rivet, and presses the panel; a first score line that is formed in the panel and is formed to surround a pressed section of the panel which is pressed by the tab; and a second score line that is formed in the panel, is provided to be connected to the first score line, and is provided to head toward an inside of a region surrounded by the first score line from a connection portion with the first score line. The connection portion is provided at a section other than an intersection where a center line of the tab along the one direction and the first score line intersect with each other.

From another point of view, a drink can to which the present invention is applied includes: a can body that has an opening and contains drink therein; and a can lid that seals the opening of the can body. The can lid includes: a panel that has an outer peripheral edge and is attached to the opening of the can body; a rivet that is provided in the panel; a tab that is secured to the panel with the rivet while being arranged along one direction from the outer peripheral edge of the panel toward the rivet, and presses the panel; a first score line that is formed to surround a pressed section of the panel which is pressed by the tab, is formed to be symmetrical with respect to a center line of the tab along the one direction as a symmetrical axis, has one end arranged on one region out of two regions facing each other across the center line and the other end arranged on the other region out of the two regions, and is formed to expand toward the outer peripheral edge side of the panel; and a second score line that is formed in the panel, is provided to be connected to the first score line, and is provided to head toward an inside of a region surrounded by the first score line from a connection portion with the first score line. The connection portion is provided so that length of a section of the first score line which is located between the one end and the connection portion and length of a section of the first score line which is located between the other end and the connection portion are different from each other.

From another point of view, a can lid to which the present invention is applied includes: a panel that is attached to an opening of a can body; a score line that is formed in the panel and fractures when an opening is formed in the panel; a tab that has one end portion and the other end portion, the one end portion coming in contact with the panel and pressing a section of the panel which is surrounded by the score line due to operation of the other end portion side by a user; a rivet that secures a section of the tab which is located between the one end portion and the other end portion to the panel; and a stretch part that is provided on the other end portion side of the tab relative to the rivet, has one end connected to the rivet and the other end connected to the tab, and stretches until an angle of the tab displaced in accordance with movement of the other end portion in a direction away from the panel which is caused by the user's operation on the other end portion of the tab becomes a predetermined angle with respect to the panel.

Here, the stretch part stops stretching in a case where the angle of the tab with respect to the panel becomes the predetermined angle.

Moreover, the score line is formed into a U-shape in a case where the panel is viewed from a front side, has one end and the other end, and has a top part on a peripheral edge side of the panel, and the rivet secures the tab to the section of the panel which is surrounded by the score line and a section located on the top part side relative to the one end and the other end of the score line.

Further, operation force from the user is transmitted to the rivet via the stretch part when the other end portion of the tab is operated by the user and moves in the direction away from the panel, and the rivet is pulled in the direction away from the panel, the other end portion of the tab is operated by the user and thereby the one end portion comes in contact with the section which is surrounded by the score line and applies pressure on the section, and a rotation moment acts on the section surrounded by the score line, which is caused by pulling the rivet and applying the pressure of the one end portion of the tab on the section.

Moreover, the stretch part is formed by a sheet and has a bending part where the sheet bends, and the stretching is performed by stretching of the bending part.

Further, the stretch part is provided with a sheet in which any one of a slit and a groove that is capable of fracturing is formed, the sheet is formed into a shape like a string by pulling a part of the sheet due to a load from the tab, and the stretching of the stretch part is performed.

Moreover, the stretch part is integrally formed with the tab.

In a case where the present invention is taken as a drink can, the drink can to which the present invention is applied includes: a can body that has an opening and contains drink therein; and a can lid that seals the opening of the can body. The can lid includes: a panel that is attached to the opening of the can body; a score line that is formed in the panel and fractures when an opening is formed in the panel; a tab that has one end portion and the other end portion, the one end portion coming in contact with the panel and pressing a section of the panel which is surrounded by the score line, due to operation of the other end side by a user; a rivet that secures a section of the tab which is located between the one end portion and the other end portion to the panel; and a stretch part that is provided on the other end portion side of the tab relative to the rivet, has one end connected to the rivet and the other end connected to the tab, and stretches until an angle of the tab displaced in accordance with movement of the other end portion in a direction away from the panel caused by an user's operation on the other end portion of the tab becomes a predetermined angle with respect to the panel.

Advantageous Effects of Invention

According to the present invention, even in a case where the tab or the opening portion is increased in size or the panel is decreased in size, it is possible to suppress decrease in the outflow of the drink and decrease in the operability of the tab.

According to the present invention, it is possible to smoothly progress the fracture of the panel at the score line and decrease the operation load at operating the tab.

According to the present invention, it is possible to suppress the increase in the operation load of the tab which may occur in the case where the branch is provided in the score line.

According to the present invention, it is possible to provide the can lid or the like which can suppress the increase in the operation load of the tab which may occur in the case where the region surrounded by the score line is large or the tab is small.

According to the present invention, it is possible to provide the can lid or the like which can suppress the decrease in the operability of the tab even if the connection portion connecting the rivet and the tab is provided.

DESCRIPTION OF EMBODIMENTS

First Exemplary Embodiment

Hereinafter, an exemplary embodiment according to the present invention will be described in detail with reference to attached drawings.

Figure 1A:
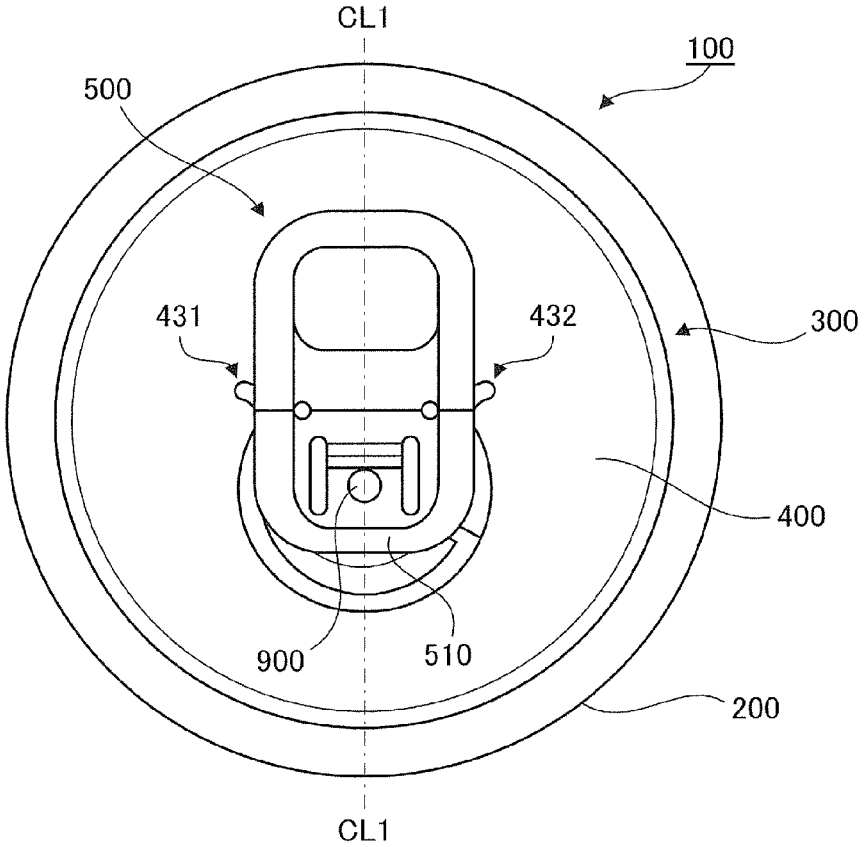
FIGS. 1A and 1B are top views of a drink can to which the exemplary embodiment is applied.
Figure 1B:
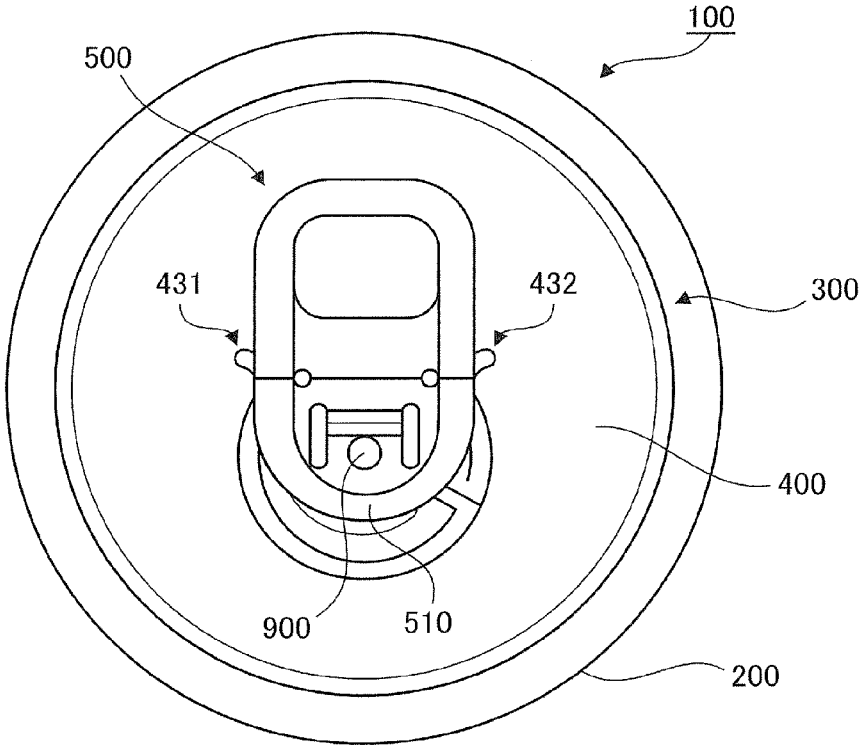

FIGS. 1A and 1B are top views of a drink can 100 to which the exemplary embodiment is applied. As shown in FIGS. 1A and 1B, the drink can 100 has: a container body (can body) 200 that has an opening at the upper part and a bottom at the lower part and that is formed into a cylinder; and a can lid 300 that is attached to the opening of the container body 200 and seals the opening of the container body 200. Note that, the inside of the drink can 100 is filled with (contains) drink such as cold beverage, soda, alcohol or the like.

The can lid 300 has a panel 400 which is formed into a disk and functions as a basal plate. Further, the can lid 300 has a tab 500 which is operated by a user. The tab 500 is attached to the panel 400 and presses a predetermined section (which will be described below in detail) of the panel 400 due to the operation by the user. Note that, the can lid 300 in the exemplary embodiment is a so-called stay-on type can lid where the tab 500 is kept to be attached to the panel 400 even after an opening portion functioning as a tap is formed in the panel 400. Here, in the exemplary embodiment, the tab 500 is secured to the panel 400 with a rivet 900 provided at a position displaced from a central part of the panel 400. That is, the tab 500 is secured to the panel 400 with the rivet 900 provided in an eccentric state with respect to the panel 400. Note that, in the exemplary embodiment, although explanation will be given for a case where the tab 500 is secured to the panel 400 with the rivet 900 provided at the position displaced from the central part of the panel 400 as an example, the tab 500 can be secured to the panel 400 with the rivet 900 provided in the central part of the panel 400.

Figure 2:
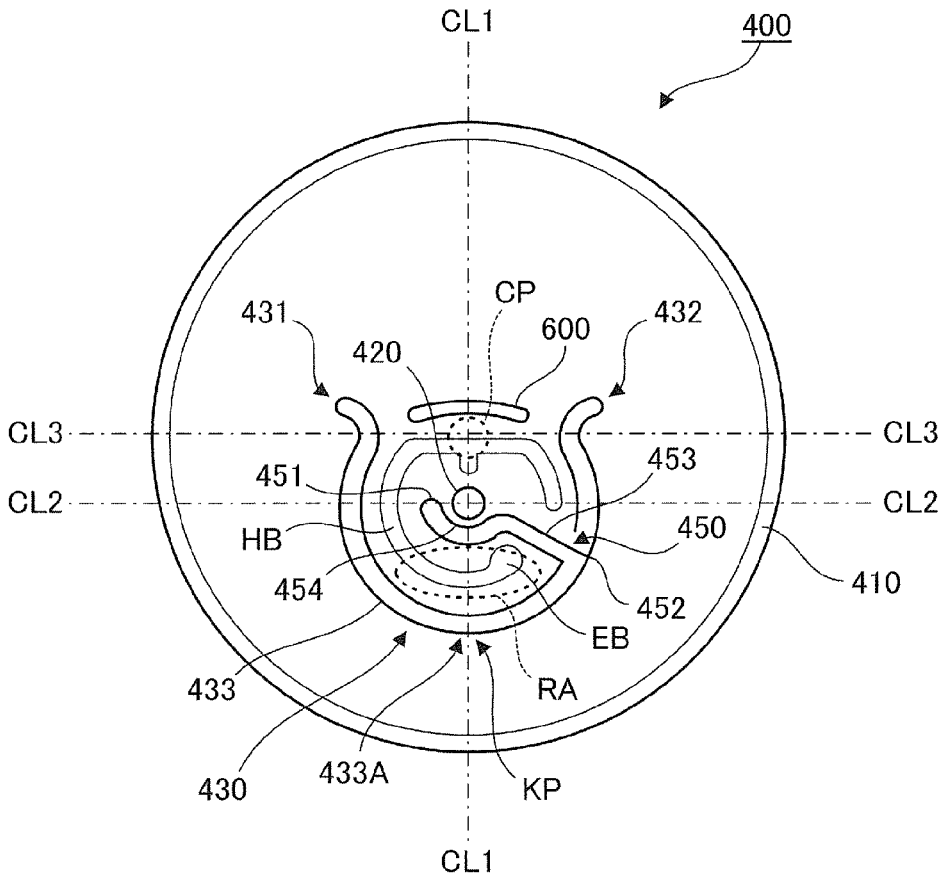
FIG. 2 is a front view showing the state of the panel before the tab is attached thereto.

FIG. 2 is a front view showing the state of the panel 400 before the tab 500 is attached thereto.

The panel 400 is formed into a disk as mentioned above. The panel 400 has an outer peripheral edge 410 on which a bending process has been performed. In the exemplary embodiment, a so-called seam process is performed on the outer peripheral edge 410 and an upper edge part (not shown) of the container body 200 in the state where the outer peripheral edge 410 and the upper edge part are in contact with each other. Thereby, the panel 400 is secured to the upper edge part of the container body 200. In the panel 400, a protrusion (nipple) 420 which is flattened at securing the tab 500 to the panel 400 and becomes the aforementioned rivet 900 is formed. Here, the protrusion 420 is provided at a section displaced from a central part CP of the panel 400.

In the exemplary embodiment, a first score line 430 is formed on the surface of the panel 400. The first score line 430 is constituted by a groove formed on the surface of the panel 400, and has a function for guiding fracture of the panel 400 (mentioned below). That is, the first score line 430 can be taken as a fracture scheduled line where the fracture of the panel 400 is scheduled. The first score line 430 is formed into an approximately U-shape when the panel 400 is viewed from the front side. Further, the first score line 430 has one end 431 and the other end 432 on the central part CP side of the panel 400, and a top part 433A on the outer peripheral edge (peripheral edge) 410 side of the panel 400.

Here, the one end 431 of the first score line 430 is arranged on one side with respect to a first virtual line CL1 connecting the central part CP of the panel 400 and the protrusion 420 formed in the panel 400. The other end 432 is provided on a side which is opposite to the side where the one end 431 is provided with respect to the first virtual line CL1. By providing the one end 431 and the other end 432 to keep away from each other, a discontinuous section where the first score line 430 is not provided is provided between the one end 431 and the other end 432. By providing the discontinuous section, a tongue part which will be mentioned below is not detached from the panel 400, and is kept to be attached to the panel 400.

In a case where a second virtual line CL2 which is a virtual line orthogonal to the aforementioned first virtual line CL1 and passes through the protrusion 420 is simulated, the aforementioned one end 431 and the other end 432 are provided on the central part CP side of the panel 400 relative to the second virtual line CL2. That is, in FIGS. 1A and 1B, the one end 431 and the other end 432 are provided above the rivet 900. The top part 433A is provided within one region out of two regions facing each other across a third virtual line CL3 which is a virtual line orthogonal to the aforementioned first virtual line CL1 and passes through the central part CP of the panel 400, and the one end 431 and the other end 432 are provided within the other region. Further, the protrusion 420 is provided within the one region. In the case where the protrusion 420 is provided within the one region as mentioned above, the operation load necessary at bending the tongue part (which will be mentioned below) decreases in comparison with a case where the protrusion 420 is provided at the central part CP of the panel 400.

As further explanation, the protrusion 420 which becomes the rivet 900 is located at a section of the panel 400 which is surrounded by the first score line 430 and a section located on the top part 433A side relative to the one end 431 and the other end 432 of the first score line 430. The first score line 430 has a curved part 433 as shown in FIG. 2. The curved part 433 is provided to expand toward the side where the protrusion 420 is provided while connecting the one end 431 and the other end 432, and to pass on the outer peripheral edge 410 side of the panel 400 relative to the protrusion 420.

The curved part 433 has the top part 433A at a point where the curved part 433 intersects with the first virtual line CL1. In the can lid 300 according to the exemplary embodiment, a reinforcing bead HB for enhancing rigidity of the region surrounded by the first score line 430 is formed within the region of the panel 400 which is surrounded by the first score line 430. At one end of the reinforcing bead HB, an emboss EB which projects upward (toward the outside of the drink can 100) and is pressed by a front end of the tab 500 is provided. By providing the emboss EB, the fracture of the panel 400 is easy to occur at the second score line 450 (which will be mentioned below in detail) in comparison with the case where the emboss EB is not provided.

Here, in the exemplary embodiment, due to the operation of the tab 500 by the user, the region surrounded by the first score line 430 is pressed by the tab 500 and the fracture of the panel 400 occurs at the section where the first score line 430 has been formed (which will be mentioned below in detail). Thereby, the region where the first score line 430 has been formed becomes a tongue-shaped part, and the region folds toward the inside of the drink can 100. Thereby, the opening portion functioning as a tap is formed on the drink can 100. Note that, in this description, the aforementioned tongue-shaped part formed by the fracture occurring at the first score line 430 may be referred to as a tongue part in some cases. In the exemplary embodiment, a curved part 454 (a section where the fracture of the panel 400 firstly occurs) of the second score line 450 (which will be mentioned below in detail) is arranged to be close to the central part CP side of the panel 400. In such a case, the drink therein is difficult to be spilled in comparison with a case where the fracture of the panel 400 firstly occurs on the outer peripheral edge 410 side of the panel 400.

In the exemplary embodiment, the second score line 450 is formed on the surface of the panel 400. Note that, the second score line 450 is also constituted by a groove formed on the surface of the panel 400, and has a function for guiding the fracture of the panel 400. The second score line 450 is provided within a region where the top part 433A (the top part 433A of the first score line 430) is provided out of two regions which face each other across the second virtual line CL2. The second score line 450 has one end 451 and the other end 452. Here, the other end 452 of the second score line 450 is connected to the curved part 433 of the first score line 430. More specifically, the other end 452 of the second score line 450 is connected to the section of the curved part 433 of the first score line 430 which is located between the first virtual line CL1 and the second virtual line CL2.

On the other hand, the one end 451 of the second score line 450 is provided in the vicinity of the protrusion 420. As further explanation, the one end 451 of the second score line 450 is arranged on one region side out of two regions which face each other across the first virtual line CL1, and the other end 452 of the second score line 450 is arranged on the other region side out of these two regions. As further explanation, the second score line 450 has a straight line 453 extending from the other end 452 toward the protrusion 420. Further, the second score line 450 has the curved part 454 which is connected to the straight line 453, which is arranged to have distance with the protrusion 420 formed into a cylinder, and which is provided along the protrusion 420. Here, the curved part 454 is formed between the protrusion 420 and the first score line 430. More specifically, it is formed between the top part 433A of the first score line 430 and the protrusion 420. That is, the curved part 454 of the second score line 450 is arranged between the protrusion 420 and the first score line 430 on the first virtual line CL1.

Here, the state of the panel 400 at operating the tab 500 will be explained with reference to FIGS. 3A to 3F (views for illustrating the state of the panel 400). Note that, in FIGS. 3A to 3F, the state in which the panel 400 is viewed from the front side and the state in which the panel 400 is viewed from the side are illustrated.

In the exemplary embodiment, when the rear end of the tab 500 is pulled up by a user, a front end (tab nose) 510 (refer to FIGS. 1A and 1B) of the tab 500 presses a region RA (refer to a broken line of FIG. 2) between the curved part 454 of the second score line 450 and the top part 433A of the first score line 430. Upon pressing the region RA with the tab 500, firstly, the panel 400 fractures at the curved part 454 of the second score line 450 which is provided to pass between the region RA and the rivet 900 (protrusion 420) (refer to FIG. 3B). Then, the fracture progresses along the second score line 450, which leads to the state in which the fracture of the panel 400 reaches the connection between the first score line 430 and the second score line 450.

Figure 3A:
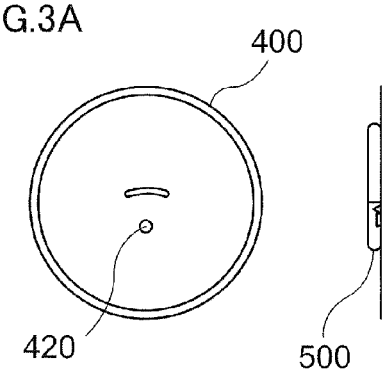
FIGS. 3A to 3F are views for illustrating the state of the panel.
Figure 3B:
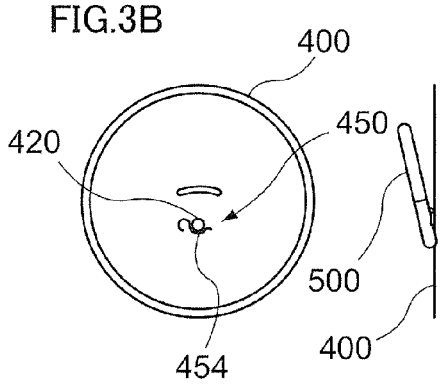
Figure 3C:
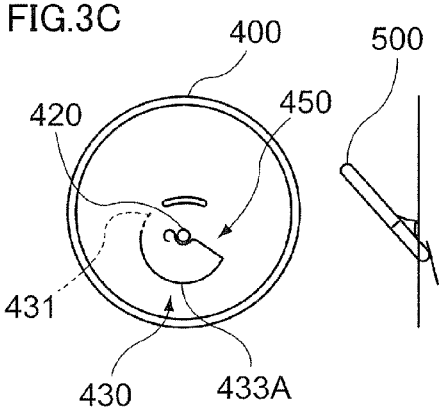
Figure 3D:
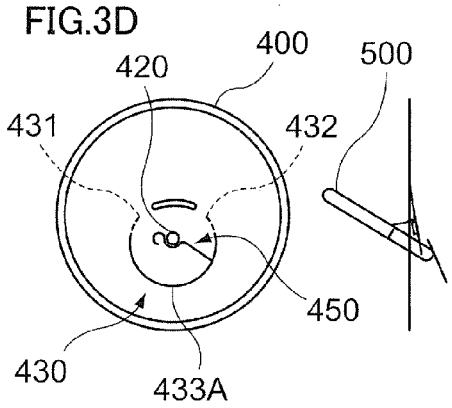
Figure 3E:
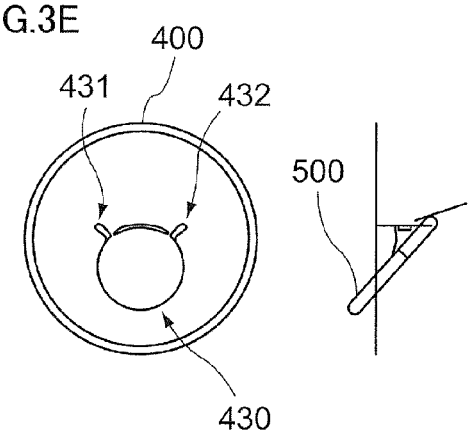
Figure 3F:
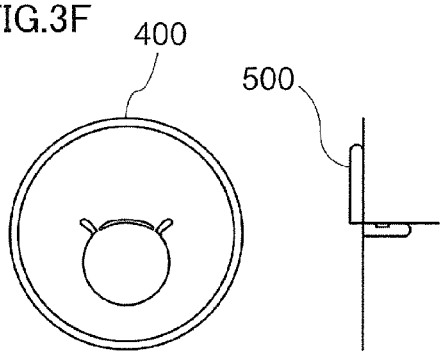

Here, in the exemplary embodiment, the score line branches at the aforementioned connection portion between the first score line 430 and the second score line 450. Therefore, after the fracture of the panel 400 progresses from the curved part 454 of the second score line 450 to the aforementioned connection portion, the fracture progresses from the connection portion to the one end 431 of the first score line 430 via the top part 433A as shown in FIG. 3C in the exemplary embodiment. In addition, the fracture also progresses from the connection portion toward the other end 432 of the first score line 430 as shown in FIG. 3D. Thereby, the region surrounded by the first score line 430 becomes the aforementioned tongue part. The tongue part is folded at the base of the tongue part (the section located between the one end 431 and the other end 432 of the first score line 430), and the tongue part enters the inside of the drink can 100 as shown in FIG. 3E. Thereby, the opening portion functioning as a tap is formed on the drink can 100. Note that, although the detailed description will be given below, when the tab 500 which has been pulled up is returned to the original state, the tab 500 folds as shown in FIG. 3F.

In the exemplary embodiment, as shown in FIG. 2, a groove 600 is provided in a region located between the one end 431 and the other end 432 of the first score line 430. The groove 600 is provided to head toward the side where the other end 432 is provided from the side where the one end 431 of the first score line 430 is provided while making an arc and being formed to have a curve. That is, it is provided along the second virtual line CL2 (the third virtual line CL3). Accordingly, in the drink can 100 according to the exemplary embodiment, fold of the tongue part is easy to occur. In the exemplary embodiment, since the groove 600 is formed to have a curve, the tongue part that has bent is difficult to return to the original state. Note that, the groove 600 is not essential, and therefore the groove 600 can be omitted.

Next, detailed explanation will be given for the tab 500.

Figure 4A:
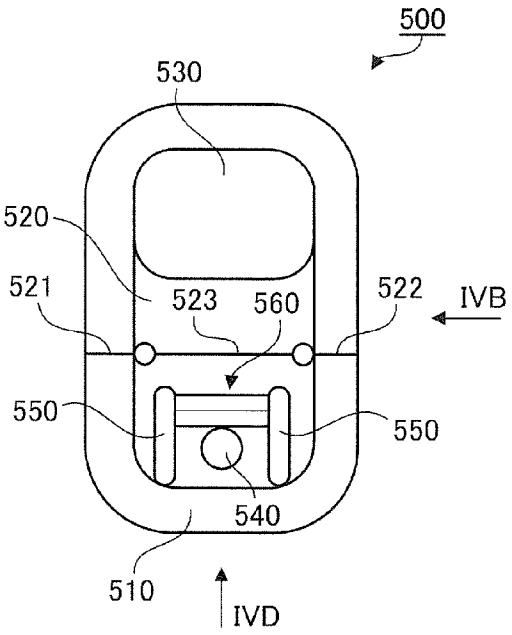
FIGS. 4A to 4D are views for illustrating the tab.
Figure 4B:
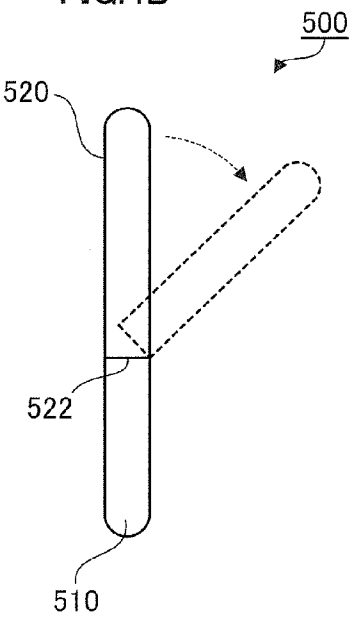
Figure 4C:
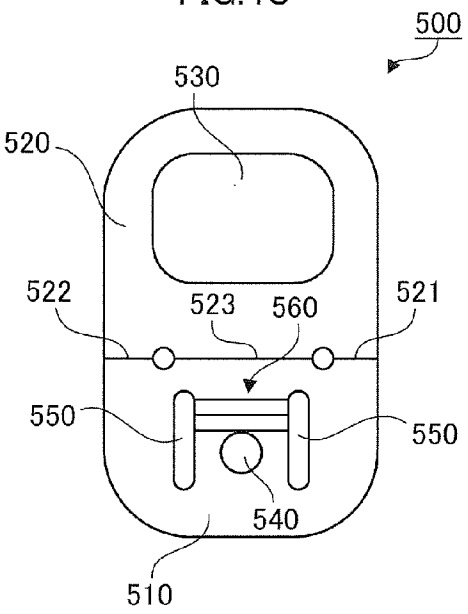
Figure 4D:
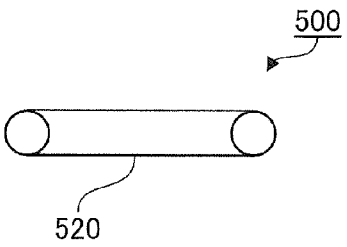
Figure 5B:
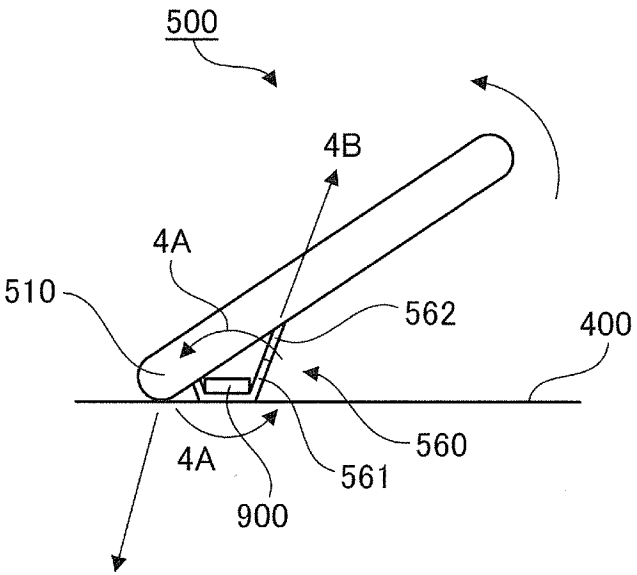
FIGS. 5A and 5B are views for illustrating the tab.

FIGS. 4A to 5B are views for illustrating the tab 500. FIGS. 6A and 6B are views showing the state in which the tab 500 is operated by a user and the opening portion is formed in the panel 400. Note that, FIG. 4A is a front view of the tab 500, FIG. 4B is a view when the tab 500 is viewed from an arrow IVB direction in FIG. 4A. FIG. 4C is a back-side view of the tab 500. That is, it is the view when the tab 500 is viewed from a facing surface side facing the panel 400. FIG. 4D is a view when the tab 500 is viewed from an arrow IVD direction in FIG. 4A. FIG. 5A is a view for illustrating a stretch part (which will be mentioned below) provided in the tab 500, and FIG. 5B is the view showing the state in which the tab 500 is pulled up.

The tab 500 in the exemplary embodiment has a tab body 520 which is formed into a sheet and a rectangle, as shown in FIG. 4A. Note that, in the exemplary embodiment, as shown in FIG. 4D, a bending process (curling process) is performed on the outer peripheral edge of the tab body 520, and thus the outer peripheral edge of the tab body 520 is curled inward. That is, at the edge provided in four directions of the tab body 520, a curl part is formed. Thereby, bending rigidity is enhanced in the tab 500 in the exemplary embodiment. Further, in the tab 500, a penetration hole (finger hole) 530 where a user's finger can be inserted is formed on a side opposite to a side where the front end 510 for pressing the panel 400 is provided (tab tail side).

In the tab 500, an insert hole 540 into which the protrusion 420 (refer to FIG. 2) provided in the panel 400 is inserted is formed on the front end 510 side of the tab 500. Further, a long hole 550 extending along the longitudinal direction of the tab 500 is formed on the front end 510 side of the tab 500. Here, two long holes 550 are provided in a width direction of the tab 500 (the direction orthogonal to the longitudinal direction) in the state of being arranged side by side. Note that, in the exemplary embodiment, the insert hole 540 is provided between the two long holes 550. In a region located on the rear end side of the tab 500 relative to the insert hole 540 and between the aforementioned two long holes 550, a stretch part 560 which is integrally formed with the tab body 520 is formed. Note that, a section where the stretch part 560 is provided can be taken as a connection provided between the rear end side of the tab 500 and the rivet 900 (refer to FIGS. 1A and 1B) and connecting the rear end side of the tab 500 and the rivet 900.

Figure 5A:
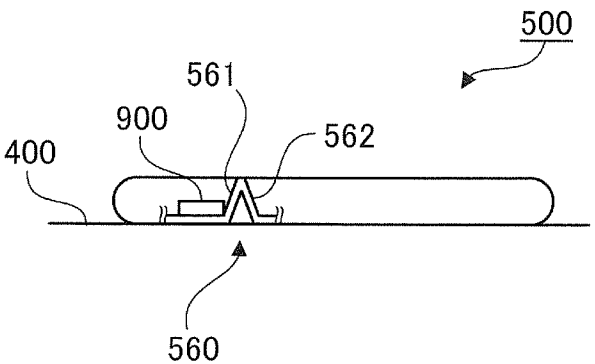
Figure 6A:
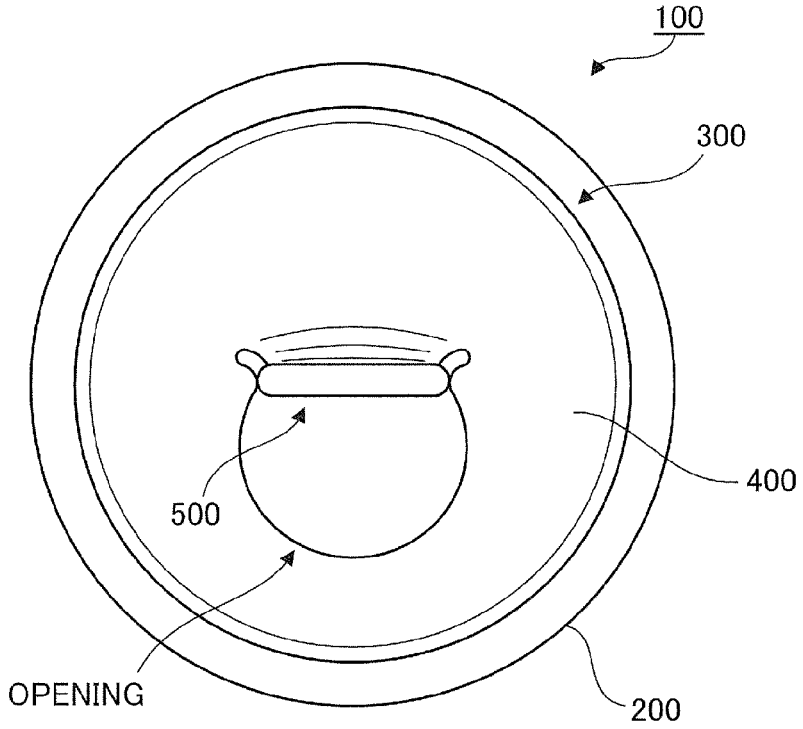
FIGS. 6A and 6B are views showing the state in which the tab is operated by a user and the opening portion is formed in the panel.
Figure 6B:
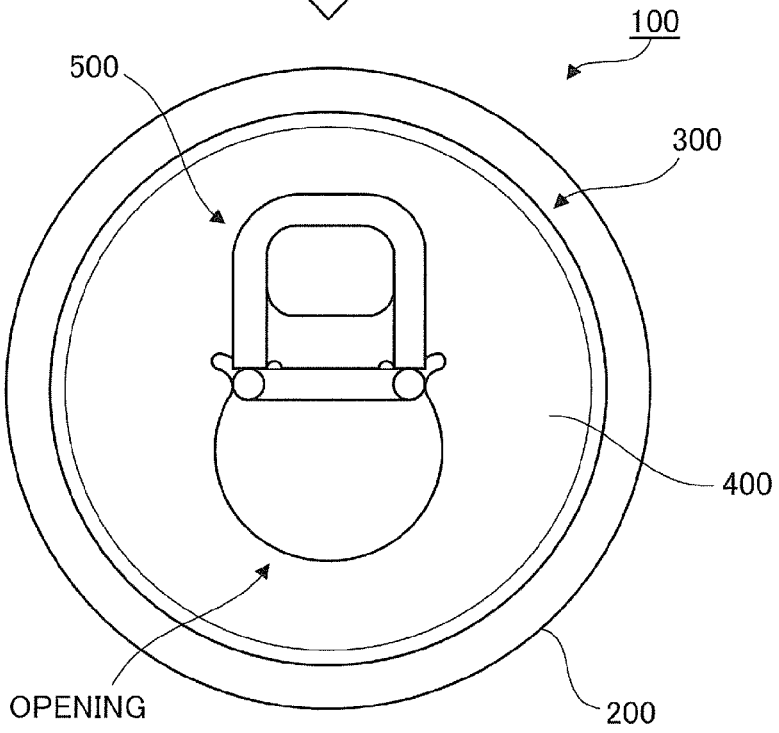

Here, as shown in FIG. 5A, in the stretch part 560, a bending process is performed on the aforementioned tab body 520 (refer to FIG. 4A) formed into a sheet, and the first piece 561 and the second piece 562 which intersect with each other are provided in the stretch part 560. That is, a bending part where the sheet constituting the tab body 520 bends is formed in the stretch part 560. Here, the first piece 561 is arranged to get away from the panel 400 as it heads to the rear end of the tab 500. Meanwhile, the second piece 562 has a front end connected to the first piece 561, and is arranged to come close to the panel 400 as it heads to the rear end of the tab 500.

Here, in the stretch part 560, one end side located on the front end 510 side of the tab 500 is connected to the rivet 900 (refer to FIGS. 1A and 1B), and the other end side located on the rear end side of the tab 500 is connected to the tab body 520. As shown in FIG. 5A, in the exemplary embodiment, the bending process is performed on the aforementioned tab body 520 (refer to FIG. 4A) formed into the sheet, and the first piece 561 and the second piece 562 intersecting with each other are provided in the stretch part 560, as mentioned above. That is, the bending part where the sheet constituting the tab body 520 bends is formed in the stretch part 560. Here, as mentioned above, the first piece 561 is arranged to get away from the panel 400 as it heads to the rear end of the tab 500. Meanwhile, the second piece 562 has a front end connected to the first piece 561, and is arranged to come close to the panel 400 as it heads to the rear end of the tab 500.

Further explanation will be given for the tab 500 with reference to FIG. 4A. A first slit 521 is formed in a curl part provided along the longitudinal direction of the tab 500 out of 4 curl parts provided in the four directions of the tab body 520. A second slit 522 is formed in another curl part provided along the longitudinal direction of the tab 500 out of the 4 curl parts. Further, a groove 523 is formed at a section located between the first slit 521 and the second slit 522 in the tab body 520.

Here, the first slit 521, the second slit 522 and the groove 523 are provided in the state of being connected to each other and being continuous. The first slit 521, the second slit 522 and the groove 523 are provided along the width direction of the tab 500. The first slit 521, the second slit 522 and the groove 523 are arranged between the insert hole 540 and the penetration hole 530. Here, in the exemplary embodiment, the first slit 521, the second slit 522 and the groove 523 are formed as mentioned above, and rigidity (bending rigidity) at the section where they are formed decreases. Thus, as shown in FIG. 4B, upon applying a load to the rear end side of the tab 500, the tab 500 starts to fold. That is, the tab 500 starts to bend. Here, in the exemplary embodiment, although the rigidity at the section is decreased by forming the groove 523 between the first slit 521 and the second slit 522, it is not limited to such a groove, and, for example, the rigidity can be decreased by performing bending process. The groove 523 is not essential, and thus the groove 523 can be omitted. Note that, the section of the tab 500 where the first slit 521, the second slit 522 and the groove 523 are formed can be taken as a rigidity decrease part.

Next, explanation will be given for the state of each part when the tab 500 is operated.

When the tab 500 is operated by a user, the user's finger is inserted between the rear end of the tab 500 and the panel 400, and the tab 500 is pulled up as shown in FIG. 5B. Here, at this time, the stretch part 560 formed of the first piece 561 and the second piece 562 firstly stretches. That is, the stretch part 560 that has been in the folding state by the first piece 561 and the second piece 562 is straightened, and thus the stretch part 560 stretches. Upon complete stretch of the stretch part 560 (stopping the stretch), the load is transmitted to the rivet 900 from the stretch part 560, and the force for pulling the rivet 900 upward acts on the rivet 900.

On the other hand, since the front end 510 of the tab 500 is in contact with the panel 400, force for pressing the panel 400 downward acts on the panel 400. Thereby, the fracture of the panel 400 occurs at the curved part 454 (refer to FIG. 2) of the second score line 450 which is located between the front end 510 of the tab 500 and the rivet 900. Then, as explained above, the fracture progresses along the second score line 450, and subsequently, the fracture progresses along the first score line 430. Thereby, the tongue part is formed at the region surrounded by the first score line 430. Also, an opening portion is formed at the region surrounded by the first score line 430.

As mentioned above, upon transmitting the load to the rivet 900 from the stretch part 560 after the stretch of the stretch part 560, a rotation moment as shown by an arrow 4A in FIG. 5B acts on the tongue part. Thereby, the tongue part rotates around the base of the tongue part as a center, and the tongue part folds at the base. By this fold, the tongue part enters the inside of the drink can 100. Further, by the entry of the tongue part to the inside of the drink can 100, the front end side of the tab 500 enters the inside of the drink can 100 as shown in FIG. 6A.

Note that, FIG. 6A shows the state in which the tab 500 stands up and the panel 400 and the tab 500 are perpendicular to each other. Then, the pulled-up tab 500 is to be returned to the original state by a user, and at this time, the fold of the tab 500 occurs at the first slit 521, the second slit 522 and the groove 523, as mentioned above. As a result, as shown in FIG. 6B, the rear end side of the tab 500 is put along the panel 400. On the other hand, the front end side of the tab 500 is put into the state of entering the inside of the drink can 100.

Note that, in the exemplary embodiment, when the opening portion is formed in the panel 400, as shown in FIG. 5B, the tab 500 makes a certain angle with respect to the panel 400, and the load from the tab 500 concentrically acts on a section of the panel 400 near the rivet 900. Here, in most drink cans, since the tab 500 which is laid on the region surrounded by the score lines (along the panel 400) is brought into contact therewith, the fracture at the score lines is difficult to occur, and the operation load at pulling up the tab 500 is easy to increase. On the other hand, in the configuration according to the exemplary embodiment, as mentioned above, since the load from the tab 500 concentrically acts on the section of the panel 400 near the rivet 900, the fracture at the score lines is easy to occur and the operation load at pulling up the tab 500 decreases.

Here, in the case where the diameter of the drink can 100 is desired to be made smaller (the panel 400 is desired to be made smaller), the region (the region which becomes the opening portion, the region which becomes the tongue part) surrounded by the first score line 430 and the tab 500 are necessary to be closely arranged. In this case, an area where the region surrounded by the first score line 430 and the tab 500 are overlapped increases. Also, in the case where the opening portion (tap) is made bigger, the area where the region surrounded by the first score line 430 and the tab 500 are overlapped increases. However, in this case, since the drink contained therein may be difficult to flow out or a similar situation may arise, a user is difficult to drink. Accordingly, in the exemplary embodiment, as mentioned above, the section of the tab 500 which is overlapped with the tap (section overlapped with the tongue part) is configured to enter the inside of the drink can 100. In this case, since the area of the opening portion increases, a user is easy to drink in comparison with a configuration in which the front end side of the tab 500 does not enter the inside of the drink can 100.

Figure 7:
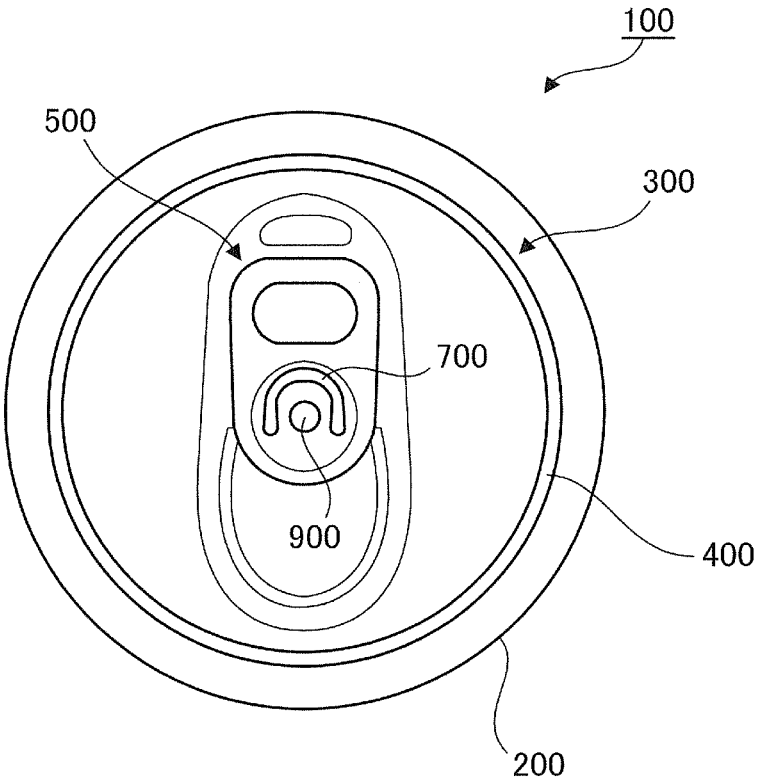
FIG. 7 is a view showing another configuration example of the can lid.

Note that, as shown in FIG. 7 (a view showing another configuration example of the can lid 300), the tab 500 in which a slit 700 is provided around a section secured by the rivet 900 is often used. However, in the case where such a tab 500 is attached to the panel 400 shown in FIG. 2, force for pulling the rivet 900 upward (pulling force) (refer to a reference numeral 4B in FIG. 5B) does not work on the rivet 900 since the slit 700 is provided, and the rotation moment shown by the arrow 4A in FIG. 5B is not applied thereto. In this case, the fold of the tongue part at the base of the tongue part is difficult to occur. That is, although the fold of the tongue part occurs at the section where the rivet 900 is provided, the fold of the tongue part is difficult to occur at the base of the tongue part. In this case, the opening portion formed in the panel 400 becomes small.

To avoid this, in the exemplary embodiment, the section of the tab 500 which is located behind the rivet 900 and the rivet 900 are configured to be connected to each other by the stretch part 560. By this configuration, the force for pulling the rivet 900 upward increases, and the rotation moment acting on the tongue part increases. Thereby, bend of the tongue part occurs at the base of the tongue part, and all of the tongue part enters the inside of the drink can 100.

Note that, even though the stretch part 560 is not provided, the aforementioned rotation moment can be increased. For example, if the section of the tab 500 which is located behind the rivet 900 and the rivet 900 are simply connected to each other without the aforementioned stretch part 560, the rotation moment increases. However, in this case, the operability at pulling up the tab 500 is caused to decrease. More specifically, in general, the tab 500 is pulled up upon inserting a finger between the tab 500 and the panel 400 for pulling up the tab 500. However, as mentioned above, in the case where the section located behind the rivet 900 and the rivet 900 are connected to each other, displacement of the tab 500 (displacement of the rear end of the tab 500 to the upside) is restricted by the rivet 900, and thus the displacement of the tab 500 is difficult to occur. In this case, a user's finger is difficult to be inserted between the panel 400 and the tab 500, and thus the operability at pulling up the tab 500 decreases.

Although, by pulling up the tab 500, the front end side of the tab 500 presses the panel 400 and hole making starts, in this case, the hole making and the aforementioned rotation moment simultaneously start. Specifically, when the rear end side of the tab 500 is pulled upward, since the aforementioned stretch part 560 is not provided, while at the same time the panel 400 is started to be pressed by the front end side of the tab 500 due to pulling up the tab 500, the aforementioned rotation moment to the section which will become the aforementioned tongue part starts. However, the aforementioned rotation moment is to work for bending and entering, into the can, the aforementioned tongue part formed as a result of making the opening portion which is caused by applying the pressure of the front end side of the tab 500 on the panel 400, after the making of the opening portion of the panel 400 progresses. Thus, start of the aforementioned rotation moment at the timing when the aforementioned tongue part is not formed may not be efficient operation of the tab 500, and the operability at pulling up the tab 500 decreases.

To avoid this, in the exemplary embodiment, the configuration in which the stretch part 560 is provided is adopted. In the case where the stretch part 560 is provided as mentioned above, since the stretch part 560 stretches until the tab 500 has a predetermined angle, the displacement of the tab 500 is difficult to be restricted by the rivet 900 until the tab 500 has the predetermined angle (for example 60°). If the displacement is difficult to be restricted as mentioned above, a finger is easy to be inserted between the tab 500 and the panel 400. As a result, in the configuration of the exemplary embodiment, decrease in the operability at pulling up the tab 500 is suppressed.

Figure 8A:
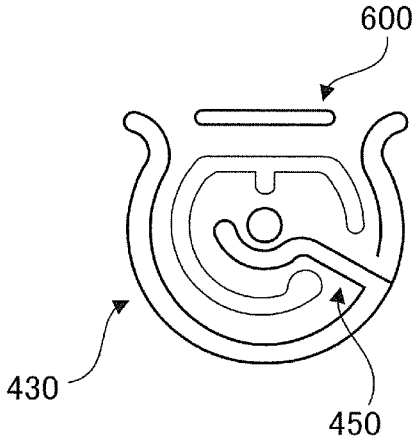
FIGS. 8A to 8C are views showing other examples of the groove.
Figure 8B:
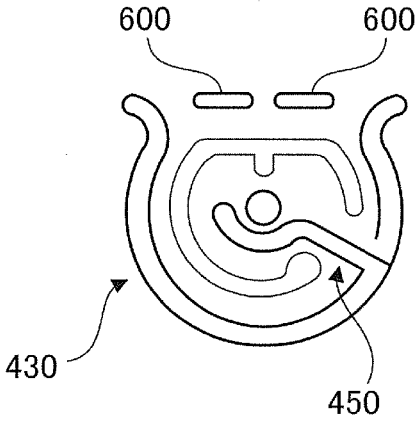
Figure 8C:
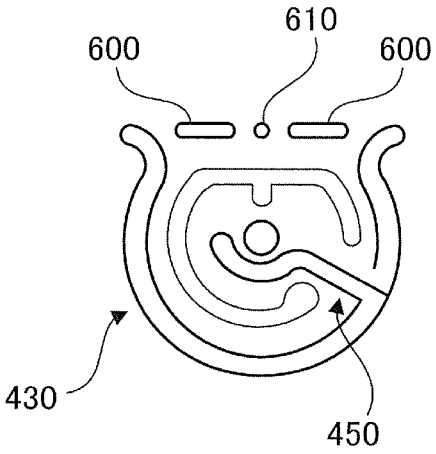

Note that, although the groove 600 is formed to have a curve (refer to FIG. 2) in the above mention, the groove 600 can be linearly formed as shown in FIG. 8A (FIGS. 8A to 8C are views showing other examples of the groove 600). The linear groove 600 can be provided by dividing it into plural sections so as to be separate from each other as shown in FIG. 8B. In addition, a point-like concavity 610 can be provided between the plural grooves 600 (2 grooves 600 in the exemplary embodiment) as shown in FIG. 8C. Note that, in these examples, although the tongue part is easy to return to the original state in comparison with the case where the groove 600 has a curve, the tongue part is easy to bend in comparison with the case where the groove 600 is not formed. That is, the operation force necessary at pulling up the tab 500 decreases in comparison with the case where the groove 600 is not formed. Note that, although, in the mention which has already been given and will be given, the example in which the groove 600 and the concavity 610 are concave toward the inside of the drink can 100 is given, they may be formed to be convex toward the outside of the drink can 100.

Figure 9A:
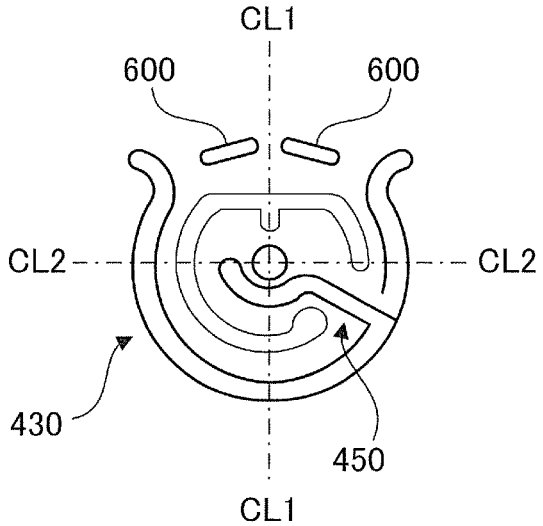
FIGS. 9A to 9C are views showing other examples of the groove.
Figure 9B:
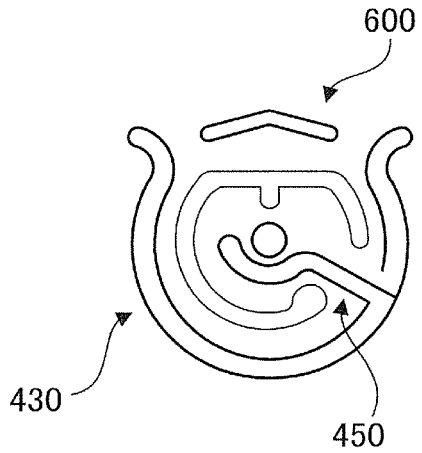
Figure 9C:
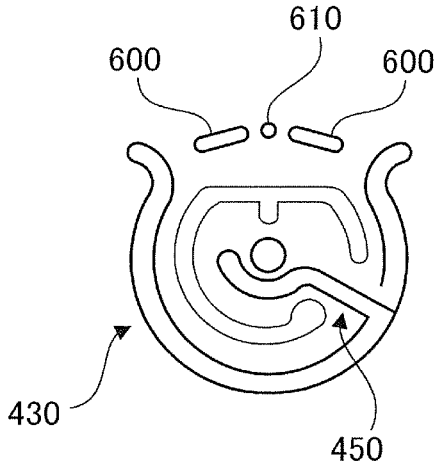
Figure 10A:
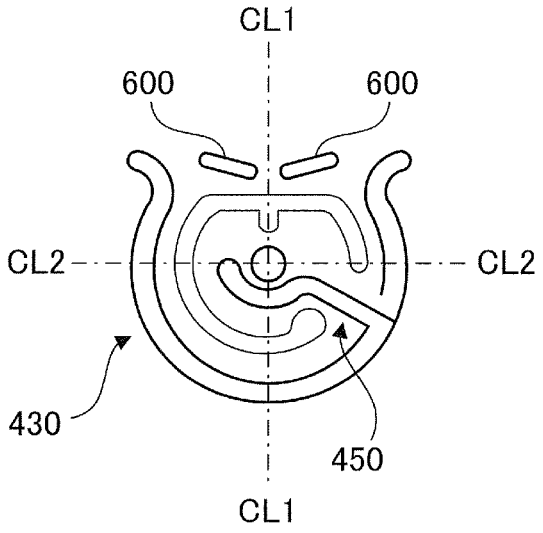
FIGS. 10A to 10C are views showing other examples of the groove.
Figure 10B:
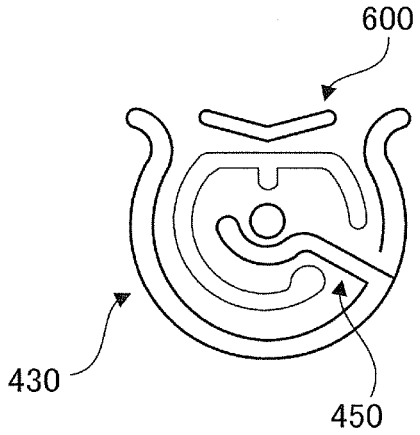
Figure 10C:
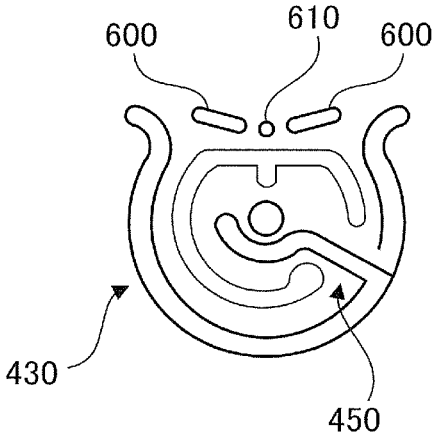

As shown in FIG. 9A (FIGS. 9A to 9C are views showing other examples of the groove 600), the two linear grooves 600 can be respectively provided on two straight lines (not shown) intersecting with each other, instead of the arrangement on the same straight line. That is, the two grooves 600 can be arranged in an inverted V-like shape. Note that, although each of the two grooves 600 is arranged to come close to the second virtual line CL2 as it gets away from the first virtual line CL1 in FIG. 9A, each of the two grooves 600 can be arranged to get away from the second virtual line CL2 as it gets away from the first virtual line CL1 as shown in FIG. 10A (FIGS. 10A to 10C are views showing other examples of the groove 600). Instead, the two grooves 600 can be provided to be connected with each other as shown in FIGS. 9B and 10B. In addition, the point-like concavity 610 can be provided between the two grooves 600 as shown in FIGS. 9C and 10C.

Figure 11A:
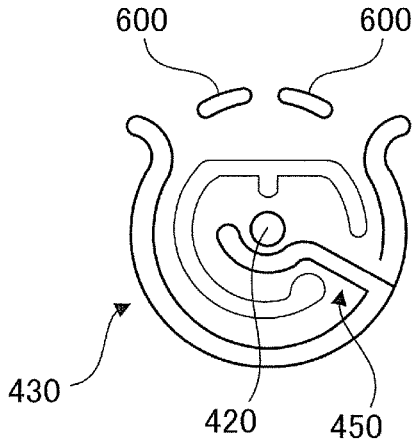
FIGS. 11A and 11B are views showing other examples of the groove.
Figure 11B:
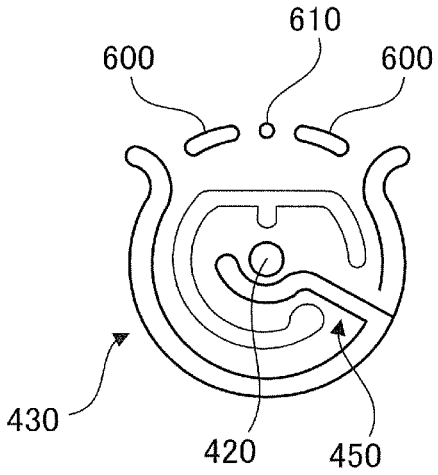
Figure 12A:
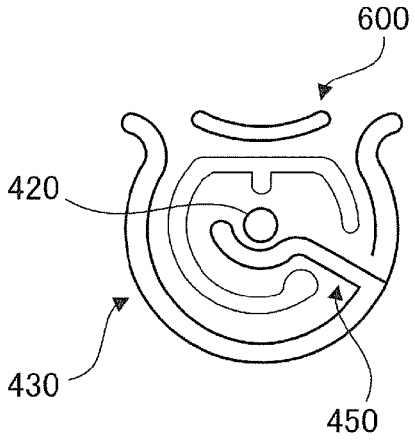
FIGS. 12A to 12C are views showing other examples of the groove.
Figure 12B:
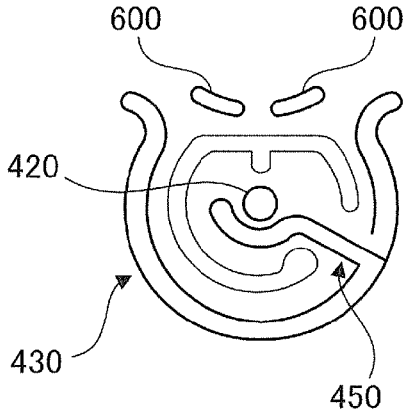
Figure 12C:
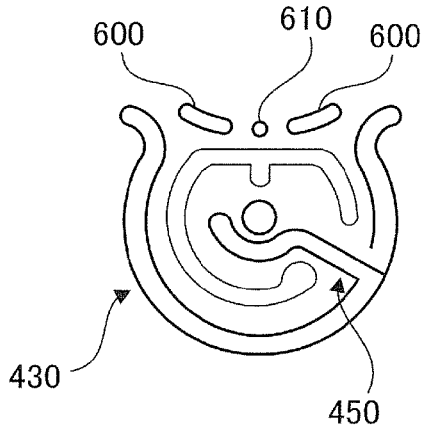

The two linear grooves 600 shown in FIG. 9A can be formed to have a curve expanding toward the direction away from the protrusion 420, as shown in FIG. 11A (FIGS. 11A and 11B are views showing other examples of the groove 600). In addition, as shown in FIG. 11B, the point-like concavity 610 can be provided between the two grooves 600 expanding toward the direction away from the protrusion 420. Although the groove 600 expanding toward the direction away from the protrusion 420 is exemplified in FIG. 2, the groove 600 may be formed to expand toward the direction coming close to the extrusion 420 as shown in FIG. 12A (FIGS. 12A to 12C are views showing other examples of the groove 600). Instead, the two linear grooves 600 shown in FIG. 10A can be formed to have a curve expanding toward the side where the protrusion 420 is provided, as shown in FIG. 12B. In addition, as shown in FIG. 12C, the point-like concavity 610 can be provided between the two grooves 600.

Figure 13A:
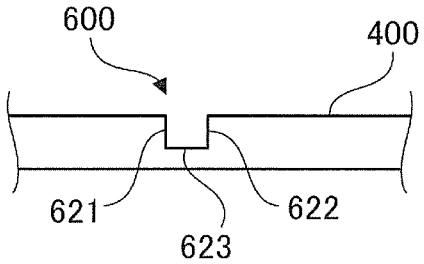
FIGS. 13A to 13D are views showing examples of the shape of the groove.
Figure 13B:
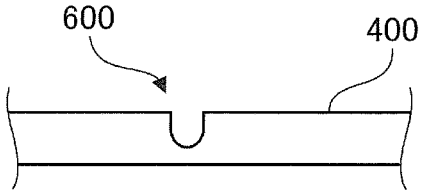
Figure 13C:
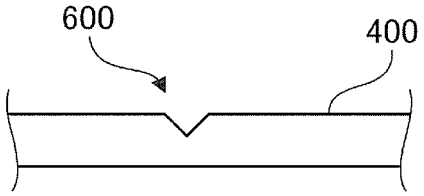
Figure 13D:
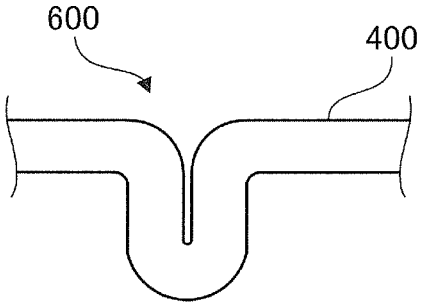

Note that, although the shape of the groove 600 is not particularly limited, the groove 600 can be formed into the shape shown in FIGS. 13A to 13D. FIGS. 13A to 13D are views showing examples of the shape of the groove 600. For example, the groove 600 can be formed by a shape having: a first side 621 and a second side 622 which are approximately perpendicular to the surface of the panel 400; and a flat base 623 connecting the first side 621 and the second side 622 as shown in FIG. 13A. Note that, the bottom of the groove 600 may have a curvature as shown in FIG. 13B. Alternatively, the groove 600 can be formed by a shape whose cross-section is a triangle as shown in FIG. 13C. Note that, although the rigidity at the base of the tongue part is decreased by forming the groove 600 in the above, the rigidity can be decreased by performing a bending process on the base of the tongue part as shown in FIG. 13D.

Next, another configuration of the panel 400 will be explained.

Figure 14:
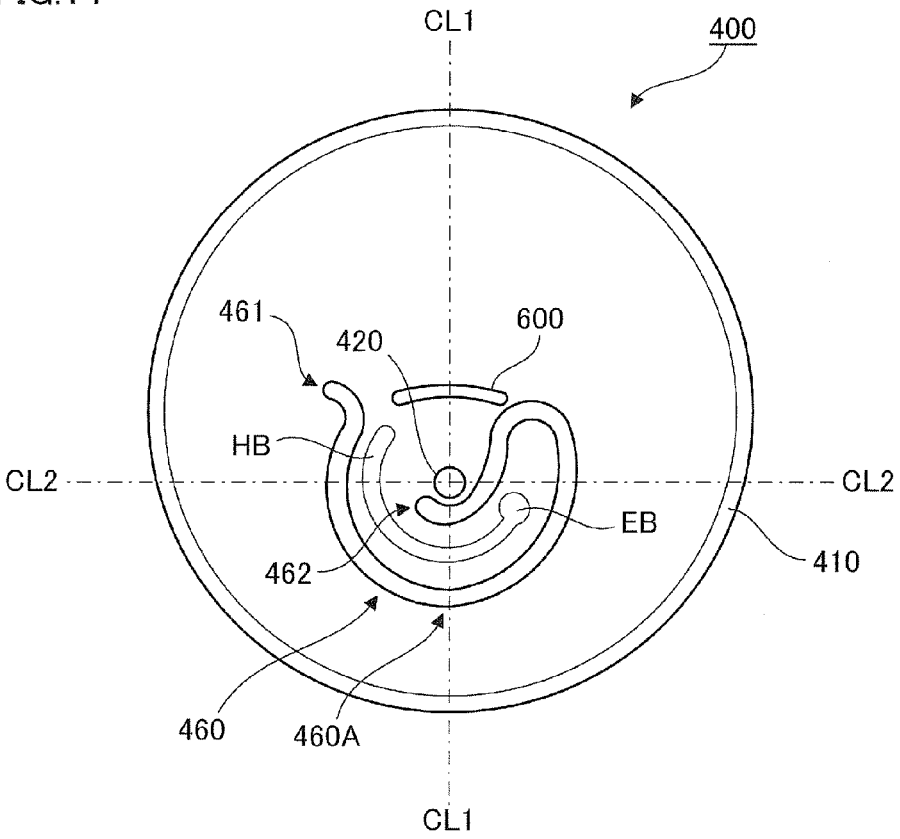
FIG. 14 is a front view showing another example of the panel.

FIG. 14 is a front view showing another example of the panel 400.

In the panel 400 according to the exemplary embodiment, the second score line 450 which has already been explained above is not provided. In the panel 400, a score line 460 corresponding to the aforementioned first score line 430 is provided. Here, although the first score line 430 shown in FIG. 2 is formed to have a symmetrical relation with respect to the first virtual line CL1 as a center, the score line 460 in the exemplary embodiment is not arranged to have a symmetrical relation with respect to any line.

Here, the score line 460 in the exemplary embodiment has one end 461 and the other end 462 similarly to the aforementioned first score line 430. The shape extending from the one end 461 to a top part 460A of the score line 460 is the same as the shape extending from the one end 431 to the top part 433A of the aforementioned first score line 430 (refer to FIG. 2). On the other hand, the shape extending from the top part 460A to the other end 462 is different from the shape extending from the top part 433A to the other part 432 of the first score line 430.

More specifically, the other end 462 of the score line 460 in the exemplary embodiment is provided in the vicinity of the protrusion 420. The other end 462 is provided within a region where the one end 461 is provided out of two regions facing each other across the first virtual line CL1. In the exemplary embodiment, the score line 460 extends from the other end 462 as a start point to the one end 461 as an end point. More specifically, the score line 460 firstly passes between the protrusion 420 and the top part 460A from the other end 462 as a start point. Note that, in the exemplary embodiment, a section of the score line 460 which is located between the other end 462 and a bending part which will be mentioned below can be taken as a second score line.

Then, the score line 460 travels around the protrusion 420 and toward a side opposite to the side where the top part 460A of the score line 460 is provided. After that, the score line 460 bends and the travelling direction thereof is reversed. More specifically, the score line 460 travels in the direction away from the protrusion 420 and the direction toward the outer peripheral edge 410 of the panel 400 while making an arc. Further, the score line 460 travels toward the top part 460A of the score line 460. Finally, the score line 460 reaches the one end 461. Note that, the aforementioned bending section of the score line 460 is hereinafter referred to as "a bending part" in this description.

Here, when the tab 500 is operated and an opening portion is formed on the drink can 100, the fracture of the panel 400 occurs at the section of the score line 460 which is located between the extrusion 420 and the top part 460A of the score line 460 similarly to the above. Then, the fracture of the panel 400 progresses to the aforementioned one end 461 of the score line 460 via the top part 460A of the score line 460. Thereby, similarly to the above, the tongue part is formed and the opening portion serving as a tap is formed in the panel 400. Note that, in the score line 460 according to the exemplary embodiment, the bending part is formed as mentioned above. Accordingly, the fracture of the aforementioned panel 400 shown in FIG. 2 progresses easier than the fracture of the panel 400 shown in FIG. 14.

Next, another example of the tab 500 will be explained.

Figure 15A:
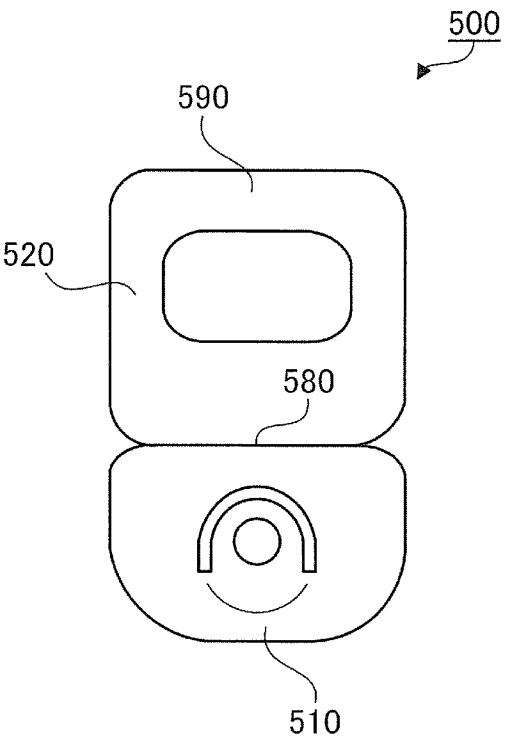
FIGS. 15A to 15C are views showing another example of the tab.
Figure 15B:
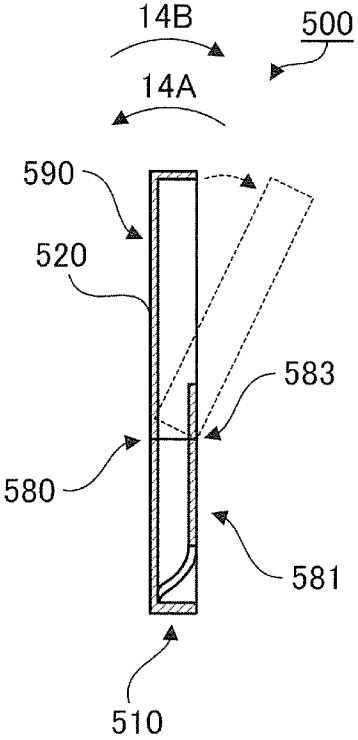
Figure 15C:
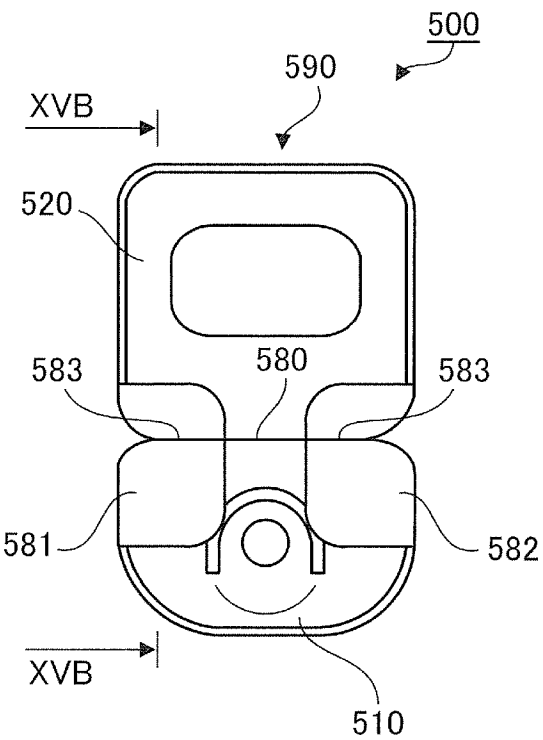

FIGS. 15A to 15C are views showing another example of the tab 500. Note that, FIG. 15A is a front view of the tab 500, FIG. 15B is a cross-sectional view taken along a line XVB-XVB in FIG. 15C, and FIG. 15C is a back-side view of the tab 500. That is, FIG. 15C is a view in which the tab 500 is viewed from the facing surface side which faces the panel 400.

In the tab 500 shown in FIGS. 15A to 15C, a slit 580 extending in the width direction of the tab 500 (direction orthogonal to the longitudinal direction of the tab 500) is formed with respect to the tab body 520 as shown in FIG. 15A. In the tab 500 according to the exemplary embodiment, a first facing piece 581 and a second facing piece 582 which are located on the back surface side of the tab 500 and face the tab body 520 are provided as shown in FIG. 15C. Here, the first facing piece 581 is connected to one edge part along the longitudinal direction of the tab body 520 within the edge of the tab body 520. The second facing piece 582 is connected to the other edge part along the longitudinal direction of the tab body 520 within the edge of the tab body 520. In the exemplary embodiment, a groove 583 extending in the width direction of the tab 500 is formed in each of the first facing piece 581 and the second facing piece 582.

Here, in the exemplary embodiment, the tab 500 is pulled up in the direction denoted by an arrow 14A in FIG. 15B. Thereby, while the opening portion is formed in the panel 400, the front end 510 of the tab 500 enters the inside of the drink can 100 through the opening portion. Then, as denoted by an arrow 14B, upon performing the returning operation of the tab 500, the tab 500 is split into the front end 510 side and the rear end 590 side at the section where the slit 580 is provided. In addition, bend of the tab 500 occurs at the section where the groove 583 is provided. Thereby, the tab 500 goes into a folding state. In this case, as mentioned above, the front end 510 side of the tab 500 is kept to enter the inside of the drink can 100. Thereby, overlap between the tap and the tab 500 is suppressed.

Next, explanation will be given for another configuration example of the stretch part 560 provided in the tab 500.

Figure 16A:
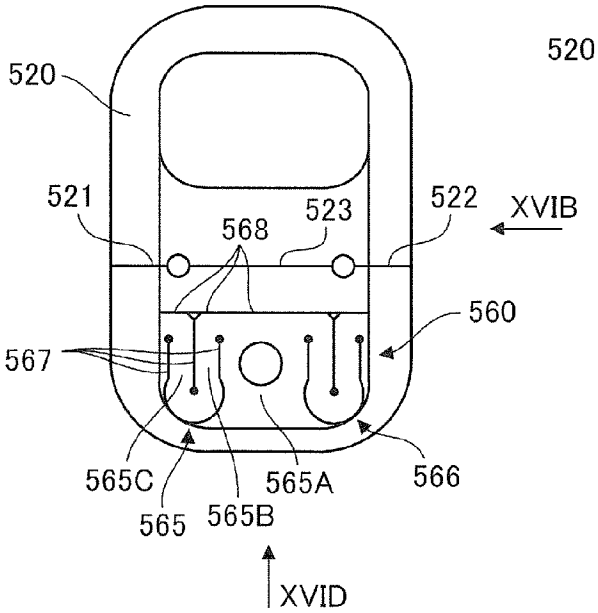
FIGS. 16A to 16D are views showing another configuration example of the stretch part of the tab.
Figure 16B:
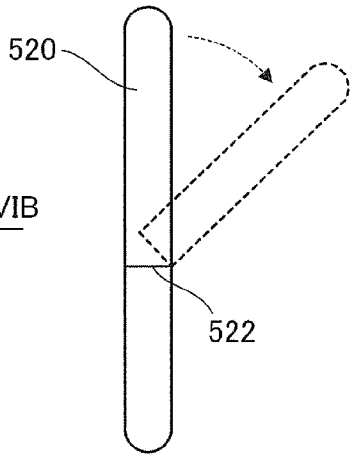
Figure 16C:
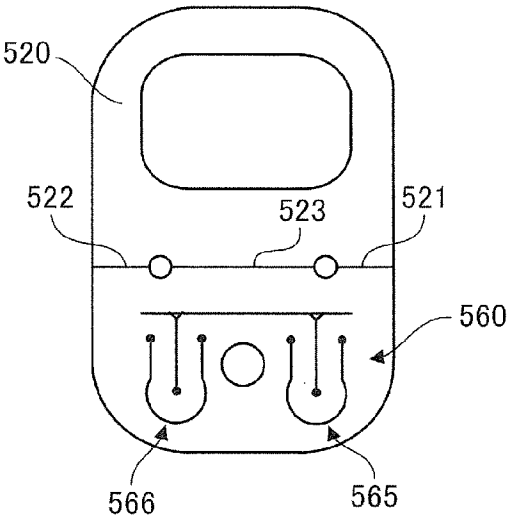
Figure 16D:
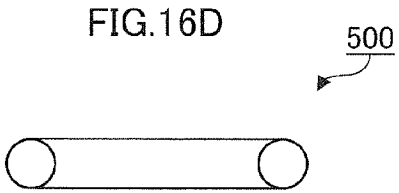

FIGS. 16A to 16D are views showing another configuration example of the stretch part 560 of the tab 500. Note that, FIG. 16A is a front view of the tab 500, FIG. 16B is a view in which the tab 500 is viewed from an arrow XVIB direction in FIG. 16A. FIG. 16C is a back-side view of the tab 500. That is, it is the view in which the tab 500 is viewed from the facing surface side facing the panel 400. FIG. 16D is a view in which the tab 500 is viewed from an arrow XVID direction in FIG. 16A. Note that, the same reference numerals are used for the functions similar to those of the aforementioned exemplary embodiment, and the explanation thereof is omitted here.

The stretch part 560 shown in FIGS. 16A to 16D is provided with a first stretch part 565 and a second stretch part 566 as shown in FIG. 16A. Here, the first stretch part 565 is provided on one edge side of the tab 500 in the width direction of the tab 500, whereas the second stretch part 566 is provided on the other edge side of the tab 500. Note that, since the first stretch part 565 and the second stretch part 566 are similarly configured, the first stretch part 565 will be explained below.

The first stretch part 565 is equipped with a secured piece 565A secured to the panel 400 with the rivet 900 (refer to FIGS. 1A and 1B). The first stretch part 565 has a first piece 565B which is located on the peripheral edge side of the tab 500 relative to the secured piece 565A, which is provided along the longitudinal direction of the tab 500, and which has one end (an end located on the rear end side of the tab 500) connected to the secured piece 565A. Further, the first stretch part 565 has a second piece 565C which is located on the peripheral edge side of the tab 500 relative to the first piece 565B, which is provided along the longitudinal direction of the tab 500, and which has one end (an end located on the front end side of the tab 500) connected to the first piece 565B. Note that, the other end of the second piece 565C is connected to the peripheral edge of the tab 500.

In the tab 500 according to the exemplary embodiment, slits 567 are formed between the secured piece 565A and the first piece 565B, between the first piece 565B and the second piece 565C, and between the second piece 565C and the peripheral edge of the tab 500. Also, a slit 568 is formed between the secured piece 565A and a section (hereinafter, referred to as a "rear-end side section") of the tab body 520 which is located on the rear end side of the tab 500 relative to the secured piece 565A. Further, the slit 568 is also formed between the rear-end side section and the first piece 565B and between the rear-end side section and the second piece 565C.

Figure 17:
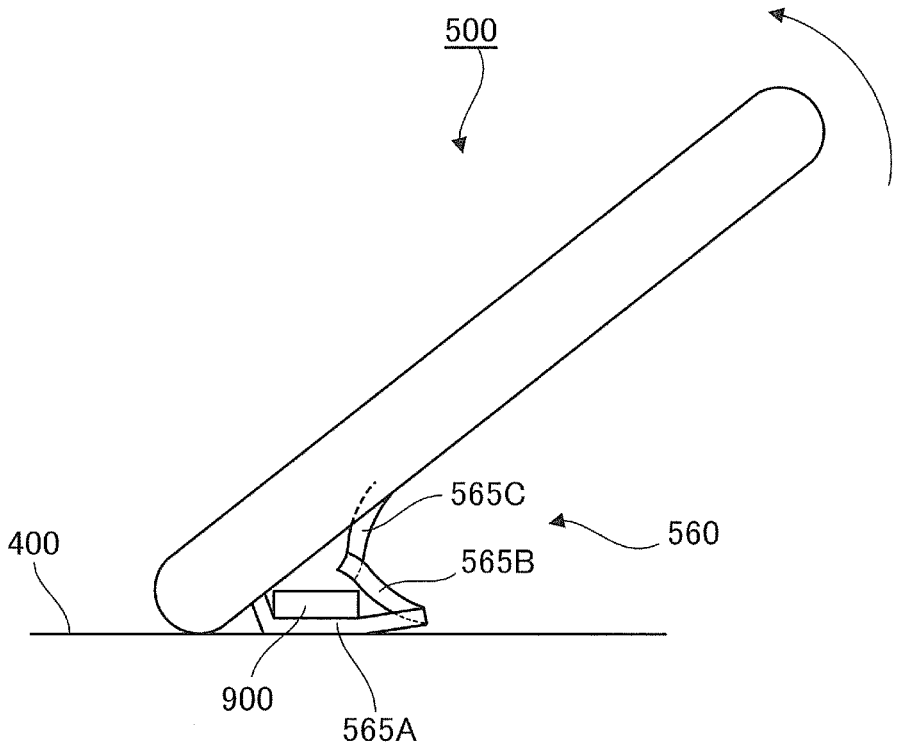
FIG. 17 is a view showing the tab when the pulling-up operation is performed.

Here, when a user pulls up the tab 500, the rear end side of the tab 500 moves upward as shown in FIG. 17 (a view showing the tab 500 when the pulling-up operation is performed). By this move, the second piece 565C is firstly pulled and the stretch part 560 stretches. More specifically, fracture of the sheet constituting the tab 500 occurs at the aforementioned slits 567 formed between the secured piece 565A and the first piece 565B, between the first piece 565B and the second piece 565C, and between the second piece 565C and the peripheral edge of the tab body 520. Also, the fracture occurs between the aforementioned rear-end side section and the secured piece 565A, between the rear-end side section and the first piece 565B, and between the rear-end side section and the second piece 565C. As a result, the stretch part 560 stretches like a string as shown in FIG. 17. When the stretch of the stretch part 560 ends, the rotation moment acting on the tongue part increases, and the tongue part enters the inside of the drink can 100.

Figure 18A:
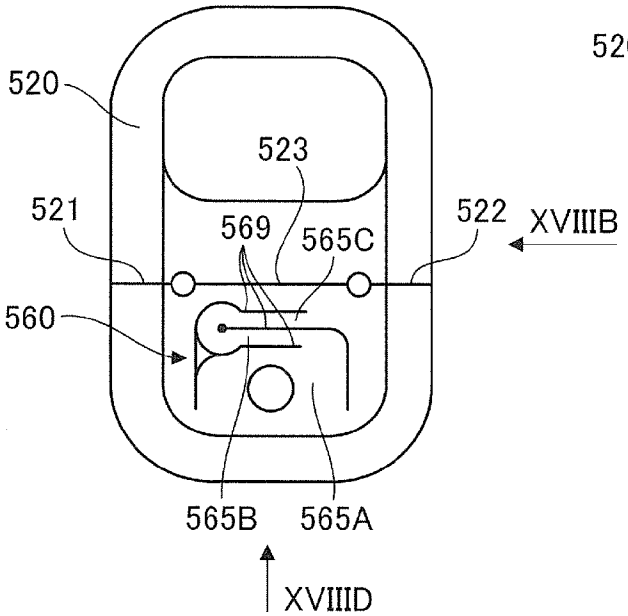
FIGS. 18A to 18D are views for illustrating another example of the stretch part.
Figure 18B:
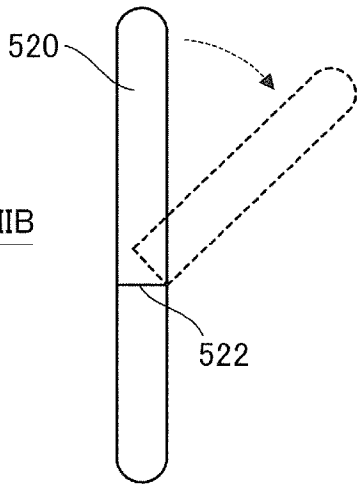
Figure 18C:
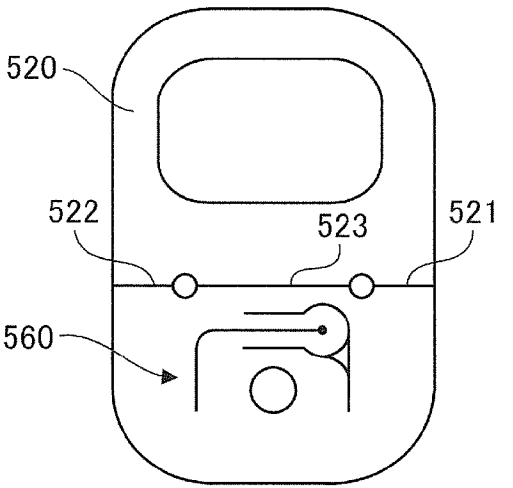
Figure 18D:
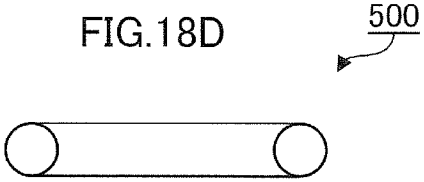

FIGS. 18A to 18D are views for illustrating another example of the stretch part 560. Note that, FIG. 18A is a front view of the tab 500, and FIG. 18B is a view in which the tab 500 is viewed from an arrow XVIIIB direction in FIG. 18A. FIG. 18C is a back-side view of the tab 500. That is, it is the view in which the tab 500 is viewed from the facing surface side facing the panel 400. FIG. 18D is a view in which the tab 500 is viewed from an arrow XVIIID direction in FIG. 18A. Note that, the same reference numerals are used for the functions similar to those of the aforementioned exemplary embodiment, and the explanation thereof is omitted here.

In the stretch part 560 shown in FIGS. 18A to 18D, the secured piece 565A, the first piece 565B and the second piece 565C are provided similarly to the above. Here, the first piece 565B according to the exemplary embodiment is provided along the width direction of the tab 500. Also, the second piece 565C is provided along the width direction of the tab 500. The first piece 565B is provided on the rear end side of the tab 500 relative to the secured piece 565A, and the second piece 565C is provided on the rear end side of the tab 500 relative to the first piece 565B. Slits 569 are formed between the secured piece 565A and the first piece 565B, between the first piece 565B and the second piece 565C, and between the second piece 565C and the aforementioned rear-end side section.

Figure 19:
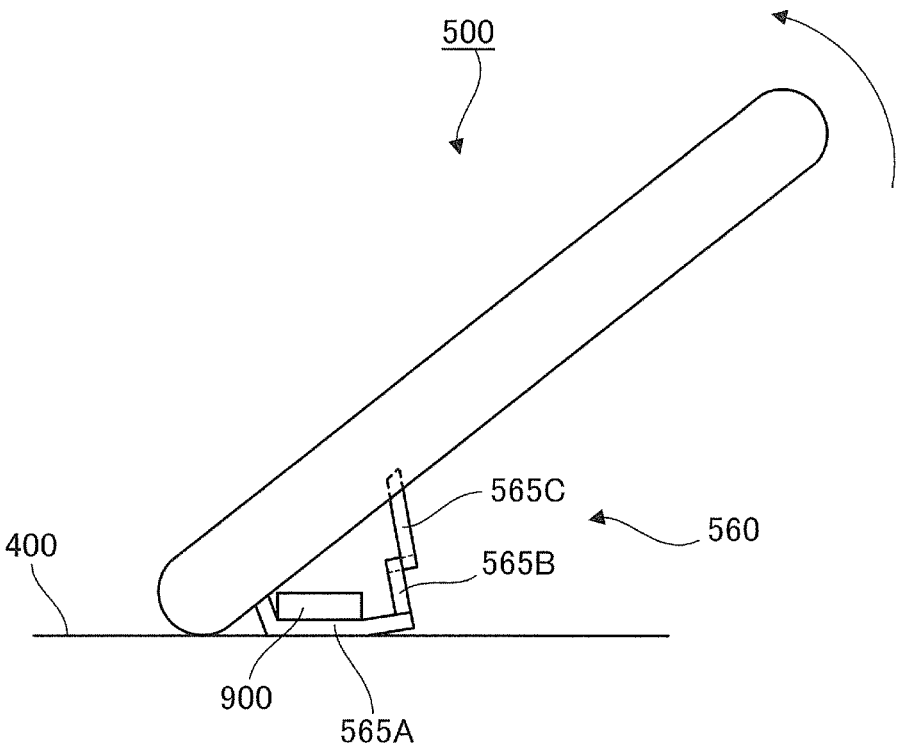
FIG. 19 is a view showing the tab when the pull-up operation is performed.

Here, in the case where the tab 500 is pulled up by a user, the rear end of the tab 500 moves upward as shown in FIG. 19 (a view showing the tab 500 when the pull-up operation is performed) similarly to the above. By this move, the stretch part 560 stretches. More specifically, the fracture of the sheet constituting the tab 500 occurs at the slits 569 formed between the secured piece 565A and the first piece 565B, between the first piece 565B and the second piece 565C, and between the second piece 565C and the rear-end side section. As a result, the stretch part 560 stretches like a string as shown in FIG. 19. When the stretch of the stretch part 560 ends, the rotation moment acting on the tongue part increases, and the tongue part enters the inside of the drink can 100 similarly to the above.

Figure 20A:
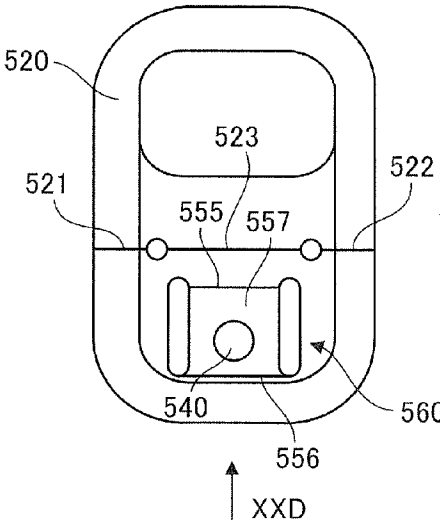
FIGS. 20A to 20D are views for illustrating another example of the stretch part.
Figure 20B:
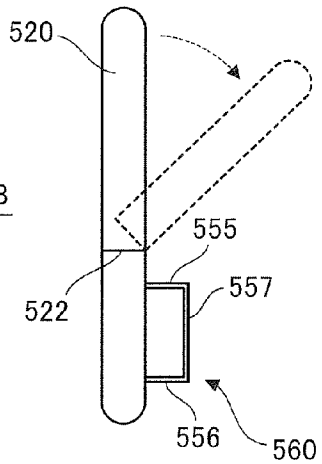
Figure 20C:
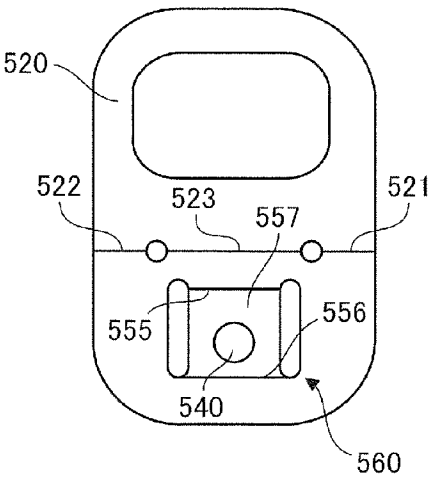
Figure 20D:
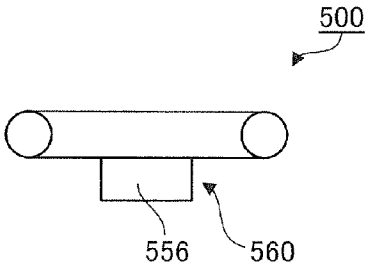

The stretch part 560 can be configured as shown in FIGS. 20A to 20D (views for illustrating another example of the stretch part 560). Note that, FIG. 20A is a front view of the tab 500, FIG. 20B is a view in which the tab 500 is viewed from an arrow XXB direction in FIG. 20A. FIG. 20C is a back-side view of the tab 500. That is, it is the view when the tab 500 is viewed from the facing surface side facing the panel 400. FIG. 20D is a view in which the tab 500 is viewed from an arrow XXD direction of FIG. 20A. Note that, the same reference numerals are used for the functions similar to those of the aforementioned exemplary embodiment, and the explanation thereof is omitted here.

The stretch part 560 shown in FIGS. 20A to 20D has a first projecting piece 555 projecting from the back-side surface of the tab body 520 (the facing surface facing the panel 400), a second projecting piece 556 which is located on the front end side of the tab 500 relative to the first projecting piece 555 and also projects from the back-side surface of the tab body 520, and a connecting piece 557 which is arranged to have a gap with the back-side surface of the tab body 520 and connects an end of the first projecting piece 555 and an end of the second projecting piece 556 as shown in FIG. 20B. Here, in the exemplary embodiment, the insert hole 540 where the protrusion 420 (refer to FIG. 2) is inserted is formed in the connecting piece 557. Note that, the insert hole 540 is arranged in the state of being close to the side where the second projecting piece 556 is provided. In the exemplary embodiment, by arranging the first projecting piece 555 and the connecting piece 557 to intersect with (be perpendicular to) each other, the bending part where a part of the tab body 520 bends is formed at the section where the first projecting piece 555 and the connecting piece 557 are provided.

Figure 21B:
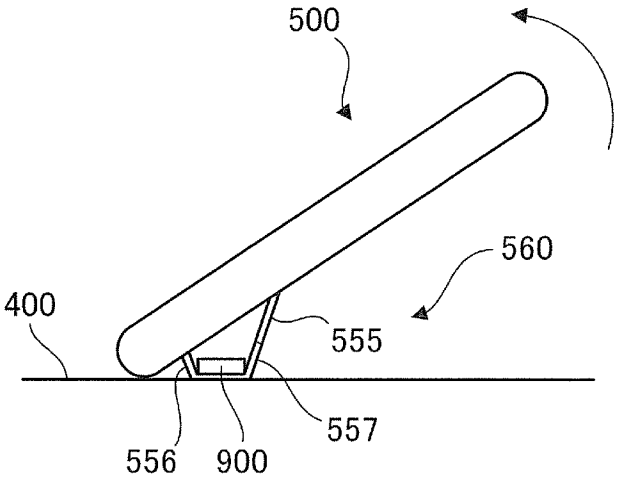
FIGS. 21A and 21B are views showing the state of the tab when the pull-up operation is performed.
Figure 21A:
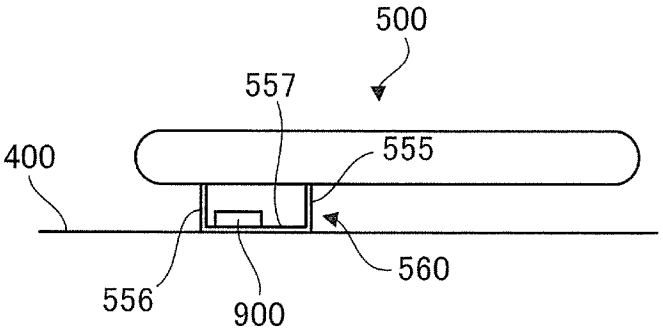

Here, in the case where the tab 500 is pulled up by a user, the tab 500 is displaced from the state shown in FIG. 21A (FIGS. 21A and 21B are views showing the state of the tab 500 when the pull-up operation is performed) to the state shown in FIG. 21B. More specifically, the front end side of the tab 500 moves downward while the rear end side of the tab 500 moves upward, and the front end side thereof comes in contact with the panel 400. By this contact of the front end side of the tab 500 to the panel 400, an opening portion is formed in the panel 400. Upon movement of the rear end side of the tab 500 upward, the aforementioned bending part formed by the first projecting piece 555 and the connecting piece 557 becomes straight. Namely, also in this case, the stretch part 560 stretches. By this stretch, the rotation moment acting on the tongue part increases, and the tongue part enters the inside of the drink can 100 similarly to the above.

Second Exemplary Embodiment

Hereinafter, a second exemplary embodiment according to the present invention will be explained in detail with reference to attached drawings.

The drink can 100 to which the exemplary embodiment is applied also has: the container body (can body) 200 which has the opening at the upper part and the bottom at the lower part and which is formed into a cylinder; and the can lid 300 which is attached to the opening of the container body 200 and seals the opening of the container body 200 as shown in FIG. 1A. Note that, the inside of the drink can 100 is filled with (contains) drink such as cold beverage, soda, alcohol or the like.

As explained above, the can lid 300 has the panel 400 which is formed into a disk and functions as a basal plate. Further, the can lid 300 has the tab 500 which is operated by a user. Here, the tab 500 is attached to the panel 400. The tab 500 is arranged along one direction from the central part side of the panel 400 toward the peripheral edge side of the panel 400. That is, the tab 500 is arranged along the first virtual line CL1. Further, the tab 500 is arranged along one direction from the peripheral edge side of the panel 400 toward the rivet 900. The tab 500 has one end portion and the other end portion, the one end portion is caused to press a predetermined part (which will be described below in detail) of the panel 400 due to the operation of the other end portion by a user, and thus the panel 400 is pressed. Note that, the can lid 300 in the exemplary embodiment is a so-called stay-on type can lid where the tab 500 is kept to be attached to the panel 400 even after an opening functioning as a tap is formed in the panel 400.

Similarly to the above, the tab 500 is secured to the panel 400 with the rivet 900 provided at the position displaced from the central part of the panel 400. That is, the tab 500 is secured to the panel 400 with the rivet 900 provided in an eccentric state with respect to the panel 400. As further explanation, the tab 500 is secured to the panel 400 with the rivet 900 provided in the central part side of the panel 400 relative to the section of the panel 400 which is pressed by the tab 500. Further, the tab 500 is secured to the panel 400 with the rivet 900 at the section located between one end portion (the front end 510) of the tab 500 and the other end portion.

Note that, in the exemplary embodiment, although the case in which the tab 500 is secured to the panel 400 with the rivet 900 provided at the position displaced from the central part of the panel 400 is explained as an example, the tab 500 can be secured to the panel 400 with the rivet 900 provided in the central part of the panel 400. Although FIG. 1A shows the case in which the tab 500 is formed into a rectangle, the tab 500 having the front end (tab nose) 510 formed into an arc (tab 500 having the rounded front end 510 by application of a curvature) as shown in FIG. 1B can be accepted.

With reference to FIG. 2, the state of the panel 400 before the tab 500 is attached thereto is explained.

The panel 400 is formed into a disk as mentioned above. The panel 400 has the outer peripheral edge 410 on which a bending process has been performed. In the exemplary embodiment, a so-called seam process is performed on the outer peripheral edge 410 and the upper edge part (not shown) of the container body 200 in the state where the outer peripheral edge 410 and the upper edge part are in contact with each other. Thereby, the panel 400 is secured to the upper edge part of the container body 200. In the panel 400, the protrusion (nipple) 420 which is flattened at securing the tab 500 to the panel 400 and becomes the aforementioned rivet 900 is formed. Here, the protrusion 420 is provided at a section displaced from the central part CP of the panel 400.

As mentioned above, the first score line 430 is formed on the surface of the panel 400. The first score line 430 is formed to surround the region RA (pressed section pressed by the tab 500) of the panel 400 which is pressed by the tab 500. That is, the first score line 430 is formed around the region RA. The first score line 430 is constituted by a groove formed on the surface of the panel 400, and has a function for guiding fracture of the panel 400 (mentioned below). That is, the first score line 430 can be taken as a fracture scheduled line where the fracture of the panel 400 is scheduled. The first score line 430 is formed to expand toward the outer peripheral edge (peripheral edge) 410 side of the panel 400, and is formed into an approximately U-shape when the panel 400 is viewed from the front side. Further, the first score line 430 has one end 431 and the other end 432 on the central part CP side of the panel 400, and a top part 433A on the outer peripheral edge (peripheral edge) 410 side of the panel 400.

As explained above, the one end 431 of the first score line 430 is arranged on one side with respect to the first virtual line CL1 connecting the central part CP of the panel 400 and the protrusion 420 formed in the panel 400. The other end 432 is provided on the side which is opposite to the side where the aforementioned one end 431 is provided with respect to the first virtual line CL1. By providing the one end 431 and the other end 432 to keep away from each other, the discontinuous section where the first score line 430 is not provided is provided between the one end 431 and the other end 432. By providing the discontinuous section, the tongue part which is formed by the fracture of the panel 400 occurring at the first score line 430 is not detached from the panel 400, and is kept to be attached to the panel 400. Note that, in the exemplary embodiment, the tab 500 is provided so that the center line of the tab 500 along the longitudinal direction is overlapped with the first virtual line CL1, as shown in FIGS. 1A to 2.

Here, the one end 431 of the first score line 430 is arranged on one region side out of two regions facing each other across the first virtual line CL1 (the center line of the tab 500 along the longitudinal direction, also with reference to FIG. 1A). That is, the one end 431 is arranged on the one region side out of the two regions facing each other across the first virtual line CL1 (the center line of the tab 500 and the center line along one direction from the outer peripheral edge 410 of the panel 400 toward the rivet 900). Meanwhile, the other end 432 is arranged on the other region side out of the two regions facing each other across the first virtual line CL1. In the exemplary embodiment, the first score line 430 is arranged to be symmetrical with respect to the first virtual line CL1 (center line of the tab 500 along the longitudinal direction) as a symmetrical axis.

As mentioned above, in the case where the second virtual line CL2 which is a virtual line orthogonal to the aforementioned first virtual line CL1 and passes through the protrusion 420 (rivet 900) is simulated, the aforementioned one end 431 and the other end 432 are provided on the central part (middle) CP side of the panel 400 relative to the second virtual line CL2. That is, in FIGS. 1A and 1B, the one end 431 and the other end 432 are provided above the rivet 900. The top part 433A is provided within one region out of two regions facing each other across the third virtual line CL3 which is a virtual line orthogonal to the aforementioned first virtual line CL1 and passes through the central part CP of the panel 400, and the one end 431 and the other end 432 are provided within the other region. Further, the protrusion 420 is provided within the one region. In the case where the protrusion 420 is provided within the one region as mentioned above, the operation load necessary at bending the tongue part decreases in comparison with the case where the protrusion 420 is provided at the central part CP of the panel 400.

As further explanation, the protrusion 420 which becomes the rivet 900 is provided at a section of the panel 400 which is surrounded by the first score line 430, and at a section located on the top part 433A side relative to the one end 431 and the other end 432 of the first score line 430. The first score line 430 has the curved part 433 as shown in FIG. 2. The curved part 433 is provided to expand toward the side where the protrusion 420 is provided while connecting the one end 431 and the other end 432, and to pass on the outer peripheral edge 410 side of the panel 400 relative to the protrusion 420.

As explained above, the curved part 433 has the top part 433A at a point where the curved part 433 intersects with the first virtual line CL1. Also in the can lid 300 according to the exemplary embodiment, the reinforcing bead HB for enhancing rigidity of the region surrounded by the first score line 430 is formed within the region of the panel 400 which is surrounded by the first score line 430. At one end of the reinforcing bead HB, the emboss EB which projects upward (toward the outside of the drink can 100) and is pressed by the front end of the tab 500 is provided. By providing the emboss EB, the fracture of the panel 400 is easy to occur at the second score line 450 (which will be mentioned below in detail) in comparison with the case where the emboss EB is not provided. Note that, although the second score line 450 is shown as a straight line in the exemplary embodiment, it is not limited to the straight line and a curved line or another line can be accepted.

Similarly to the first exemplary embodiment, in the exemplary embodiment, due to the operation of the tab 500 by the user, the region surrounded by the first score line 430 is pressed by the tab 500 and the fracture of the panel 400 occurs at the section where the first score line 430 has been formed (which will be mentioned below in detail). Thereby, the region where the first score line 430 has been formed becomes a tongue-shaped part, and the region folds toward the inside of the drink can 100. Thereby, the opening functioning as a tap is formed on the drink can 100. Note that, also in the exemplary embodiment, the aforementioned tongue-shaped part formed by the fracture occurring at the first score line 430 may be referred to as a tongue part in some cases. Also in the exemplary embodiment, the curved part 454 (a section where the fracture of the panel 400 firstly occurs) of the second score line 450 (which will be mentioned below in detail) is arranged to be close to the central part CP side of the panel 400. When drinking, a user needs to pull up the tab 500 for forming an opening on the can lid 300. Thus, the can body is held with one hand, and the tab 500 is pulled up by the other hand. At this time, since force is applied on the tab 500, the hand holding the can body becomes unstable, and thus the can body may be inclined in some cases. In general, contents inside the can are filled therein with a space in the can. In the case where the contents are liquid, when the can body is inclined to a certain extent, the liquid surface reaches the outer peripheral edge of the can lid. However, the liquid surface does not reach the middle of the can lid. Even if the can body is inclined until the liquid surface reaches the middle of the can lid, the depth from the liquid surface in the middle of the can lid is shallower than the depth of the liquid at the outer peripheral edge. Accordingly, the drink therein is difficult to be spilled in the case where the fracture firstly occurs on the central part CP side of the panel 400 in comparison with the case where the fracture firstly occurs on the peripheral edge 410 side of the panel 400.

Also in the exemplary embodiment, the second score line 450 is formed on the surface of the panel 400 and within the region surrounded by the first score line 430. Note that the second score line 450 is also constituted by a groove formed on the surface of the panel 400, and has a function for guiding the fracture of the panel 400. The second score line 450 is provided within a region where the top part 433A (the top part 433A of the first score line 430) is provided out of two regions which face each other across the second virtual line CL2.

The second score line 450 has one end 451 and the other end 452 similarly to the first exemplary embodiment. Here, the other end 452 of the second score line 450 is connected to the curved part 433 of the first score line 430. Accordingly, the score line branches at the section where the first score line 430 and the second score line 450 are connected in the exemplary embodiment. Note that, in the exemplary embodiment, three ends including the one end 431, the other end 432 and the one end 451 are provided in the score line.

As further explanation of the second score line 450, the other end 452 of the second score line 450 is connected to the section of the curved part 433 of the first score line 430 which is located between the first virtual line CL1 and the second virtual line CL2. More specifically, the other end 452 of the second score line 450 is connected to the section of the first score line 430 which is located between the top part 433A and the other end 432. The second score line 450 is provided to head toward the inside of the region surrounded by the first score line 430 from the connection portion with the first score line 430.

As further explanation, the connection portion between the first score line 430 and the second score line 450 is provided at a section except an intersection KP where the first virtual line CL1 (center line of the tab 500 along the longitudinal direction) and the first score line 430 intersect with each other. In the exemplary embodiment, the second score line 450 is provided to head toward the inside of the region surrounded by the first score line 430 from the connection portion with the first score line 430. In the exemplar embodiment, the connection portion between the first score line 430 and the second score line 450 is provided on the side where the aforementioned intersection KP is provided relative to the second virtual line CL2 arranged to be orthogonal to the first virtual line CL1. As further explanation, the connection portion between the first score line 430 and the second score line 450 is provided on the side where the region RA is located relative to the second virtual line CL2 arranged to be orthogonal to the first virtual line CL1.

In the exemplary embodiment, the distance between the connection portion connecting the first score line 430 and the second score line 450 and the one end 431 of the first score line 430 is longer than the distance between the connection portion and the other end 432 of the first score line 430. That is, the length of a section of the first score line 430 which is located between the one end 431 and the aforementioned connection portion is longer than the length of a section of the first score line 430 which is located between the other end 432 and the aforementioned connection portion. Note that, in the exemplary embodiment, although explanation has been given for the case in which the second score line 450 is provided to head to the lower right direction in the figure, the second score line 450 can be provided to head to the lower left direction in the figure. In this case, the second score line 450 is connected to a section of the first score line 430 which is located between the top part 433A and the one end 431.

On the other hand, the one end 451 of the second score line 450 is provided in the vicinity of the protrusion 420. As further explanation, the one end 451 of the second score line 450 is arranged on one region side out of two regions which face each other across the first virtual line CL1, and the other end 452 of the second score line 450 is arranged on the other region side out of these two regions. As further explanation, the second score line 450 has the straight line 453 extending from the other end 452 toward the protrusion 420. Further, the second score line 450 has the curved part 454 which has distance with the protrusion 420 formed into a cylinder while being connected to the straight line 453 and which is provided along the protrusion 420.

The curved part 454 is formed between the protrusion 420 and the first score line 430 similarly to the first exemplary embodiment. More specifically, it is formed between the top part 433A of the first score line 430 and the protrusion 420. That is, the curved part 454 of the second score line 450 is arranged between the protrusion 420 and the first score line 430 on the first virtual line CL1.

The curved part 454 is provided to pass between the region RA (pressed section by the tab 500) of the panel 400 which is pressed by the tab 500 and the protrusion 420. That is, in the exemplary embodiment, while being provided to pass the side where the protrusion 420 (rivet 900) is provided relative to the aforementioned region RA, the second score line 450 is provided to pass between the aforementioned region RA and the protrusion 420.

In the exemplary embodiment, the curved part 454 of the second score line 450 is provided to intersect with the aforementioned first virtual line CL1 (straight line passing through the region RA and the protrusion 420) passing through the region RA pressed by the tab 500 and the protrusion 420. As further explanation, after the second score line 450 in the exemplary embodiment passes between the region RA and the protrusion 420, the second score line 450 travels toward the direction which intersects with the first virtual line CL1, and is connected to the first score line 430. That is, the second score line 450 in the exemplary embodiment is formed along the direction which intersects with the arrangement direction of the first virtual line CL1. As further explanation, the second score line 450 is formed along the direction which intersects with the arrangement direction of the tab 500 (refer to FIGS. 1A and 1B).

As further explanation, the second score line 450 travelling toward the direction which intersects with the first virtual line CL1 travels to gradually come close to the side where the region RA is located out of sides including the side where the region RA is located and the side where the protrusion 420 is provided. More specifically, the second score line 450 travels toward the first score line 430 so that the straight line 453 of the second score line 450 gradually comes close to the side where the region RA is located.

As further explanation, after the second score line 450 passes between the region RA and the protrusion 420, the second score line 450 travels to gradually get away from the second virtual line CL2, and is connected to the first score line 430. Note that, the second score line 450 at this time passes by the region RA. That is, after the second score line 450 passes between the region RA and the protrusion 420, the second score line 450 travels to gradually get away from the second virtual line CL2 as a straight line orthogonal to the straight line passing through the top part 433A of the first score line 430 and the central part CP of the panel 400 and also as a straight line passing through the protrusion 420, and is connected to the first score line 430.

Here, the state of the panel 400 when the tab 500 is operated will be explained with reference to FIGS. 3A to 3F (views for illustrating the state of the panel 400). Note that, in FIGS. 3A to 3F, the state in which the panel 400 is viewed from the front side and the state in which the panel 400 is viewed from the side are illustrated.

Also in the exemplary embodiment, when the rear end of the tab 500 is pulled up by a user, the front end (tab nose) 510 (refer to FIGS. 1A and 1B) of the tab 500 presses the aforementioned region RA (refer to FIG. 2) located between the curved part 454 of the second score line 450 and the top part 433A of the first score line 430. Upon pressing the region RA with the tab 500, firstly, the panel 400 fractures at the curved part 454 of the second score line 450 which is provided to pass between the region RA and the rivet 900 (protrusion 420) (refer to FIG. 3B). Note that, in the exemplary embodiment, the fracture is designed to occur at the curved part 454 when the tab 500 and the panel 400 make an angle of approximately 15°. Then, the fracture of the panel 400 progresses along the second score line 450, which leads to the state in which the fracture of the panel 400 reaches the connection between the first score line 430 and the second score line 450.

Here, in the exemplary embodiment, the score line branches at the aforementioned connection portion between the first score line 430 and the second score line 450. Therefore, after the fracture of the panel 400 progresses from the curved part 454 of the second score line 450 to the aforementioned connection portion, the fracture progresses from the connection portion to the one end 431 of the first score line 430 via the top part 433A as shown in FIG. 3C in the exemplary embodiment. In addition, the fracture also progresses from the connection portion toward the other end 432 of the first score line 430 as shown in FIG. 3D. Note that, in the exemplary embodiment, the aforementioned fracture from the connection portion toward the one end 431 is designed to occur when the tab 500 and the panel 400 make an angle of approximately 50°. Meanwhile, the aforementioned fracture from the connection portion toward the other end 432 is designed to occur when the tab 500 and the panel 400 make an angle of approximately 60°.

Then, due to further pulling-up of the rear end of the tab 500 by a user, the fracture of the panel 400 further progresses to the one end 431 and the other end 432 of the first score line 430. Thereby, the region surrounded by the first score line 430 becomes the aforementioned tongue part. The tongue part is folded at the base of the tongue part (the section located between the one end 431 and the other end 432 of the first score line 430), and the tongue part enters the inside of the drink can 100 as shown in FIG. 3E. Thereby, the opening functioning as a tap is formed on the drink can 100. Note that, although the detailed description will be given below, when the tab 500 which has been pulled up is returned to the original state, the tab 500 folds as shown in FIG. 3F.

Note that, also in the exemplary embodiment, as shown in FIG. 2, the groove 600 is provided in the region located between the one end 431 and the other end 432 of the first score line 430. The groove 600 is provided to head toward the side where the other end 432 is provided from the side where the one end 431 of the first score line 430 is provided, while being formed to curve and make an arc. That is, it is provided along the second virtual line CL2 (the third virtual line CL3). Accordingly, also in the drink can 100 according to the exemplary embodiment, fold of the tongue part is easy to occur. Also in the exemplary embodiment, since the groove 600 is formed to have a curve, the tongue part that has bent is difficult to return to the original state. Note that, the groove 600 is not essential, and therefore the groove 600 can be omitted.

Here, further explanation will be given for the fracture of the panel 400 occurring at the first score line 430 and the second score line 450 with reference to FIG. 22 (a view for illustrating the fracture occurring at the panel 400). In the exemplary embodiment, as mentioned above, due to pulling-up of the rear end of the tab 500 by a user, the aforementioned region RA (refer to FIG. 2) located between the curved part 454 of the second score line 450 and the top part 433A of the first score line 430 is pressed by the tab 500. That is, the region located on the top part 433A side of the first score line 430 relative to the second score line 450 (an example of a first region) within the region surrounded by the first score line 430 is pressed by the tab 500. Thereby, the panel 400 firstly fractures at the curved part 454 of the second score line 450. Then, the fracture of the panel 400 progresses along the second score line 450, and the fracture progresses to the connection portion (intersection) between the first score line 430 and the second score line 450.

Figure 22:
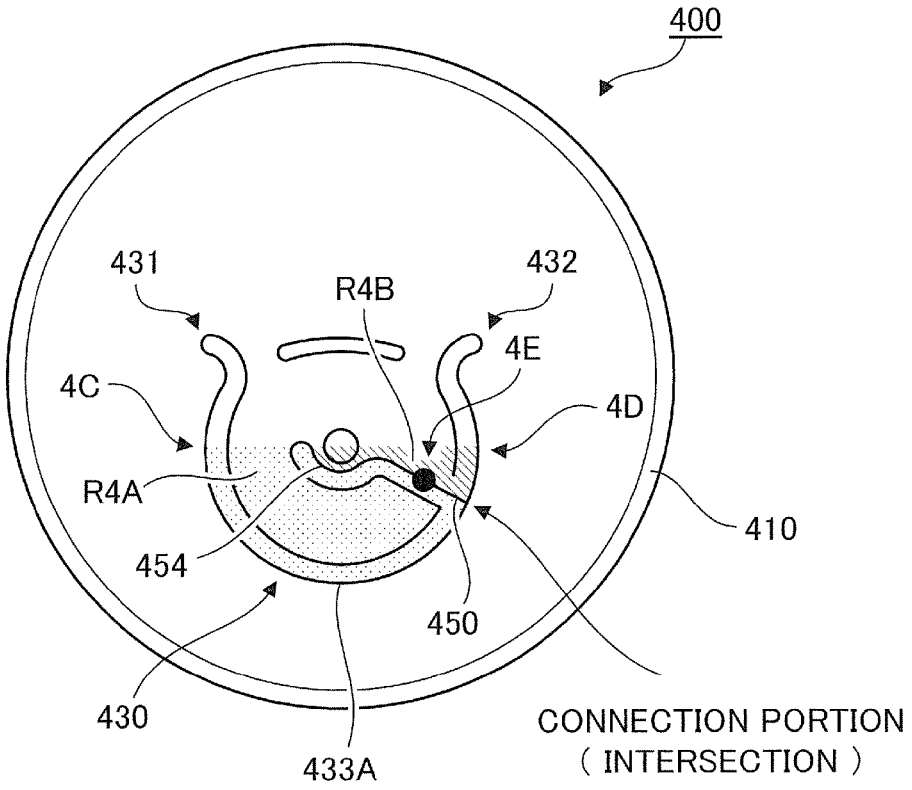
FIG. 22 is a view for illustrating the fracture occurring at the panel.

Thereafter, due to further application of the pressure on the region RA (refer to FIG. 2) of the panel 400 by the front end 510 of the tab 500, the fracture of the panel 400 progresses along the first score line 430, which leads to the fracture of the panel 400 to the section shown with a reference numeral 4C in FIG. 22. That is, the fracture of the panel 400 is caused to reach the vicinity of the section where the second virtual line CL2 (refer to FIG. 2) passing through the protrusion 420 and the first score line 430 intersect with each other. Thereby, an opening is formed at a region R4A in FIG. 22. That is, by the fracture of the panel 400 at the second score line 450 and the fracture of the panel 400 at the section located on the one end 431 side relative to the aforementioned connection portion of the first score line 430, a small opening (hereinafter, referred to as "a small opening") is formed at a part of the panel 400.

Subsequently, in the exemplary embodiment, due to further pulling-up of the rear end of the tab 500 by a user, the front end 510 of the tab 500 starts to enter the inside of the drink can 100 through the aforementioned small opening portion. At this time, the tab 500 starts to press the section shown with a reference numeral 4E in FIG. 22. That is, the edge of the small opening portion is started to be pressed. As further explanation, a region R4B (an example of a second region) of the panel 400 which is located above the section where the second score line 450 existed is started to be pressed. As further explanation, the region located between the section of the first score line 430 which is located on the other end 432 side relative to the aforementioned connection portion and the second score line 450 is started to be pressed by the tab 500.

Thereby, in the exemplary embodiment, the fracture of the panel 400 progresses along the first score line 430, and the panel 400 fractures to the section shown with a reference numeral 4D. That is, the fracture of the panel 400 is caused to reach the vicinity of the section where the second virtual line CL2 (refer to FIG. 2) passing through the protrusion 420 and the first score line 430 intersect with each other. As further explanation, the fracture of the panel 400 occurs at the section of the first score line 430 which is located on the other end 432 side relative to the aforementioned connection portion, and the panel 400 fractures to the section shown with the reference numeral 4D. Note that, until the fracture of the panel 400 progresses to the section shown with the reference numeral 4D after a user starts to operate the tab 500, the stretch part 560 which will be mentioned below is in the process of stretching.

Thereafter, in the exemplary embodiment, due to further pulling-up of the rear end of the tab 500 by a user, the aforementioned stretch part is completely stretched (reaches the limit of the stretch), a rotation moment starts to act on the aforementioned tongue part (which will be described below in detail), and the fracture of the panel 400 further occurs at the first score line 430. Specifically, the fracture of the panel 400 occurs at both sections which are a first section located between the section of the first score line 430 which is shown with the aforementioned reference numeral 4C and the one end 431 and a second section located between the section which is shown with the aforementioned reference numeral 4D of the first score line 430 and the other end 432. Then, the tongue part is folded at the base of the tongue part (section located between the one end 431 and the other end 432 of the first score line 430) as mentioned above, and the tongue part enters the inside of the drink can 100 as shown in FIG. 3E. Thereby, the opening is formed on the drink can 100.

Note that, in the exemplary embodiment, the first score line 430 is arranged to have a symmetrical relation with respect to the first virtual line CL 1 as a center line. Accordingly, the fracture of the panel 400 from the section shown with the reference numeral 4C toward the one end 431 and the fracture of the panel 400 from the section shown with the reference numeral 4D toward the other end 432 occur at approximately the same time. That is, the fracture of the panel 400 from the section shown with the reference numeral 4C to the one end 431 and the fracture of the panel 400 from the section shown with the reference numeral 4D to the other end 432 simultaneously progress.

Here, in the exemplary embodiment, as mentioned above, the fracture of the panel 400 firstly occurs at the second score line 450. Next, in the exemplary embodiment, the fracture of the panel 400 occurs at the section of the first score line 430 which is located between the aforementioned connection portion and the section shown with the reference numeral 4C. Then, the fracture of the panel 400 occurs at the section of the first score line 430 which is located between the aforementioned connection portion and the section shown with the reference numeral 4D. That is, in the exemplary embodiment, the fracture of the panel 400 from the aforementioned connection portion toward the one end 431 of the first score line 430 and the fracture of the panel 400 from the aforementioned connection portion toward the other end 432 of the first score line 430 do not occur at the same time, and the fractures of the panel occur at different times. Accordingly, in the exemplary embodiment, the operation load of the tab 500 when the tab 500 is pulled up and the opening is formed in the panel 400 decreases.

As further explanation, in the exemplary embodiment, when the user operates the tab 500 and the front end 510 of the tab 500 presses the panel 400, the front end 510 presses the section located below the second score line 450 (section located on the top part 433A side relative to the second score line 450), and does not press the section located above the second score line 450. That is, in the exemplary embodiment, both of the section located below the second score line 450 and the section located above the second score line 450 are not configured to be pressed by the tab 500 at the same time, and only the section located below the second score line 450 is configured to be pressed by the tab 500 since only this section comes in contact with the tab 500. As further explanation, in the exemplary embodiment, contact between the aforementioned region R4B and the tab 500 occurs after the aforementioned small opening is formed in the panel 400.

Accordingly, in the exemplary embodiment, the fracture of the panel 400 from the aforementioned connection portion toward the one end 431 of the first score line 430 and the fracture of the panel 400 from the aforementioned connection toward the other end 432 of the first score line 430 do not occur at the same time, and the fractures of the panel 400 occur at different times. Thereby, the operation load of the tab 500 at pulling up the tab 500 decreases in comparison with the case where the fractures of the panel 400 occur at the same time.

Note that, in the exemplary embodiment, the fracture of the panel 400 from the section shown with the reference numeral 4C toward the one end 431 and the fracture of the panel 400 from the section shown with the reference numeral 4D toward the other end 432 occur at approximately the same time. By the way, when the fractures occur, the angle of the tab 500 with respect to the panel 400 is large. Accordingly, in this case, the operation load of the tab 500 little increases, and decrease in the operability of the tab 500 is suppressed.

As further explanation, in the exemplary embodiment, the fracture of the panel 400 from the section shown with the reference numeral 4C toward the one end 431 and the fracture of the panel 400 from the section shown with the reference numeral 4D toward the other end 432 occur at approximately the same time. However, the fractures in this case are different in process from the former fracture. That is, as for the fractures at the reference numerals 4C and 4D, due to application of pressure on the panel 400 into the can by the front end of the tab 500, the fracture is caused to progress at the score having a certain distance from the front end of the tab 500 as a point of application. However, after the fractures at the reference numerals 4C and 4D, the fracture is caused to progress toward the one end 431 and the other end 432 by the moment (which will be mentioned below in detail) pressing the rivet 900 to the inside of the can, which is generated by the stretch part 560 provided in the tab 500. In other words, the fracture is caused to progress with the rivet 900 as a point of application and the region between the one end 431 and the other end 432 as a bending part. Further, since the fractures at the reference numerals 4C and 4D have already occurred, the rivet 900 can be interpreted as a front end of the region where the fracture is planned to occur. That is, since the fracture is caused by applying a load at the front end of the region where the fracture is planned to occur, the fracture can progress easier than before. Accordingly, in this case, the operation load of the tab 500 little increases, and decrease in the operability of the tab 500 is suppressed.

In the exemplary embodiment, the connection portion between the first score line 430 and the second score line 450 is not located on the first virtual line CL1 (the center line of the tab 500 along the longitudinal direction), and the connection portion between the first score line 430 and the second score line 450 is located at a position displaced from the first virtual line CL1. Accordingly, the fracture of the panel 400 from the connection portion toward the one end 431 and the fracture of the panel 400 from the connection portion toward the other end 432 do not occur at the same time, and the fractures of the panel 400 occur in different times. Specifically, the fracture from the connection portion toward the one end 431 firstly occurs, and then the fracture from the connection portion to the other end 432 occurs. Accordingly, in the exemplary embodiment, the operation load of the tab 500 at forming the opening in the panel 400 decreases in comparison with the case where the fracture of the panel 400 toward the one end 431 and the fracture of the panel 400 toward the other end 432 occur at the same time.

As mentioned above, in the exemplary embodiment, when the tab 500 is operated by a user and the front end 510 of the tab 500 presses the panel 400, the front end 510 presses the section located below the second score line 450 (the section located on the top part 433A side relative to the second score line 450) and does not press the section located above the second score line 450. That is, in the exemplary embodiment, both of the section located below the second score line 450 and the section located above the second score line 450 are not configured to be pressed by the tab 500 at the same time, only the section located below the second score line 450 is configured to come in contact with the tab 500 and to be pressed by the tab 500. As further explanation, in the exemplary embodiment, the contact between the aforementioned region R4B and the tab 500 is designed to occur after the aforementioned small opening is formed in the panel 400.

Accordingly, in the exemplary embodiment, the fracture of the panel 400 from the aforementioned connection portion toward the one end 431 of the first score line 430 and the fracture of the panel 400 from the aforementioned connection toward the other end 432 of the first score line 430 do not occur at the same time, and the fractures of the panel 400 occur in different times. Thereby, the operation load of the tab 500 at pulling up the tab 500 decreases in comparison with the case where the fractures of the panel 400 occur at the same time.

Figure 25:
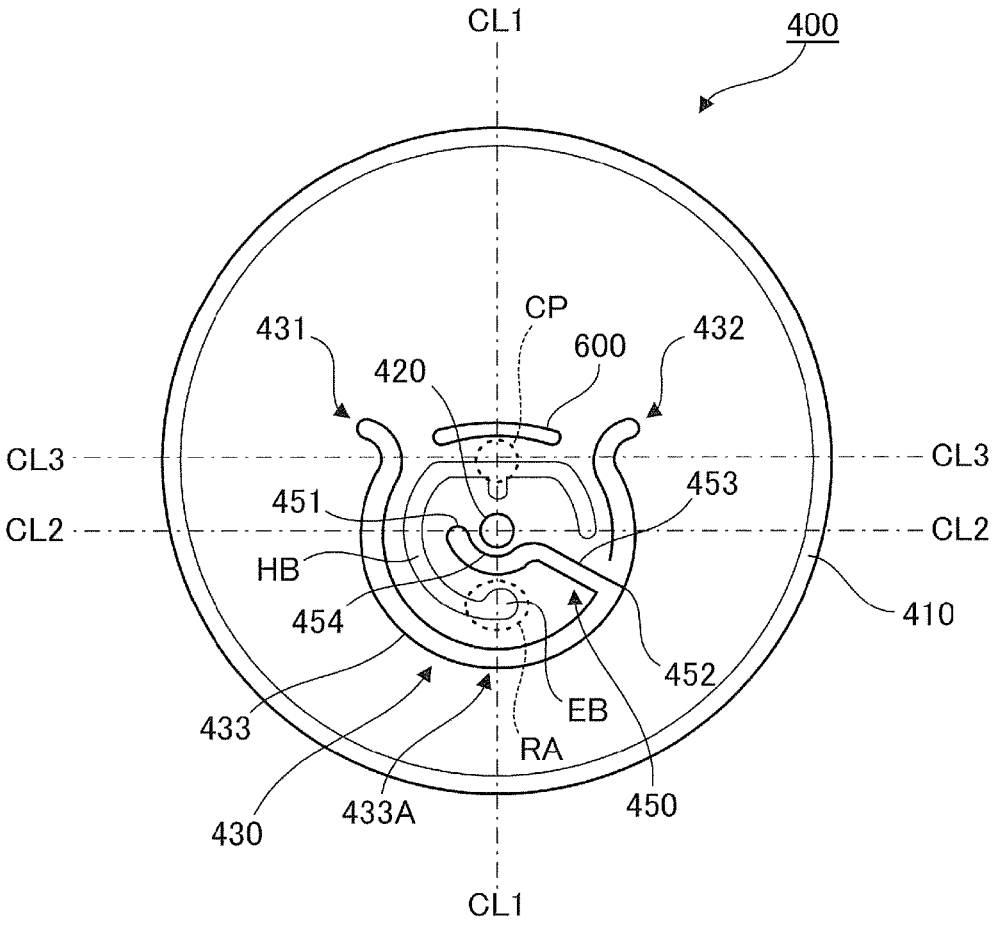
FIG. 25 is another example of a front view showing the state of the panel before the tab is attached.

Here, FIG. 25 is another example of a front view showing the state of the panel 400 before the tab 500 is attached. FIG. 25 shows the panel 400 adopted in the case where the tab 500 having the front end (tab nose) 510 formed into an arc is used. Here, in the case where the tab 500 having the front end (tab nose) 510 formed into an arc is used, the region RA pressed by the tab 500 decreases as shown in FIG. 25.

Figure 26:
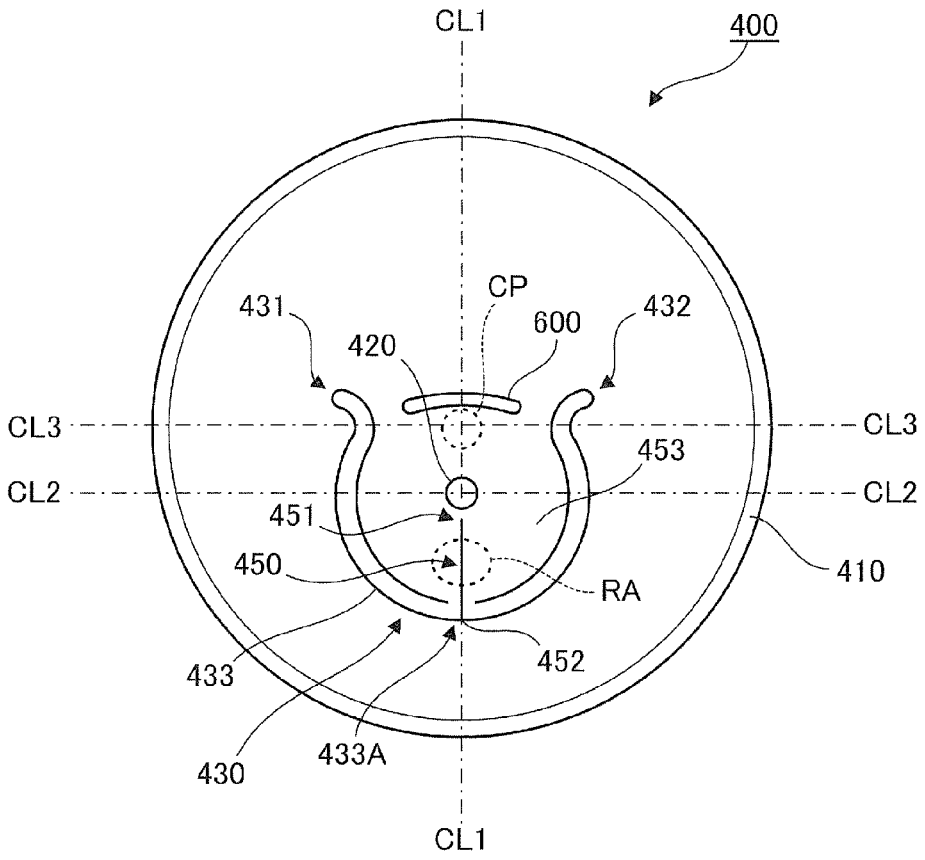
FIG. 26 is a view showing a comparative example of the panel.

Note that, the panel 400 can be configured as shown in FIG. 26.

FIG. 26 is a view showing a comparative example of the panel 400.

As shown in FIG. 26, in the panel 400 according to the comparative example, the other end 452 of the second score line 450 is connected to the top part 433A of the first score line 430. The second score line 450 is formed to head toward the protrusion 420 from the top part 433A of the first score line 430. That is, the second score line 450 is provided to be overlapped with the first virtual line CL1. As further explanation, the second score line 450 is formed in the state of extending along the arrangement direction of the tab 500 instead of the direction intersecting with the arrangement direction of the tab 500.

By the way, although the region RA is to be pressed by the tab 500 also in the panel 400, since the second score line 450 is provided from the region RA toward the protrusion 420 (rivet 900) in the comparative example, the pressing load when the tab 500 presses the panel 400 is easy to act on all of the second score line 450. In this case, the fracture of the panel 400 is difficult to occur in comparison with the case where the pressing load concentrically acts on a certain point, and thus the operation load of the tab 500 necessary to cause the fracture is easy to increase.

On the other hand, in the configuration according to the exemplary embodiment, as mentioned above, the second score line 450 is provided to intersect with the arrangement direction of the first virtual line CL1. That is, the second score line 450 is formed to head to the direction intersecting with the arrangement direction of the tab 500. As a result, in the exemplary embodiment, as shown in FIG. 25, while the one end 451 side of the second score line 450 is arranged in the vicinity of the region RA, the other end 452 side is located at a section away from the region RA. Accordingly, in the exemplary embodiment, the load is easy to concentrically act on the one end 451 side of the second score line 450, and the operation load of the tab 500 necessary to cause the fracture of the panel 400 decreases in comparison with the case in the aforementioned comparative example.

In addition, in the comparative example shown in FIG. 26, as for the fractures of the score lines, while the fracture of the first score line 430 toward the one end 431 is caused to progress, the fracture of the first score line 430 toward the other end 432 is caused to progress, after the fracture reaches the other end 452. In other words, the fractures of the first score line 430 progress at 2 sections at the same time. That is, the double load is necessary in comparison with the case where the fracture of the first score line 430 is caused to progress at 1 section. In this case, the fracture of the panel 400 is difficult to occur and the operation load of the tab 500 necessary to cause the fracture is easy to increase in comparison with the case where the fracture is caused to progress at 1 section.

Note that, although the explanation has been omitted above, also in the exemplary embodiment, the second score line 450 is provided to pass through the section displaced from the region RA (section except the region RA) as shown in FIG. 25. More specifically, the second score line 450 is provided to pass between the region RA and the protrusion 420 (rivet 900). In this case, shear force starts to act on the second score line 450, and the fracture of the panel 400 is easy to occur. Note that, the configuration is not limited to the above, and the second score line 450 can be provided to pass through the inside of the region RA. In this case, the second score line 450 is directly pressed by the tab 500 and the panel 400 bends, and thereby the fracture of the panel 400 occurs.

Figure 23:
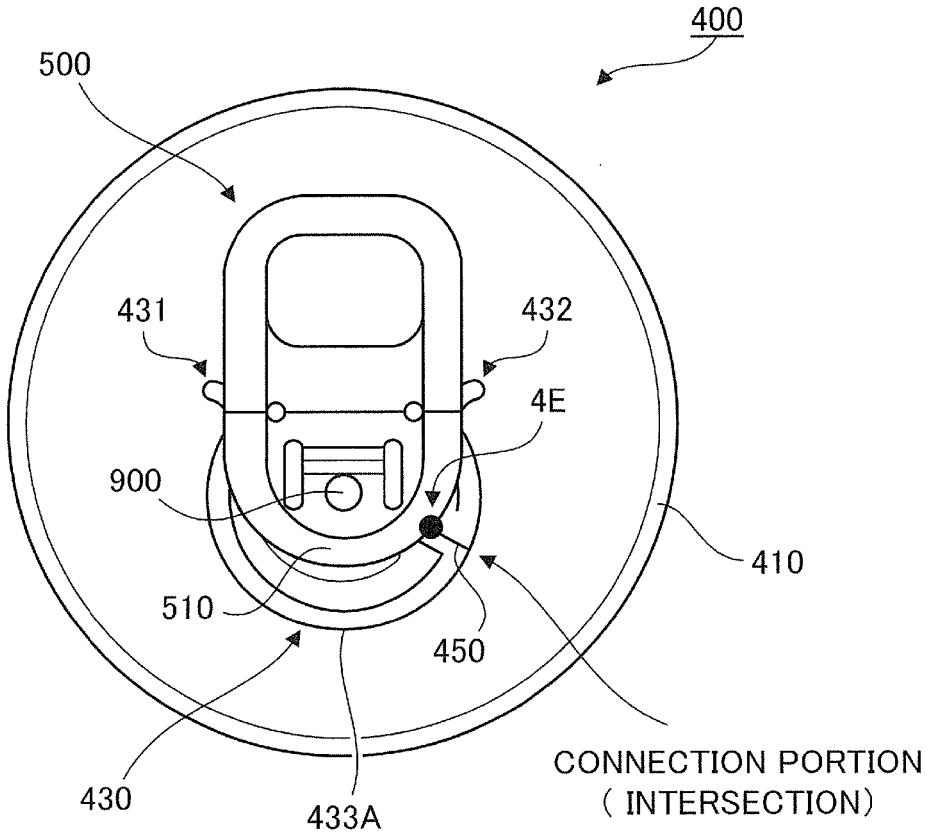
FIG. 23 is a view showing the state of the panel where the tab is attached.

FIG. 23 is a view showing the state of the panel 400 where the tab 500 is attached. Note that, FIG. 23 shows the state in which the tab 500 shown in FIG. 1B is attached thereto. As shown in FIG. 23, in the exemplary embodiment, the distance between the section shown with a reference numeral 4E (the section pressed by the tab 500 when the section located above the second score line 450 is fractured) and the aforementioned connection portion becomes small. That is, the distance between a load application point where the load from the tab 500 acts and the aforementioned connection becomes small. Accordingly, in the exemplary embodiment, the fracture of the panel 400 from the connection portion toward the upper part (the other end 432) is easy to occur in comparison with the case where the distance between the section shown with the reference numeral 4E and the aforementioned connection is large. In this case, the operation load of the tab 500 becomes small.

Note that, although the explanation has already been given above, in the exemplary embodiment, as shown in FIG. 2, the groove 600 is provided in the region located between the one end 431 and the other end 432 of the first score line 430. The groove 600 is provided to head to the side where the other end 432 is provided from the side where the one end 431 of the first score line 430 is provided, while being formed to curve and to make an arc. That is, it is provided along the second virtual line CL2 (the third virtual line CL3). Accordingly, in the drink can 100 according to the exemplary embodiment, the fold of the tongue part is easy to occur. In the exemplary embodiment, since the groove 600 is formed to have a curve, the tongue part that has bent is difficult to return to the original state. Note that, the groove 600 is not essential, and therefore the groove 600 can be omitted.

Figure 24:
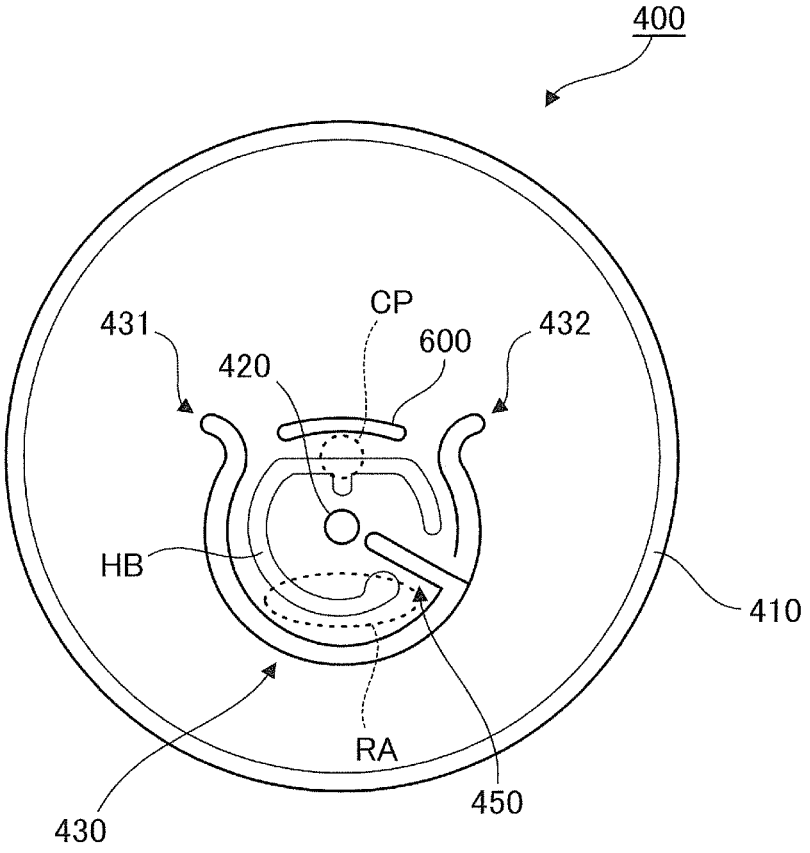
FIG. 24 is a view showing another configuration example of the panel.
Figure 27:
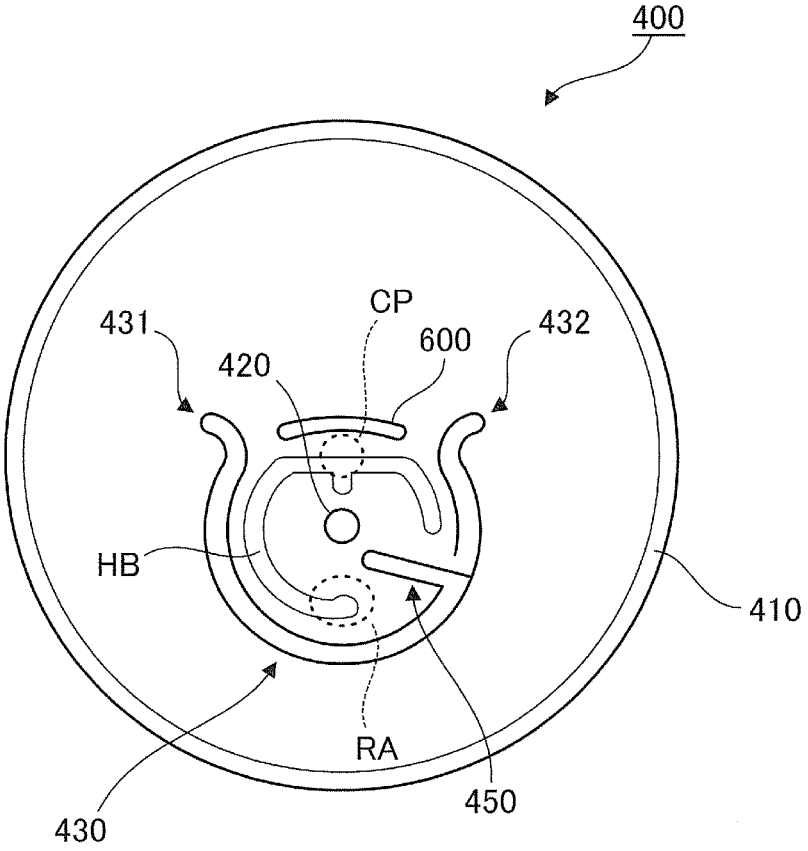
FIG. 27 is a view showing another configuration example of the panel.

Although an example has been given for the case where the second score line 450 is provided to pass between the region RA of the panel 400 which is pressed by the tab 500 and the protrusion 420 in the above, the configuration of arranging the second score line 450 is not limited to the above. For example, as shown in FIG. 24 (a view showing another configuration example of the panel 400) and FIG. 27 (a view showing another configuration example of the panel 400), the second score line 450 which does not pass between the region RA and the protrusion 420 can be provided. Further, although the second score line 450 is shown as an approximately straight line in the above, it is not limited to the straight line, and a curve or another line can be accepted.

Next, explanation will be given for the tab 500 with reference to FIGS. 4A to 6B again.

FIGS. 4A to 5B are views for illustrating the tab 500. FIGS. 6A and 6B are views showing the state in which the tab 500 is operated by a user and the opening is formed in the panel 400. Note that, FIG. 4A is a front view of the tab 500, FIG. 4B is a view when the tab 500 is viewed from an arrow IVB direction in FIG. 4A. FIG. 4C is a back-side view of the tab 500. That is, it is the view when the tab 500 is viewed from the facing surface side facing the panel 400. FIG. 4D is a view when the tab 500 is viewed from an arrow IVD direction in FIG. 4A. FIG. 5A is a view for illustrating the stretch part (which will be mentioned below) provided in the tab 500, and FIG. 5B is the view showing the state in which the tab 500 is pulled up.

Similarly to the first exemplary embodiment, the tab 500 in the exemplary embodiment has the tab body 520 which is formed into a sheet and a rectangle, as shown in FIG. 4A. Note that, also in the exemplary embodiment, as shown in FIG. 4D, a bending process (curling process) is performed on the outer peripheral edge of the tab body 520, and thus the outer peripheral edge of the tab body 520 is curled inward. That is, at the edge provided in four directions of the tab body 520, the curl part is formed. Thereby, bending rigidity is enhanced in the tab 500 in the exemplary embodiment. Further, in the tab 500, the penetration hole (finger hole) 530 where a user's finger can be inserted is formed on the side opposite to the side where the front end 510 for pressing the panel 400 is provided (tab tail side).

In the tab 500, the insert hole 540 into which the protrusion 420 (refer to FIG. 2) provided in the panel 400 is inserted is formed on the front end 510 side of the tab 500. Further, the long hole 550 extending along the longitudinal direction of the tab 500 is formed on the front end 510 side of the tab 500. Here, the two long holes 550 are provided in the width direction of the tab 500 (the direction orthogonal to the longitudinal direction) in the state of being arranged side by side. Note that, in the exemplary embodiment, the insert hole 540 is provided between the two long holes 550. In the region located on the rear end side of the tab 500 relative to the insert hole 540 and between the aforementioned two long holes 550, the stretch part 560 is formed. Note that, the section where the stretch part 560 is provided can be taken as a transmission portion which is provided between the rear end side of the tab 500 and the rivet 900 (refer to FIGS. 1A and 1B), connects the tab 500 and the rivet 900, and transmits the load from the tab 500 to the rivet 900.

Here, similarly to the first exemplary embodiment, as shown in FIG. 5A, in the stretch part 560, a bending process is performed on the aforementioned tab body 520 (refer to FIG. 4A) formed into a sheet, and the first piece 561 and the second piece 562 which intersect with each other are provided in the stretch part 560. That is, the bending part where the sheet constituting the tab body 520 bends is formed in the stretch part 560. Here, the first piece 561 is arranged to get away from the panel 400 as it heads to the rear end of the tab 500. Meanwhile, the second piece 562 has a front end connected to the first piece 561, and is arranged to come close to the panel 400 as it heads to the rear end of the tab 500.

Further explanation will be given for the tab 500 with reference to FIG. 4A. The first slit 521 is formed in the curl part provided along the longitudinal direction of the tab 500 out of the 4 curl parts provided in the four directions of the tab body 520. The second slit 522 is formed in another curl part provided along the longitudinal direction of the tab 500 out of the 4 curl parts. Further, the groove 523 is formed at the section located between the first slit 521 and the second slit 522 in the tab body 520.

Here, similarly to the first exemplary embodiment, the first slit 521, the second slit 522 and the groove 523 are provided in the state of being connected to each other and being continuous. The first slit 521, the second slit 522 and the groove 523 are provided along the width direction of the tab 500. The first slit 521, the second slit 522 and the groove 523 are arranged between the insert hole 540 and the penetration hole 530. Here, in the exemplary embodiment, the first slit 521, the second slit 522 and the groove 523 are formed as mentioned above, and rigidity (bending rigidity) at the section where they are formed decreases.

Thus, as shown in FIG. 4B, upon applying a load to the rear end side of the tab 500, the tab 500 starts to fold. That is, the tab 500 starts to bend. Note that, in the exemplary embodiment, although the rigidity at the section is decreased by forming the groove 523 between the first slit 521 and the second slit 522, it is not limited to such a groove, and, for example, the rigidity can be decreased by performing a bending process. The groove 523 is not essential, and thus the groove 523 can be omitted.

Next, explanation will be given for the state of each part when the tab 500 is operated.

When the tab 500 is operated by a user, the user's finger is inserted between the rear end of the tab 500 and the panel 400, and the tab 500 is pulled up as shown in FIG. 5B. Here, at this time, the stretch part 560 formed of the first piece 561 and the second piece 562 firstly stretches. That is, the stretch part 560 that has been in the folding state by the first piece 561 and the second piece 562 is straightened, and thus the stretch part 560 stretches. Upon complete stretch of the stretch part 560, the load is transmitted to the rivet 900 from the stretch part 560, and the force for pulling the rivet 900 upward acts on the rivet 900.

On the other hand, since the front end 510 of the tab 500 is in contact with the panel 400, the force for pressing the panel 400 downward acts on the panel 400. Thereby, the fracture of the panel 400 occurs at the curved part 454 (refer to FIG. 2) of the second score line 450 which is located between the front end 510 of the tab 500 and the rivet 900. Then, as explained above, the fracture progresses along the second score line 450, and subsequently, the fracture progresses along the first score line 430. Thereby, the tongue part is formed at the region surrounded by the first score line 430. Also, the opening is formed at the region surrounded by the first score line 430.

As mentioned above, upon transmitting the load to the rivet 900 from the stretch part 560 after the stretch of the stretch part 560, a rotation moment as shown by an arrow 4A in FIG. 5B acts on the tongue part. Thereby, the tongue part rotates around the base of the tongue part as a center, and the tongue part folds at the base. By this fold, the tongue part enters the inside of the drink can 100. Further, by the entry of the tongue part to the inside of the drink can 100, the front end side of the tab 500 enters the inside of the drink can 100 as shown in FIG. 6A.

Note that, FIG. 6A shows the state in which the tab 500 stands up and the panel 400 and the tab 500 are perpendicular to each other. Then, the pulled-up tab 500 is to be returned to the original state by a user, and at this time, the fold of the tab 500 occurs at the first slit 521, the second slit 522 and the groove 523, as explained above. As a result, as shown in FIG. 6B, the rear end side of the tab 500 is put along the panel 400. On the other hand, the front end side of the tab 500 is put into the state of entering the inside of the drink can 100.

Here, in the case where the diameter of the drink can 100 is desired to be smaller (the panel 400 is desired to be smaller), the region (the region which becomes the opening, the region which becomes the tongue part) surrounded by the first score line 430 and the tab 500 are necessary to be closely arranged. In this case, an area where the region surrounded by the first score line 430 and the tab 500 are overlapped increases. Also, in the case where the opening (tap) is made bigger, the area where the region surrounded by the first score line 430 and the tab 500 are overlapped increases. However, in this case, since a part of the tab 500 which has been overlapped with the first score line 430 blocks a part of the opening, the drink contained therein may be difficult to flow out or a similar situation may arise, and a user is difficult to drink. Accordingly, as mentioned above, in the exemplary embodiment, the configuration in which the section of the tab 500 overlapped with the tap (section overlapped with the tongue part) is kept to enter the inside of the drink can 100 when a user drinks after the opening is adopted. In this case, since the area of the opening increases, a user is easy to drink in comparison with a configuration in which the front end side of the tab 500 does not enter the inside of the drink can 100.

Note that, although the explanation has been given in the first exemplary embodiment, as shown in FIG. 7 (a view showing another configuration example of the can lid 300), the tab 500 in which the slit 700 is provided around the section secured by the rivet 900 is often used. However, in the case where such a tab 500 is attached to the panel 400 shown in FIG. 2, the force for pulling the rivet 900 upward (pulling force) (refer to a reference numeral 4B in FIG. 5B) does not work on the rivet 900 since the slit 700 is provided, and the rotation moment shown by the arrow 4A in FIG. 5B is not applied thereto. In this case, the fold of the tongue part at the base of the tongue part is difficult to occur. That is, although the fold of the tongue part occurs at the section where the rivet 900 is provided, the fold of the tongue part is difficult to occur at the base of the tongue part. In this case, the opening formed in the panel 400 becomes small.

To avoid this, also in the exemplary embodiment, the section of the tab 500 which is located at the rear side of the rivet 900 and the rivet 900 are configured to be connected to each other by the stretch part 560. By this configuration, the force for pulling the rivet 900 upward increases, and the rotation moment acting on the tongue part increases. Thereby, bend of the tongue part occurs at the base of the tongue part, and all of the tongue part enters the inside of the drink can 100.

Note that, even though the stretch part 560 is not provided, the aforementioned rotation moment can be increased. For example, if the section of the tab 500 which is located behind the rivet 900 and the rivet 900 are simply connected to each other without the aforementioned stretch part 560, the rotation moment increases. However, in this case, the operability at pulling up the tab 500 is caused to decrease.

More specifically, in general, the tab 500 is pulled up upon inserting a finger between the tab 500 and the panel 400 for pulling up the tab 500. However, as mentioned above, in the case where the section located behind the rivet 900 and the rivet 900 are connected to each other, displacement of the tab 500 (displacement of the rear end of the tab 500 to the upside) is restricted by the rivet 900, and thus the displacement of the tab 500 is difficult to occur. In this case, a user's finger is difficult to be inserted between the panel 400 and the tab 500, and thus the operability at pulling up the tab 500 decreases.

Although, by pulling up the tab 500, the front end side of the tab 500 presses the panel 400 and hole making starts, in this case, the hole making and the aforementioned rotation moment simultaneously start. Specifically, when the rear side of the tab 500 is pulled upward, since the aforementioned stretch part 560 is not provided, while at the same time the panel 400 is started to be pressed by the front end side of the tab 500 due to pulling up the tab 500, the aforementioned rotation moment to the section which will become the aforementioned tongue part starts. However, the aforementioned rotation moment is to work for bending and entering, into the can, the aforementioned tongue part formed as a result of making the opening which is caused by applying the pressure of the front end side of the tab 500 on the panel 400, after the making of the opening of the panel 400 progresses. Thus start of the aforementioned rotation moment at the timing when the aforementioned tongue part is not formed may not be efficient operation of the tab 500, and the operability at pulling up the tab 500 decreases.

To avoid this, in the exemplary embodiment, the configuration in which the stretch part 560 is provided is adopted. In the case where the stretch part 560 is provided as mentioned above, since the stretch part 560 stretches until the tab 500 has a predetermined angle (for example, 60°), the displacement of the tab 500 is difficult to be restricted by the rivet 900 until the tab 500 has the predetermined angle. If the restriction is difficult as mentioned above, a finger is easy to be inserted between the tab 500 and the panel 400. As a result, in the configuration of the exemplary embodiment, decrease in the operability at pulling up the tab 500 is suppressed.

Note that, although the shape of the groove 600 shown in FIG. 2 is not particularly limited, the groove 600 can be formed into the shape shown in FIGS. 13A to 13D similarly to the first exemplary embodiment. For example, the groove 600 can be formed by a shape having: the first side 621 and the second side 622 which are approximately perpendicular to the surface of the panel 400; and the flat base 623 connecting the first side 621 and the second side 622 as shown in FIG. 13A. Note that, the bottom of the groove 600 may have a curvature as shown in FIG. 13B. Alternatively, the groove 600 can be formed by a shape whose cross-section is a triangle as shown in FIG. 13C. Note that, although the rigidity at the base of the tongue part is decreased by forming the groove 600 in the above, the rigidity can be decreased by performing a bending process on the base of the tongue part as shown in FIG. 13D.

FIG. 14 is a view showing a comparative example of the panel 400.

In the panel 400 shown in FIG. 14, the second score line 450 which has already been explained above is not provided. In the panel 400, as explained in the first exemplary embodiment, the score line 460 corresponding to the aforementioned first score line 430 is provided. Here, although the first score line 430 shown in FIG. 2 is formed to have a symmetrical relation with respect to the first virtual line CL1 as a center, the score line 460 in the exemplary embodiment is not arranged to have a symmetrical relation with respect to any line.

Here, the score line 460 has one end 461 and the other end 462 similarly to the aforementioned first score line 430. The shape extending from the one end 461 to the top part 460A of the score line 460 is the same as the shape extending from the one end 431 to the top part 433A of the aforementioned first score line 430 (refer to FIG. 2). On the other hand, the shape extending from the top part 460A to the other end 462 is different from the shape extending from the top part 433A to the other part 432 of the first score line 430.

More specifically, the other end 462 of the score line 460 is provided in the vicinity of the protrusion 420. The other end 462 is provided within a region where the one end 461 is provided out of two regions facing each other across the first virtual line CL1. In the exemplary embodiment, the score line 460 extends from the other end 462 as a start point to the one end 461 as an end point. More specifically, the score line 460 firstly passes between the protrusion 420 and the top part 460A from the other end 462 as a start point.

Then, the score line 460 travels around the protrusion 420 and toward a side opposite to the side where the top part 460A of the score line 460 is provided. After that, the score line 460 bends and the travelling direction thereof is reversed. More specifically, the score line 460 travels in the direction away from the protrusion 420 and the direction toward the outer peripheral edge 410 of the panel 400 while making an arc. Further, the score line 460 travels toward the top part 460A of the score line 460. Finally, the score line 460 reaches the one end 461. Note that, the aforementioned bending section of the score line 460 is hereinafter referred to as "a bending part" in this description.

Here, when the tab 500 is operated and the opening is formed on the drink can 100, the fracture of the panel 400 occurs at the section of the score line 460 which is located between the extrusion 420 and the top part 460A of the score line 460 similarly to the above. Then, the fracture of the panel 400 progresses to the aforementioned one end 461 of the score line 460 via the top part 460A of the score line 460. Thereby, similarly to the above, the tongue part is formed and the opening serving as a tap is formed in the panel 400. Here, in the score line 460 shown in FIG. 14, the bending part is formed as mentioned above. Accordingly, the fracture of the aforementioned panel 400 shown in FIG. 2 progresses easier than the fracture of the panel 400 shown in FIG. 14.

As further explanation, in the case where the protrusion 420 is provided in the middle of the tongue part instead of the base of the tongue part and only one score line is provided without the second score line 450 like the aforementioned score line 460 as shown in FIG. 14, the bending part is formed as mentioned above. In order to make the opening bigger without making the panel 400 and the tab 500 bigger, the score line 460 is to extend to the side opposite to the side where the top part 460A of the score line 460 is provided with respect to the second virtual line CL2 passing through the protrusion 420 as shown in FIG. 14. Also in this case, the bending part is formed. If the bending part is formed as mentioned above, the situation in which the fracture of the panel 400 is difficult to progress is caused. On the other hand, in the configuration of the exemplary embodiment shown in FIG. 2, although the protrusion 420 is provided in the middle of the tongue part similarly to FIG. 14, since the second score line 450 is provided, the aforementioned bending part is not configured to be formed. Accordingly, in the configuration according to the exemplary embodiment, in spite of providing the protrusion 420 in the middle of the tongue part, the fracture of the panel 400 is easy to progress.

In the configuration shown in FIG. 14, a clearance between the load application point where the load from the tab 500 acts on the panel 400 (corresponding to the aforementioned region RA) and the score line 460 increases as the score line 460 travels from the other end 462 toward the aforementioned bending part. If the clearance becomes large as mentioned above, the load is difficult to act on the score line 460, and thus the fracture of the panel 400 is difficult to occur. In this case, the operation load of the tab 500 when the opening is formed in the panel 400 is caused to increase.

On the other hand, in the configuration according to the exemplary embodiment, the second score line 450 is configured to be connected to the section located between the one end 431 and the other end 432 of the first score line 430 instead of the one end 431 or the other end 432 of the first score line 430 as shown in FIG. 2, and the clearance between the aforementioned load application point and the score line becomes small in comparison with the configuration shown in FIG. 14. Accordingly, in the configuration according to the exemplary embodiment, the operation load of the tab 500 when the opening is formed in the panel 400 becomes small in comparison with the configuration shown in FIG. 14.

Note that, in the exemplary embodiment, although explanation has been given for the case where the second score line 450 is provided to gradually get away from the second virtual line CL2 as an example, as shown in FIG. 2, as long as the configuration in which the second score line 450 is connected to the section located between the one end 431 and the other end 432 of the first score line 430 is adopted, the fracture of the score line is easy to progress and the operation load of the tab 500 when the opening is formed in the panel 400 becomes small in comparison with the configuration of FIG. 14.

For example, even in the case where the second score line 450 travels to gradually come close to the side where the protrusion 420 is provided (the case where the second score line 450 travels to gradually come close to the third virtual line CL3), as long as the configuration in which the second score line 450 is connected to the aforementioned section located between the one end 431 and the other end 432 is adopted, the fracture of the score line is easy to progress in comparison with the configuration of FIG. 14. Further, in this case, the operation load of the tab 500 becomes small in comparison with the configuration of FIG. 14.

Note that, in the case where the fracture of the score line is caused to progress more smoothly and the operation load of the tab 500 is caused to be further reduced, the second score line 450 is preferably provided to gradually get away from the second virtual line CL2 as shown in FIG. 2. That is, in the case where the second score line 450 is provided to gradually get away from the second virtual line CL2 shown in FIG. 2, the second score line 450 comes closer to the region RA of the panel 400 which is pressed by the tab 500 in comparison with the case where the second score line 450 is provided to gradually come close to the third virtual line CL3. In this case, the fracture of the score line is easy to progress and the operation load of the tab 500 becomes small in comparison with the case where the second score line 450 is provided to gradually come close to the third virtual line CL3.

REFERENCE SIGNS LIST

200 . . . Container body
300 . . . Can lid
400 . . . Panel
410 . . . Outer peripheral edge
430 . . . First score line
431 . . . One end
432 . . . The other end
433A . . . Top part
450 . . . Second score line
500 . . . Tab
521 . . . First slit
522 . . . Second slit
523 . . . Groove
560 . . . Stretch part
900 . . . Rivet
CL1 . . . First virtual line
CP . . . Central part

The invention claimed is:

1. A can lid comprising:

a panel that is attached to an opening of a can body;

a score line that is formed in the panel and has a first score line and a second score line;

the first score line is formed in the panel, having one end and an other end, is formed to expand toward a peripheral edge side of the panel, and has a top part on the peripheral edge side;

a tab that is operated by a user, and presses a section of the panel which is surrounded by the first score line;

a rivet that secures the tab to a section of the panel which is surrounded by the first score line and which is located on the top part side relative to the one end and the other end of the first score line; and the second score line is provided to pass between a section of the panel which is pressed by the tab and the rivet, and is provided to be connected to the first score line, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

2. The can lid according to claim 1, wherein the second score line is provided to be connected to a section of the first score line which is located between the one end and the other end.

3. The can lid according to claim 1, wherein an other end portion side of the tab located on a side opposite to one end portion side which presses the panel is operated by the user and moves in a direction away from the panel, and thereby the one end portion side moves toward the panel and presses the panel, so that the tab applies pressure on the panel, the tab is provided with a connection portion between the other end portion side of the tab and the rivet, the connection portion connecting the other end portion side and the rivet, operation force from the user is transmitted to the rivet via the connection portion when the user operates the other end portion side and the other end portion side is displaced in the direction away from the panel, and the rivet is pulled toward the direction away from the panel, and a rotation moment acts on the section of the panel which is surrounded by the first score line, which is caused by pulling the rivet and applying the pressure of the one end portion side of the tab on the panel.

4. The can lid according to claim 3, wherein the connection portion is configured to stretch until the other end portion side of the tab moves in the direction away from the panel and an angle of the tab with respect to the panel becomes a predetermined angle.

5. The can lid according to claim 1, wherein the other end portion side of the tab which is located on the side opposite to the one end portion side pressing the panel is operated by the user and moves in the direction away from the panel, and thereby the one end portion side moves toward the panel, so that the tab applies the pressure on the panel, and the tab is provided with a rigidity decrease part between the other end portion side and a support portion supported by the rivet, the rigidity decrease part having lower rigidity than other portions of the tab, and the tab folds by use of the rigidity decrease part when the other end portion side of the tab which has moved in the direction away from the panel is operated to come close to the panel by a user.

6. The can lid according to claim 1, wherein any one of a concavity and a convex is formed at a section of the panel which is located between the one end and the other end of the first score line.

7. A can lid comprising:

a panel that is attached to an opening of a can body and is formed into a disk;

a score line that is formed in the panel and has a first score line and a second score line;

the first score line is formed in the panel, and has a top part, one end and an other end, the top part being arranged within one region out of two regions facing each other across a virtual line passing through a central part of the panel, the one end and the other end being arranged within the other region out of the two regions;

a tab that is operated by a user, and presses a section of the panel which is surrounded by the first score line;

a rivet that secures the tab to a section of the panel which is surrounded by the first score line and which is located within the one region; and the second score line is provided to pass between a section of the panel which is pressed by the tab and the rivet, and is provided to be connected to the first score line, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

8. A drink can comprising:

a can body that has an opening and contains drink therein; and a can lid that seals the opening of the can body, wherein the can lid comprises:

a panel that is attached to the opening of the can body;

a score line that is formed in the panel and has a first score line and a second score line;

the first score line is formed in the panel and is formed into a U-shape in a case where the panel is viewed from a front side, and that has one end and an other end, and a top part on a peripheral edge side of the panel;

a tab that is operated by a user and presses a section of the panel which is surrounded by the first score line;

a rivet that secures the tab to a section of the panel which is surrounded by the first score line and which is located on the top part side relative to the one end and the other end of the first score line; and the second score line is provided to pass between the section of the panel which is pressed by the tab and the rivet, and is provided to be connected to the first score line, wherein the score line branches at a connection portion between the first score line and the second score line forming a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

9. A can lid comprising:

a panel that is attached to an opening of a can body;

a score line that is formed in the panel and has a first score line and a second score line;

the first score line is formed in the panel, has one end and an other end, and is formed to expand toward a peripheral edge side;

a tab that has one end portion and an other end portion, is arranged along one direction from the central part side of the panel toward the peripheral edge side of the panel, and presses a section of the panel which is surrounded by the first score line;

a rivet that secures a section of the tab which is located between the one end portion and the other end portion to the panel; and the second score line is formed along a direction intersecting with the one direction while being provided to pass between a section of the panel which is pressed by the tab and the rivet, and that is connected to a section of the first score line which is located between the one end and the other end, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

10. The can lid according to claim 9, wherein the first score line formed to expand toward the peripheral edge side of the panel has a top part on the peripheral edge side, and the second score line travels to get away from a straight line which is orthogonal to a straight line passing through the top part of the first score line and a central part of the panel and which passes through the rivet, and is connected to the first score line, after passing between the section which is pressed by the tab and the rivet.

11. The can lid according to claim 9, wherein the first score line formed to expand toward the peripheral edge side of the panel has a top part on the peripheral edge side, and the second score line is provided to connect any one of a section of the first score line which is located between the top part and the one end and a section of the first score line which is located between the top part and the other end.

12. A can lid comprising:

a panel that is attached to an opening of a can body;

a first score line that is formed in the panel, has one end and an other end, and is formed to expand toward a peripheral edge side;

a tab that has one end portion and an other end portion, is arranged along one direction from the central part side of the panel toward the peripheral edge side of the panel, and presses a section of the panel which is surrounded by the first score line;

a rivet that secures a section of the tab which is located between the one end portion and the other end portion to the panel; and a second score line that is formed along a direction intersecting with the one direction while being provided to pass between a section of the panel which is pressed by the tab and the rivet, and that is connected to a section of the first score line which is located between the one end and the other end, wherein the first score line formed to expand toward the peripheral edge side of the panel has a top part on the peripheral edge side, the second score line travels to get away from a straight line which is orthogonal to a straight line passing through the top part of the first score line and a central part of the panel and which passes through the rivet, and is connected to the first score line, after passing between the section which is pressed by the tab and the rivet, and the rivet secures the tab to a section of the panel which is surrounded by the first score line and which is located on the top part side relative to the one end and to the other end of the first score line.

13. A drink can comprising:

a can body that has an opening and contains drink therein; and a can lid that seals the opening of the can body, wherein the can lid comprises:

a panel that is attached to the opening of the can body;

a score line that is formed in the panel and has a first score line and a second score line;

the first score line is formed in the panel, has one end and an other end, and is formed to expand toward a peripheral edge side of the panel;

a tab that has one end portion and an other end portion, is arranged along one direction from the central part side of the panel toward the peripheral edge side of the panel, and presses a section of the panel which is surrounded by the first score line;

a rivet that secures a section of the tab which is located between the one end portion and the other end portion to the panel; and the second score line is formed along a direction intersecting with the one direction while being provided to pass between a section of the panel which is pressed by the tab and the rivet, and that is connected to a section of the first score line which is located between the one end and the other end, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

14. A can lid comprising:

a panel that is attached to an opening of a can body;

a score line that is formed in the panel and has a first score line and a second score line;

the first score line is formed in the panel, has one end and an other end, is formed to expand toward a peripheral edge side of the panel, and has a top part on the peripheral edge side;

a tab that has one end portion and an other end portion, the one end portion pressing a predetermined section of the panel which is located within a region surrounded by the first score line;

a rivet that is provided in the central part side of the panel relative to the one end portion of the tab, and secures a section of the tab which is located between the one end portion and the other end portion to the panel; and the second score line is formed in the panel, is provided to be connected to a section of the first score line which is located between the other end and the top part, is provided to head toward an inside of the region which is surrounded by the first score line from the connection portion with the first score line, and is provided to pass on a side where the rivet is provided rather than the predetermined section, wherein fracture of the panel progresses along the second score line and toward the connection portion by applying pressure of the tab on the predetermined section of the panel, the fracture of the panel further progresses from the connection portion toward the one end of the first score line, and the fracture of the panel progresses from the connection portion toward the other end of the first score line after the fracture progresses to a predetermined point of the first score line, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

15. The can lid according to claim 14, wherein the second score line is provided to pass between the predetermined section and the rivet.

16. A can lid comprising:

a panel that is attached to an opening of a can body;

a first score line that is formed in the panel, has one end and an other end, is formed to expand toward a peripheral edge side of the panel, and has a top part on the peripheral edge side;

a tab that has one end portion and an other end portion, the one end portion pressing a predetermined section of the panel which is located within a region surrounded by the first score line;

a rivet that is provided in the central part side of the panel relative to the one end portion of the tab, and secures a section of the tab which is located between the one end portion and the other end portion to the panel; and a second score line that is formed in the panel, is provided to be connected to a section of the first score line which is located between the other end and the top part, is provided to head toward an inside of the region which is surrounded by the first score line from the connection portion with the first score line, and is provided to pass on a side where the rivet is provided rather than the predetermined section, wherein fracture of the panel progresses along the second score line and toward the connection portion by applying pressure of the tab on the predetermined section of the panel, the fracture of the panel further progresses from the connection portion toward the one end of the first score line, and the fracture of the panel progresses from the connection portion toward the other end of the first score line after the fracture progresses to a predetermined point of the first score line, wherein the rivet secures the tab to a section of the panel which is located within the region surrounded by the first score line and which is located on the top part side relative to the one end and the other end of the first score line, the other end portion side of the tab which is located on a side opposite to the one end portion side is operated by a user and moves in a direction away from the panel and thereby the one end portion side moves toward the panel, so that the panel is pressed by the moving one end portion, a transmission portion that connects the tab and the rivet and transmits a load from the tab to the rivet is provided between the other end portion side of the tab and the rivet, operation force from the user is transmitted to the rivet via the transmission portion when the user operates the other end portion side and the other end portion side is displaced in the direction away from the panel, and the rivet is pulled toward the direction away from the panel, and a rotation moment acts on the section located on the top part side relative to the one end and the other end of the first score line, which is caused by pulling the rivet and applying the pressure of the one end portion of the tab on the panel.

17. A can lid comprising:

a panel that is attached to an opening of a can body;

a score line that is formed in the panel and has a first score line and a second score line;

the first score line is formed in the panel, has one end and an other end, is formed to expand toward a peripheral edge side of the panel, and has a top part on the peripheral edge side;

a tab that has one end portion and an other end portion, the one end portion pressing a predetermined section of the panel which is located within a region surrounded by the first score line;

a rivet that is provided in the central part side of the panel relative to the one end portion of the tab, and secures a section of the tab which is located between the one end portion and the other end portion to the panel; and the second score line is formed in the panel, is provided to be connected to a section located between the other end and the top part of the first score line, is provided to head toward an inside of the region surrounded by the first score line from the connection portion with the first score line, and is provided to pass on a side where the rivet is provided rather than the predetermined section, wherein in the region of the panel which is surrounded by the first score line, a first region located on the top part side of the first score line relative to the second score line and a second region located on a side opposite to the first region with respect to the second score line are formed, and fracture of the panel progresses along the second score line and toward the connection portion by applying pressure of the one end portion of the tab on the predetermined section located within the first region, the fracture of the panel further progresses from the connection portion toward the one end of the first score line and thereby an opening is formed in the first region, the one end portion of the tab enters the opening that has been formed and thereby the second region is pressed by the tab, and, by the pressure, the fracture of the panel progresses from the connection toward the other end of the first score line, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

18. The can lid according to claim 17, wherein the one end portion of the tab does not come in contact with the second region when the tab is operated by a user and the predetermined section located within the first region is pressed by the one end portion of the tab.

19. The can lid according to claim 17, wherein the second score line is provided to pass between the predetermined section and the rivet.

20. A drink can comprising:

a can body that has an opening and contains drink therein; and a can lid that seals the opening of the can body, wherein the can lid comprises:

a panel that is attached to the opening of the can body;

a score line that is formed in the panel and has a first score line and a second score line;

the first score line is formed in the panel, has one end and an other end, is formed to expand toward a peripheral edge side of the panel, and has a top part on the peripheral edge side;

a tab that has one end portion and an other end portion, the one end portion pressing a predetermined section of the panel which is located within a region surrounded by the first score line;

a rivet that is provided in the central part side of the panel relative to the one end portion of the tab, and secures a section of the tab which is located between the one end portion and the other end portion to the panel; and the second score line is formed in the panel, is provided to be connected to a section of the first score line which is located between the other end and the top part, is provided to head toward an inside of the region surrounded by the first score line from the connection portion with the first score line, and is provided to pass on a side where the rivet is provided rather than the predetermined section, wherein fracture of the panel progresses along the second score line and toward the connection portion by applying pressure of the tab on the predetermined section of the panel, the fracture of the panel further progresses from the connection portion toward the one end of the first score line, and the fracture of the panel progresses from the connection portion toward the other end of the first score line after the fracture progresses to a predetermined point of the first score line, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

21. A can lid comprising:

a panel that is attached to an opening of a can body;

a score line that is formed in the panel and has a first score line and a second score line;

a rivet that is provided in the panel;

a tab that is secured to the panel with the rivet while being arranged along one direction from a peripheral edge of the panel toward the rivet, and presses the panel;

the first score line is formed in the panel, has one end and an other end, and is formed to surround a pressed section of the panel which is pressed by the tab; and the second score line is formed within a region of the panel which is surrounded by the first score line, that is provided to extend in a direction intersecting with the one direction from a first second-score line end located within the region as a start point, and that is connected to the first score line at a second second-score line end, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

22. The can lid according to claim 21, wherein the second score line is formed to pass by a section other than the pressed section.

23. The can lid according to claim 21, wherein a side of the first second-score line end is arranged in the vicinity of the pressed section.

24. The can lid according to claim 21, wherein the second score line is formed to pass on a side where the rivet is provided rather than the pressed section, and the second score line is provided to pass between the pressed section and the rivet.

25. The can lid according to claim 24, wherein the second score line gradually gets away from a straight line passing the rivet and heading toward a direction orthogonal to the one direction as heading toward the other second second-score line end from the first second-score line end.

26. The can lid according to claim 21, wherein the first score line is formed to expand toward the peripheral edge side of the panel, and has a top part on the peripheral edge side; and the other end of the second score line is connected to any one of a section of the first score line which is located between the one end and the top part and a section of the first score line which is located between the other end and the top part.

27. A drink can comprising:

a can body that has an opening and contains drink therein; and a can lid that seals the opening of the can body, wherein the can lid comprises:

a panel that is attached to the opening of the can body;

a score line that is formed in the panel and has a first score line and a second score line;

a rivet that is provided in the panel;

a tab that is secured to the panel with the rivet while being arranged along one direction from a peripheral edge of the panel toward the rivet, and presses the panel;

the first score line is formed in the panel, has one end and an other end, and is formed to surround a pressed section of the panel which is pressed by the tab; and the second score line is formed within a region of the panel which is surrounded by the first score line, that is provided to extend in a direction intersecting with the one direction from a first second-score line end located within the region as a start point, and that is connected to the first score line at a second second-score line end, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

28. A can lid comprising:

a panel that has an outer peripheral edge and is attached to an opening of a can body;

a score line that is formed in the panel and has a first score line and a second score line;

a rivet that is provided in the panel;

a tab that is secured to the panel with the rivet while being arranged along one direction from the outer peripheral edge of the panel toward the rivet, and presses the panel;

the first score line is formed in the panel, has one end and an other end, and is formed to surround a pressed section of the panel which is pressed by the tab; and the second score line is formed in the panel, is provided to be connected to the first score line, and is provided to head toward an inside of a region surrounded by the first score line from a connection portion with the first score line, wherein the connection portion is provided at a section other than an intersection where a center line of the tab along the one direction and the first score line intersect with each other, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

29. A can lid comprising:

a panel that has an outer peripheral edge and is attached to an opening of a can body;

a rivet that is provided in the panel;

a tab that is secured to the panel with the rivet while being arranged along one direction from the outer peripheral edge of the panel toward the rivet, and presses the panel;

a first score line that is formed in the panel and is formed to surround a pressed section of the panel which is pressed by the tab; and a second score line that is formed in the panel, is provided to be connected to the first score line, and is provided to head toward an inside of a region surrounded by the first score line from a connection portion with the first score line, wherein the connection portion is provided at a section other than an intersection where a center line of the tab along the one direction and the first score line intersect with each other, wherein the rivet is provided within the region surrounded by the first score line, and the connection portion is provided on a side where the intersection is located relative to a straight line orthogonal to the center line of the tab and the straight line passing the rivet.

30. The can lid according to claim 28, wherein the second score line heading toward the inside of the region surrounded by the first score line from the connection portion passes on a side where the rivet is provided rather than the pressed section, wherein the second score line heading toward the inside of the region surrounded by the first score line from the connection portion passes between the pressed section and the rivet.

31. A can lid comprising:

a panel that has an outer peripheral edge and is attached to an opening of a can body;

a score line that is formed in the panel and has a first score line and a second score line;

a rivet that is provided in the panel;

a tab that is secured to the panel with the rivet while being arranged along one direction from the outer peripheral edge of the panel toward the rivet, and presses the panel;

the first score line is formed to surround a pressed section of the panel which is pressed by the tab, is formed to be symmetrical with respect to a center line of the tab along the one direction as a symmetrical axis, has one end arranged on one region out of two regions facing each other across the center line and an other end arranged on the other region out of the two regions, and is formed to expand toward the outer peripheral edge side of the panel; and the second score line is formed in the panel, is provided to be connected to the first score line, and is provided to head toward an inside of a region surrounded by the first score line from a connection portion with the first score line, wherein the connection portion is provided so that length of a section of the first score line which is located between one end and the connection portion and length of a section of the first score line which is located between the other end and the connection portion are different from each other, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

32. The can lid according to claim 31, wherein the connection portion is provided at a section other than the one end of the first score line and at a section other than the other end of the first score line.

33. A can lid comprising:

a panel that has an outer peripheral edge and is attached to an opening of a can body;

a rivet that is provided in the panel;

a tab that is secured to the panel with the rivet while being arranged along one direction from the outer peripheral edge of the panel toward the rivet, and presses the panel;

a first score line that is formed to surround a pressed section of the panel which is pressed by the tab, is formed to be symmetrical with respect to a center line of the tab along the one direction as a symmetrical axis, has one end arranged on one region out of two regions facing each other across the center line and an other end arranged on the other region out of the two regions, and is formed to expand toward the outer peripheral edge side of the panel; and a second score line that is formed in the panel, is provided to be connected to the first score line, and is provided to head toward an inside of a region surrounded by the first score line from a connection portion with the first score line, wherein the connection portion is provided so that length of a section of the first score line which is located between the one end and the connection portion and length of a section of the first score line which is located between the other end and the connection portion are different from each other, wherein the connection portion is provided on a side where the pressed section is located relative to a straight line orthogonal to the center line of the tab and the straight line passing the rivet.

34. The can lid according to claim 33, wherein the second score line has a first second-score line end and a second second-score line end, the first second-score line end is located within the region surrounded by the first score line, and the second second-score line end is connected to the first score line at the connection portion, and the second score line gradually gets away from the straight line passing the rivet as travelling from the first second score-line end toward the second second-score line end.

35. The can lid according to claim 34, wherein the second score line passes by the pressed section when travelling from the first second-score line end toward the second second-score line end.

36. A drink can comprising:

a can body that has an opening and contains drink therein; and a can lid that seals the opening of the can body, wherein the can lid comprises:

a panel that has an outer peripheral edge and is attached to the opening of the can body;

a score line that is formed in the panel and has a first score line and a second score line;

a rivet that is provided in the panel;

a tab that is secured to the panel with the rivet while being arranged along one direction from the outer peripheral edge of the panel toward the rivet, and presses the panel;

the first score line is formed in the panel, has one end and an other end, and is formed to surround a pressed section of the panel which is pressed by the tab; and the second score line is formed in the panel, is provided to be connected to the first score line, and is provided to head toward an inside of a region surrounded by the first score line from a connection portion with the first score line, wherein the connection portion is provided at a section other than an intersection where a center line of the tab along the one direction and the first score line intersect with each other, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

37. A drink can comprising:

a can body that has an opening and contains drink therein; and a can lid that seals the opening of the can body, wherein the can lid comprises:

a panel that has an outer peripheral edge and is attached to the opening of the can body;

a score line that is formed in the panel and has a first score line and a second score line;

a rivet that is provided in the panel;

a tab that is secured to the panel with the rivet while being arranged along one direction from the outer peripheral edge of the panel toward the rivet, and presses the panel;

the first score line is formed to surround a pressed section of the panel which is pressed by the tab, is formed to be symmetrical with respect to a center line of the tab along the one direction as a symmetrical axis, has one end arranged on one region out of two regions facing each other across the center line and an other end arranged on the other region out of the two regions, and is formed to expand toward the outer peripheral edge side of the panel; and the second score line is formed in the panel, is provided to be connected to the first score line, and is provided to head toward an inside of a region surrounded by the first score line from a connection portion with the first score line, wherein the connection portion is provided so that length of a section of the first score line which is located between the one end and the connection portion and length of a section of the first score line which is located between the other end and the connection portion are different from each other, wherein the score line branches at a connection portion between the first score line and the second score line to form a branching of the score line, the branching of the score line at the connection point being in between the one end and the other end of the first score line, and, after fracture of the panel progresses along the second score line to the connection portion, the fracture of the panel progresses from the connection portion to the one end of the first score line and to the other end of the first score line, respectively.

38. A can lid comprising:

a panel that is attached to an opening of a can body;

a score line that is formed in the panel and fractures when an opening is formed in the panel;

a tab that has one end portion and an other end portion, the one end portion coming in contact with the panel and pressing a section of the panel which is surrounded by the score line due to operation of the other end portion side by a user;

a rivet that secures a section of the tab which is located between the one end portion and the other end portion to the panel; and a stretch part that is provided on the other end portion side of the tab relative to the rivet, has one end connected to the rivet and an other end connected to the tab, and stretches until an angle of the tab displaced in accordance with movement of the other end portion in a direction away from the panel which is caused by the user's operation on the other end portion of the tab becomes a predetermined angle with respect to the panel.

39. The can lid according to claim 38, wherein the stretch part stops stretching in a case where the angle of the tab with respect to the panel becomes the predetermined angle.

40. The can lid according to claim 38, wherein the score line is formed into a U-shape in a case where the panel is viewed from a front side, has one end and an other end, and has a top part on a peripheral edge side of the panel, and the rivet secures the tab to the section of the panel which is surrounded by the score line and a section located on the top part side relative to the one end and the other end of the score line.

41. The can lid according to claim 40, wherein operation force from the user is transmitted to the rivet via the stretch part when the other end portion of the tab is operated by the user and moves in the direction away from the panel, and the rivet is pulled in the direction away from the panel, the other end portion of the tab is operated by the user and thereby the one end portion comes in contact with the section which is surrounded by the score line and applies pressure on the section, and a rotation moment acts on the section surrounded by the score line, which is caused by pulling the rivet and applying the pressure of the one end portion of the tab on the section.

42. The can lid according to claim 38, wherein the stretch part is formed by a sheet and has a bending part where the sheet bends, and the stretching is performed by stretching of the bending part.

43. The can lid according to claim 38, wherein the stretch part is provided with a sheet in which any one of a slit and a groove that is capable of fracturing is formed, the sheet is formed into a shape like a string by pulling a part of the sheet due to a load from the tab, and the stretching of the stretch part is performed.

44. The can lid according to claim 38, wherein the stretch part is integrally formed with the tab.

45. A drink can comprising:

a can body that has an opening and contains drink therein; and a can lid that seals the opening of the can body, wherein the can lid comprises:

a panel that is attached to the opening of the can body;

a score line that is formed in the panel and fractures when an opening is formed in the panel;

a tab that has one end portion and an other end portion, the one end portion coming in contact with the panel and pressing a section of the panel which is surrounded by the score line, due to operation of the other end portion side by a user;

a rivet that secures a section of the tab which is located between the one end portion and the other end portion to the panel; and a stretch part that is provided on the other end portion side of the tab relative to the rivet, has one end connected to the rivet and an other end connected to the tab, and stretches until an angle of the tab displaced in accordance with movement of the other end portion in a direction away from the panel caused by an user's operation on the other end portion of the tab becomes a predetermined angle with respect to the panel.

46. The can lid according to claim 1, wherein the one end and the other end of the first score line extend past the rivet on a side of the panel opposite from the top part along a diameter of the can.

* * * * *